US005401621A

United States Patent [19]

Kojima et al.

[11] Patent Number: 5,401,621

[45] Date of Patent: Mar. 28, 1995

[54] METHOD OF FIXING AND BLEACH-FIXING A SILVER HALIDE PHOTOGRAPHIC MATERIAL USING MESOIONIC COMPOUNDS

[75] Inventors: Tetsuro Kojima; Nobuo Watanabe, both of Kanagawa, Japan

[73] Assignee: Fuji Photo Film Co., Ltd., Kanagawa, Japan

[21] Appl. No.: 741,426

[22] PCT Filed: Dec. 4, 1990

[86] PCT No.: PCT/JP90/01574

§ 371 Date: Aug. 2, 1991

§ 102(e) Date: Aug. 2, 1991

[87] PCT Pub. No.: WO91/08517

PCT Pub. Date: Jun. 13, 1991

[30] Foreign Application Priority Data

| | | | |
|---|---|---|---|
| Dec. 4, 1989 | [JP] | Japan | 1-314974 |
| Aug. 1, 1990 | [JP] | Japan | 2-204430 |
| Aug. 3, 1990 | [JP] | Japan | 2-206070 |

[51] Int. Cl.[6] ..... G03C 7/00; G03C 5/38; G03C 11/00; G03C 5/18

[52] U.S. Cl. ..... 430/393; 430/372; 430/428; 430/429; 430/430; 430/455; 430/460

[58] Field of Search ..... 430/372, 393, 428, 429, 430/430, 455, 460, 567

[56] References Cited

U.S. PATENT DOCUMENTS

| | | | |
|---|---|---|---|
| 3,716,362 | 2/1973 | Meier | 430/430 |
| 4,003,910 | 1/1977 | Bartels-Keith et al. . | |
| 4,378,424 | 3/1983 | Altland et al. | 430/352 |
| 4,615,970 | 10/1986 | Kojima et al. | 430/372 |
| 4,624,913 | 11/1986 | Miyasaka et al. | 430/444 |
| 4,631,253 | 12/1986 | Mituno et al. | 430/611 |
| 4,939,075 | 7/1990 | Bergthaller et al. | 430/430 |
| 5,068,170 | 11/1991 | Abe | 430/393 |

FOREIGN PATENT DOCUMENTS

| | | | |
|---|---|---|---|
| 0054415 | 6/1982 | European Pat. Off. . | |
| 0321839 | 6/1989 | European Pat. Off. . | |
| 0431568 | 6/1991 | European Pat. Off. . | |
| 62-253161 | 11/1987 | Japan . | |
| 1-201659 | 8/1989 | Japan . | |
| 2-044355 | 2/1990 | Japan . | |
| 2-139547 | 5/1990 | Japan . | |
| 4143757 | 5/1992 | Japan | 430/460 |
| 4229860 | 8/1992 | Japan | 430/455 |
| 4365035 | 12/1992 | Japan | 430/455 |
| 5034872 | 2/1993 | Japan | 430/455 |
| 9108517 | 6/1991 | WIPO | 430/455 |

OTHER PUBLICATIONS

U.S. Statutory Invention Registration H953, Aug. 1991, Goto et al., Research Disclosure 20430, pp. 159–160, Apr. 1981.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A process for processing an imagewise exposed silver halide photographic material comprising a support having thereon at least one light-sensitive silver halide emulsion layer, comprising the steps of developing in a developing bath and processing in a bath having a fixing ability, wherein the bath having the fixing ability contains at least one mesoionic compound represented by formula (I):

In a second embodiment, a process is disclosed for processing an imagewise exposed silver halide color photographic material comprising a support having thereon at least one light-sensitive silver halide emulsion layer, comprising the steps of subjecting the material to color development, and then subjecting the material to blix in a blix bath, wherein the blix bath contains at least one mesoionic compound represented formula (III) or (IV):

(Abstract continued on next page.)

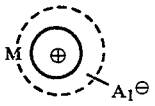
(III)
-continued
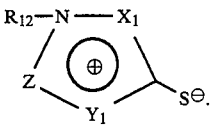
(IV)
14 Claims, No Drawings

METHOD OF FIXING AND BLEACH-FIXING A SILVER HALIDE PHOTOGRAPHIC MATERIAL USING MESOIONIC COMPOUNDS

TECHNICAL FIELD

The present invention relates to a process and composition for the processing of a silver halide photographic material. More particularly, the present invention relates to a process for processing a silver halide photographic material which provides excellent desilvering properties and a processing composition therefor. Further, the present invention relates to a process for processing a silver halide photographic material which is little subject to thermostain on the material after processing and provides excellent desilvering properties and a processing composition therefor.

Moreover, the present invention relates to a process for processing a silver halide color photographic material which is little subject to bleach fogging caused by blix and provides an excellent solution stability and a processing composition therefor.

BACKGROUND ART

In general, the processing of a silver halide color photographic material consists of steps of color development and desilvering. Silver which has been produced in the development step is then oxidized with a bleaching agent and dissolved with a fixing agent. As bleaching agent there may be mainly used a, ferric complex salt, e.g., aminopolycarboxylic acid-ferric complex salt. As fixing agent there may be normally used a thiosulfate.

On the other hand, the processing of a black-and-white photographic light-sensitive material consists of steps of development and removal of unexposed silver halide. Unlike the processing of a color photographic light-sensitive material, the black-and-white photographic light-sensitive material which has been developed is then fixed without being bleached. In this case, too, as fixing agent there is normally used a thiosulfate.

It has been desired to speed up both the color development and the black-and-white development. It has thus been studied to shorten each processing step. This doesn't except the fixing step. Various fixing accelerators have been studied. Little or no effective fixing accelerators have been found. It is possible to use fixing agents other than thiosulfates to-speed up the fixing step.

Examples of fixing agents to replace thiosulfates include 1,2,4-triazolium-3-thiolates of mesoionic compounds as described in U.S. Pat. No. 4,378,424, and JP-A-57-150842 (the term "JP-A" as used herein means an "unexamined published Japanese patent application"). However, no full studies have been made on these fixing agents.

JP-A-1-201659 discloses the use of mesoionic compounds as bleach accelerators in the bleaching bath or blix bath. Further, JP-A-2-44355 discloses the use of 1,2,4-triazolium-3-thiolate compounds as fixing accelerators in the fixing bath. However, the above cited patents give no reference to the effects of the present invention.

Other examples of mesoionic compounds include those disclosed in U.S. Pat. Nos. 4,003,910, 4,675,276, 4,624,913, and 4,631,253, and JP-A-62-217237, JP-A-64-3641, JP-A-60-144737, JP-A-62-253161, JP-A-62-287239, JP-A-61-176920, JP-A-62-96423, and JP-A-1-154056. However, all these mesoionic compounds are intended to be incorporated in the photographic light-sensitive material or the developer. The above cited patents give no reference to the effects of the present invention.

There is an increasing demand for the improvement in the image preservability. For this purpose, studies have been made on both the material to be used in the light-sensitive material and the final processing bath. However, these approaches still leave much to be desired. Thus, there have been not yet attained desired desilvering properties and image preservability. It has thus been desired to drastically improve these properties.

Further, the above mentioned bleaching agent and fixing agent are used in the same bath as blix bath in the processing of a color photographic paper, etc., for the purpose of speeding up the processing. The bleaching agent to be used in the blix bath is normally an ethylenediaminetetraacetic acid-ferric complex salt. It is the recent tendency that an oxidizing agent having a higher oxidizing power (high redox potential) is used in the bleaching bath to further speed up the processing. However, it has been known that such an oxidizing agent causes significant bleach fogging or that if used as blix bath, it causes a problem of solution stability or the like. The solution stability problem is that the thiosulfate is deteriorated by oxidation and then precipitated.

In recent years, this problem has become more remarkable as the replenishment rate decreases. In order to inhibit the oxidation of thiosulates, sulfites are normally used as preservatives. However, if sulfites are used in a large amount, they are oxidized to cause precipitation of Glauber's salt or other problems. Thus, it is difficult to use sulfites as a countermeasure.

On the other hand, U.S. Pat. No. 4,378,424, and JP-A-57-150842 disclose that as fixing agents to replace thiosulfates there may be used mesoionic compounds. However, the above cited patents give no reference to the effects in the blix bath as stated herein.

Moreover, JP-A-2-44355 discloses the incorporation of 1,2,4-triazolium-3-thiolate compounds as fixing accelerators in the fixing bath. JP-A-1-201659 discloses the incorporation of mesoionic compounds as bleach accelerators in the bleach or blix bath. However, the above cited patents give reference neither to the use of mesoionic compounds as fixing agents in the blix bath nor to the effects of the present invention.

If these mesoionic compounds are used as accelerators, they often work well in a small amount. These mesoionic compounds serve to remove substances which are adsorbed by silver halide (or silver). Thus, these approaches greatly differ in the amount of mesoinic compounds to be used and their functions from the present invention, in which mesoionic compounds are used as fixing agents. Therefore, the present invention cannot be easily worked out from the above cited patents.

Further examples of mesoionic compounds are disclosed in U.S. Pat. Nos. 4,003,910, 4,675,276, 4,624,913, and 4,631,253, and JP-A-62-217237, JP-A-64-3641, JP-A-60-144737, JP-A-62-253161, JP-A-62-287239, JP-A-61-176920, JP-A-62-96943, and JP-A-1-154056. However, all these mesoionic compounds are intended to be incorporated in the photographic light-sensitive material or the developer. The above cited patents give no reference to the effects of the present invention.

Thus, it can be said that there have been not yet found a blix bath that can eliminate both the bleach fogging problem and the solution stability problem at the same time.

DISCLOSURE OF THE INVENTION

It is therefore a first object of the present invention to provide a process for processing a silver halide photographic material which provides excellent desilvering properties and is little subject to thermostain after processing.

It is a second object of the present invention to provide a process for processing a silver halide photographic material by using a blix bath which is little subject to bleach fogging and provides an excellent solution stability.

These and other objects of the present invention will become more apparent from the following detailed description and examples.

The first object of the present invention is accomplished by a process for processing a silver halide photographic material which comprises processing an exposed silver halide photographic material comprising a support having thereon at least one light-sensitive silver halide emulsion layer, wherein a bath having a fixing ability contains at least one mesoionic compound represented by the general formula (I):

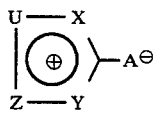

wherein X represents N or C—$R_1$; Y and Z each represents O, S, N, N—$R_2$ or C—$R_3$; U represents O, S or N—$R_4$; and $A^{\ominus}$ represents —$O^{\ominus}$, —$S^{\ominus}$ or —$N^{\ominus}R$ in which $R_1$, $R_2$, $R_3$ and $R_4$ may be the same or different and each represents $-(T)_nR'$ (wherein T represents —S—, —O—, —N(R″)—, $$-\overset{O}{\overset{\|}{C}}-,$$

—C(=S)—, —$SO_2$— or combination thereof; and n represents an integer 0 or 1); R, R′ and R″ may be the same or different and each represents a hydrogen atom, an alkyl group, a cycloalkyl group, an alkenyl group, an alkynyl group or a heterocyclic group, with the proviso that at least one of R, R′ and R″ is substituted by carboxylic acid or sulfonic acid group; and X and U, Y and Z, and Z and U may be ring-closed (This process will be hereinafter referred to as "first embodiment of the present invention").

In the first embodiment of the present invention, examples of the "bath having a fixing ability" include fixing bath and blix bath.

The second object of the present invention is accomplished with a process for processing a silver halide color photographic material, characterized in that the blix bath contains at least one mesoionic compound as fixing agent and is substantially free of other fixing agents (This process will be hereinafter referred to as "second embodiment of the present invention").

The present invention will be further described hereinafter.

The mesoionic compounds to be used in the present invention are compound groups defined in W. Baker and W. D. Ollis, "Quarterly Review", 11, 15 (1957) and "Advances in Heterocyclic Chemistry", 19, 1 (1976). These mesoionic compounds represent 5- or 6-membered heterocyclic compounds which cannot be satisfactorily represented by only one covalent structural formula or polar structural formula and have a sextet of $\pi$-electrons related to all the atoms constituting the ring, the ring being partially positively charged to balance an equal negative charge on atoms or atomic groups outside the ring.

The mesoionic compound represented by the general formula (I) to be used in the bath having a fixing ability used in the first embodiment of the present invention will be further described hereinafter.

In the general formula (I), X represents N or C—$R_1$. Y and Z each represents O, S, N, N—$R_2$ or C—$R_3$. U represents O, S or N—$R_4$. Examples of a heterocyclic group formed of a combination of X, Y, Z and U include imidazoliums, pyrazoliums, oxazoliums, thiazoliums, triazoliums, tetrazoliums, thiadiazoliums, oxadiazoliums, thiatriazoliums, and oxatriazoliums.

$A^{\ominus}$ represents —$O^{\ominus}$, —$S^{\ominus}$ or —$N^{\ominus}R$.

$R_1$, $R_2$, $R_3$ and $R_4$ may be the same or different and each represents $-T)_nR'$ (wherein T represents —S—, —O—, $$-\overset{R''}{\overset{|}{N}}-,\ -\overset{O}{\overset{\|}{C}}-,\ -\overset{S}{\overset{\|}{C}}-,$$

—$SO_2$— or a group formed of an arbitrary combination thereof (e.g., carbamoyl, ureide, thiocarbamoyl, thioureide, sulfamoyl, carbonamide, sulfonamide). The suffix n represents 0 or 1.

R, R′ and R″ may be the same or different and each represents a hydrogen atom, a substituted or unsubstituted $C_{1-6}$ alkyl group (e.g., methyl, ethyl, n-propyl, n-butyl, t-butyl, n-hexyl, hydroxyethyl, dimethylaminoethyl, cyanoethyl, carboxyethyl, carboxymethyl, carboxypropyl, 1,2-dicarboxyethyl, sulfoethyl, sulfopropyl, sulfobutyl, 2-hydroxy-3-sulfopropyl), a substituted or unsubstituted $C_{3-10}$ cycloalkyl group (e.g., cyclopropyl, cyclobutyl, cyclohexyl, 4-hydroxycyclohexyl, 4-carboxycyclohexyl, 4-sulfocyclohexyl), a substituted or unsubstituted $C_{2-8}$ alkenyl group (e.g., vinyl, propenyl, 4-carboxy-2-butenyl), a substituted or unsubstituted $C_{2-8}$ alkynyl group (e.g., propargyl) or a substituted or unsubstituted $C_{1-8}$ heterocyclic group (e.g., 2-pyridyl, 3-pyridyl, 4-pyridyl, 2-thienyl, 1 -pyrazolyl, 1-imidazolyl, 2-tetrahydrofuryl), with the proviso that at least one of R, R′ and R″ is substituted by carboxylic acid or salt thereof (e.g., sodium salt, potassium salt, ammonium salt) or sulfonic acid or salt thereof (e.g., sodium salt, potassium salt, ammonium salt).

X and U, Y and Z, and Z and U may be ring-closed.

If R, R′ and R″ contain substituents other than carboxylic acid and sulfonic acid, examples of such substituents include nitro group, halogen atom (e.g., chlorine, bromine), mercapto group, cyano group, alkyl group (e.g., methyl, ethyl, methoxyethyl), alkoxy group (e.g., methoxy, ethoxy, methoxyethoxy, methylthioethoxy), alkylthio group (e.g., methylthio, dimethylaminoethylthio, methoxyethylthio), sulfonyl group (e.g., methanesulfonyl), carbamoyl group (e.g., unsubstituted carbamoyl, dimethylcarbamoyl), sulfamoyl group (e.g., unsubstituted sulfamoyl, methylsulfamoyl), carbonamide group (e.g., acetamide), sulfonamide group (e.g., methanesulfonamide), acyloxy group (e.g., acetyloxy), sulfonyloxy group (e.g., methanesulfonyloxy), ureide group (e.g., unsubstituted ureide, methylureide), thioureide group (e.g., unsubstituted thioureide), amino group (e.g., unsubstituted amino, dimethylamino), and hydroxy group.

The compound represented by the general formula (I) may form a salt (e.g., acetate, nitrate, salicylate, hydrochloride, iodate, bromate).

In the general formula (I), $A^{\ominus}$ preferably represents $-S^{\ominus}-$. X preferably represents N or C—$R_1$. Y preferably represents O, S, N or N—$R_2$. Z preferably represents N, N—$R_2$ or C—$R_3$. U preferably represents N—$R_4$. When n is 1, T preferably represents

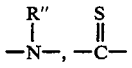

or a combination thereof. R′ and R″ preferably each represents a hydrogen atom or alkyl group. At least one (preferably 1 or 2) of R′ and R″ is preferably an alkyl group substituted by carboxylic acid group or sulfonic acid group.

Preferred among compounds represented by the general formula (I) are those represented by the general formula (II):

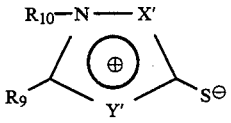

(II)

In the general formula (II), X′ represents N or C—$R_5$. Y′ represents O, S, N—$R_6$ or

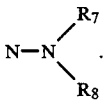

$R_5$, $R_6$, $R_7$, $R_8$, $R_9$ and $R_{10}$ may be the same or different and each represents a substituted or unsubstituted $C_{1-6}$ alkyl group. $R_5$, $R_7$, $R_8$ and $R_9$ each may be a hydrogen atom. It is provided that at least one alkyl group of $R_5$, $R_6$, $R_7$, $R_8$, $R_9$ and $R_{10}$ is substituted by at least one carboxylic acid group or sulfonic acid group.

Specific examples of the compound of the present invention will be set forth below, but the present invention should not be construed as being limited thereto.

A-1.

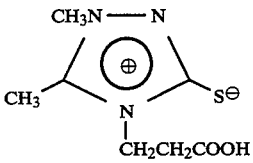

A-2.

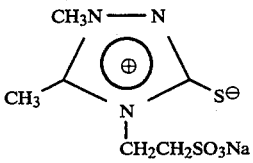

-continued

A-3.

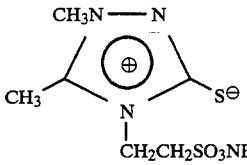

A-4.

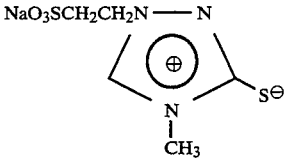

A-5.

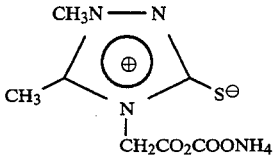

A-6.

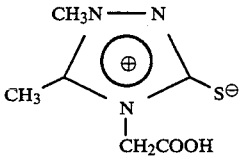

A-7.

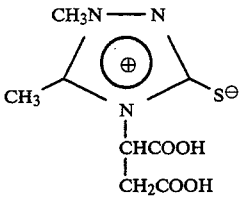

A-8.

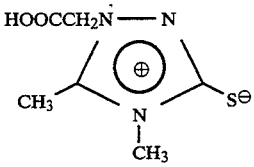

A-9.

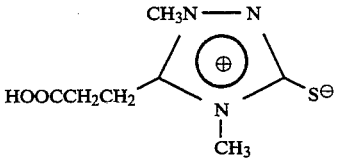

A-10.

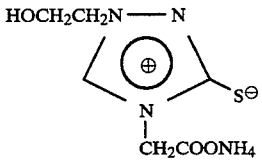

A-11.

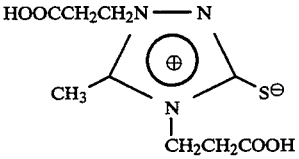

-continued
A-12.
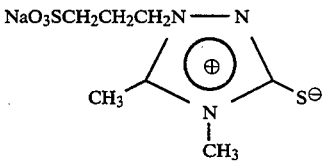
A-13.
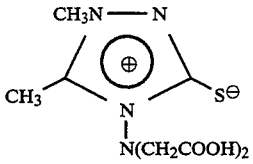
A-14.
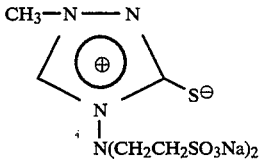
A-15.
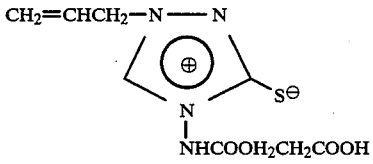
A-16.
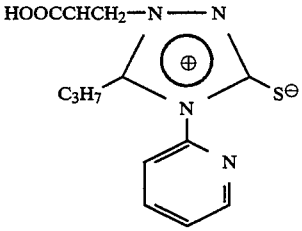
A-17.
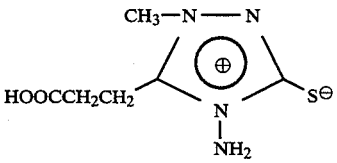
A-18.
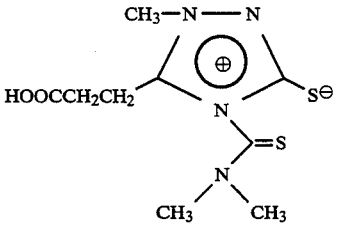
A-19.
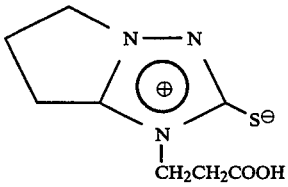
-continued
A-20.
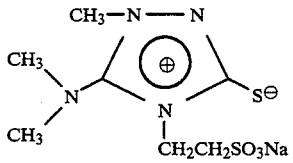
A-21.
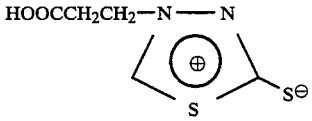
A-22.
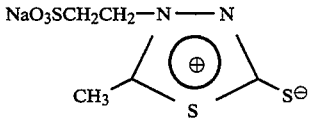
A-23.
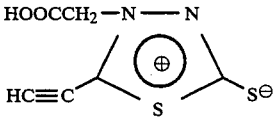
A-24.
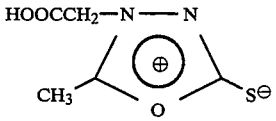
A-25.
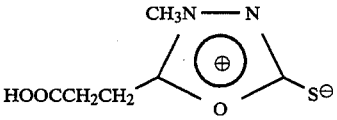
A-26.
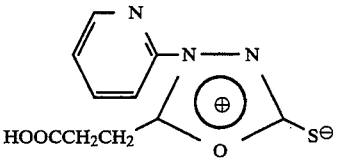
A-27.
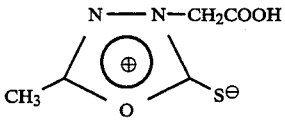
A-28.
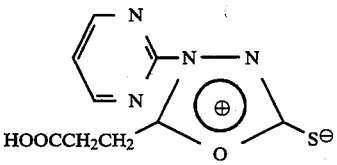
A-29.
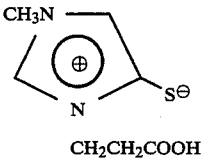
A-30.
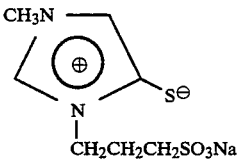

-continued
A-31.
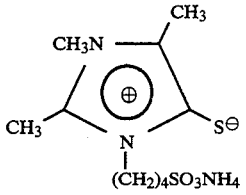
A-32.
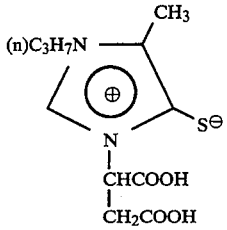
A-33.
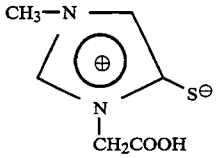
A-34.
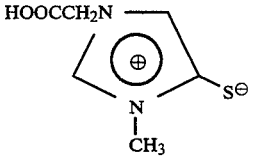
A-35.
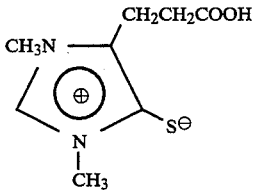
A-36.
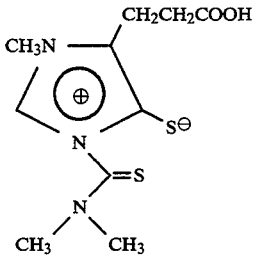
A-37.
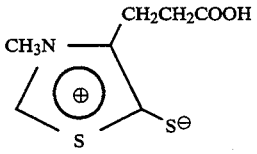
A-38.
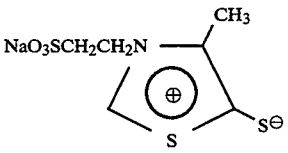
-continued
A-39.
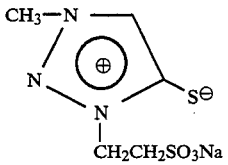
A-40.
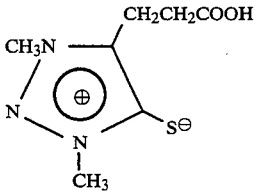
A-41.
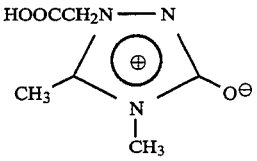
A-42.
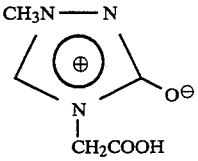
A-43.
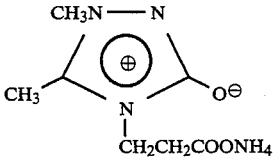
A-44.
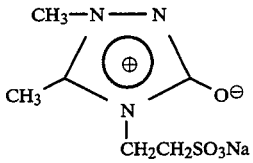
A-45.
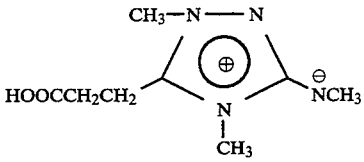
A-46.
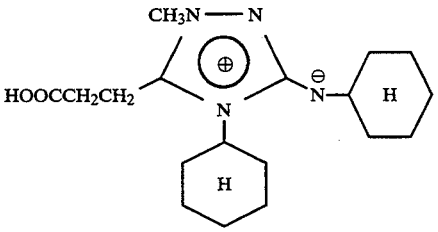

-continued

A-47.

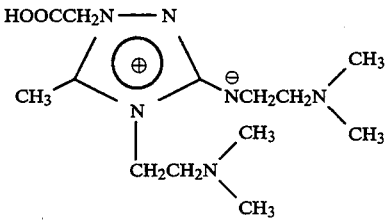

A-48.

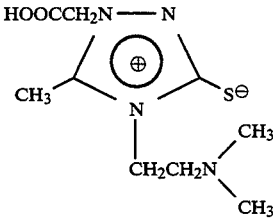

A-49.

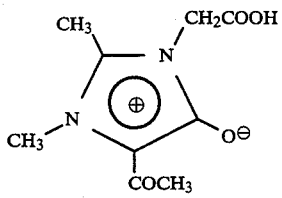

A-50.

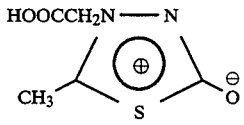

A-51.

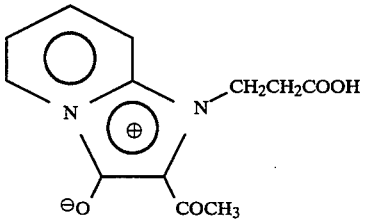

A-52.

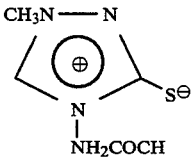

A-53.

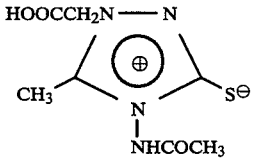

A-54.

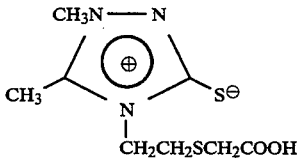

The synthesis of the compound represented by the general formula (I) or (II) can be accomplished by any suitable method as described in "Journal of Heterocyclic Chemistry" 2, 105 (1965), "Journal of Organic Chemistry" 32, 2245 (1967), "Journal of Chemical Society" 3799 (1969), "Journal of American Chemical Society", 80, 1895 (1958), "Chemical Communication", 1222 (1971), "Tetrahedron Letters" 2939 (1972), JP-A-60-87322, "Berichte der Deutschen Chemischen Gesellschaft" 38, 4049 (1905), "Journal of Chemical Society Chemical Communication", 1224 (1971), JP-A-60-122936, JP-A-60-117240, "Advances in Heterocyclic Chemistry", 19, 1 (1976), "Tetrahedron Letters" 5881, (1968), "Journal of Heterocyclic Chemistry", 5, 277 (1968), "Journal of Chemical Society, Parkin Transaction I", 627 (1974), "Tetrahedron Letters" 1809 (1967) and 1578 (1971), "Journal of Chemical Society", 899 (1935) and 2865 (1959), and "Journal of Organic Chemistry" 30, 567 (1965). Examples of synthesis of typical compounds of the present invention will be described hereinafter.

SYNTHESIS EXAMPLE 1

Synthesis of Exemplary Compound 1

(1) Synthesis of 2-Methoxycarbonylethylisothiocyanate 1,256 ml of triethylamine was added to a solution of 603.6 g of β-alaninemethylester sulfate in 1.5 liter of methyl alcohol under cooling with ice. 235 ml of carbon disulfide was added dropwise to the system at a temperature of 10° C. or lower. After the dropwise addition, the system was then stirred at a temperature of 10° C. or lower for 1 hour. 288 ml of ethyl chloroformate was added dropwise to the system at a temperature of 5° C. or lower. The system was then stirred for 2 hours. After the reaction, the reaction solution was then subjected to separation with ethyl acetate and water. The ethyl acetate phase thus extracted was dried with magnesium sulfate, and then filtered off. Ethyl acetate was then distilled off from the system under reduced pressure to obtain 389.1 g (yield: 89.3%) of the desired substance in the form of oil.

(2) Synthesis of 1-Acetyl-1-methyl-4-methoxycarbonylethylthiosemicarbazide

A solution of 101.6 g of 2-methoxycarbonylethylisothiocyanate obtained in (1) and 61.7 g of 1-acetyl-1-methylhydrazine in 150 ml of methyl alcohol was heated under reflux for 2 hours. Methyl alcohol was then distilled off from the system under reduced pressure. 500 ml of ethyl acetate was added to the residue. The resulting crystal was filtered off to obtain 105.0 g (yield: 64.3%) of the desired compound.

(3) Synthesis of Mesoion-1,5-dimethyl-4-methoxycarbonylethyl-1,2,4-triazolium-3-thiolate 300 ml of methyl alcohol and 10 ml of a 28% methyl alcohol solution of sodium methoxide were added to 93.3 g of 1-acetyl-1-methyl-4-methoxycarbonylethylthiosemicarbazide obtained in (2). The system was then stirred at room temperature for 2 hours. The resulting crystal was filtered off to obtain 67.2 g (yield: 78.0%) of the desired compound. m.p. 139°–140° C.

(4) Synthesis of Mesoion-4-carboxyethyl-l,5-dimethyl-1,2,4-triazolium-3-thiolate 64.6 g of mesoion-1,5-dimethyl-4-methoxycarbonylethyl-1,2,4-triazolium-3-thiolate was dissolved in 300 ml of water. 100 ml of 5N sodium hydroxide solution was added to the system. The system was then heated to a temperature of 30° C. with stirring for 2 hours. After the reaction, the system was neutralized with 45 ml of concentrated hydrochloric acid. The system was dried under reduced pressure. The resulting residue was recrystallized from 100 ml of water to obtain 49.3 g (yield: 81.6%) of the desired compound (m.p. 214°–215° C.). The compound was confirmed to be the desired compound by NMR, IR, mass spectrum, and elemental analysis.

SYNTHESIS EXAMPLE 2

Synthesis of Exemplary Compound 2

(1) Synthesis of Sodium 1-acetyl-1-methyl-4-sulfoethylthiosemicarbazide 175.3 g of sodium sulfoethylisothiocyanate was added to a solution obtained by adding 600 ml of methyl alcohol and 300 ml of water to 114.2 g of 1-acetyl-1-methylhydrazine. The system was then heated under reflux for 4 hours. After the reaction, the reaction solution was dried under reduced pressure. The resulting solid matter was then recrystallized from 1 l of methyl alcohol to obtain 169.4 g (yield: 66.0%) of the desired compound. m.p. 255°–256° C.

(2) Synthesis of sodium mesoion-1,5-dimethyl-4-sulfoethyl-1,2,4-triazolium-3-thiolate 850 ml of methyl alcohol and 5 ml of a 28% methyl alcohol solution of sodium methoxide were added to 139.8 g of sodium 1-acetyl-1-methyl-4-sulfoethylthiosemicarbazide. The system was then heated under reflux for 3 hours. The system was then cooled to room temperature. The resulting crystal was filtered off, and then recrystallized from 2 l of a 9:1 mixture of methyl alcohol and water to obtain 99.3 g (yield: 67.9%). m.p. 300° C. or higher The compound thus obtained was confirmed to be the desired compound by NMR, IR, mass spectrum, and elementary analysis.

SYNTHESIS EXAMPLE 3

Synthesis of Exemplary Compound 52

Mesoion-4-carboxymethyl-1-methyl-1,2,4-triazolium-3-thiolate was prepared as the desired compound from methoxycarbonylmethylisothiocyanate obtained in the same manner as in Synthesis Example 1-(1) and 1-formyl-1-methylhydrazine in the same manner as in Synthesis Example 1. m.p. 231°–232° C.

The suitable amount of the compound of the present invention to be incorporated in the fixing bath or blix bath is in the range of $1\times10^{-5}$ to 10 mol/l, preferably $1\times10^{-3}$ to 3 mol/l.

If the halogen composition of the silver halide emulsion to be incorporated in the light-sensitive material to be processed is AgBrI (I≧2 mol %), it is preferably used in an amount of 0.5 to 2 mol/l. If the halogen composition is AgBr, AgBrCl or high silver chloride content (AgCl≧80 mol %), it is preferably used in an amount of 0.1 to 1 mol/l. Mesoionic compounds other than those of the present invention can be used in combination with those of the present invention.

Mesoionic compounds of the present invention can be used in combination with thiosulfates as described later. However, it is preferred in view of inhibition of sulfurization that the compound of the present invention be used as fixing agent and the processing bath be substantially free of commonly used thiosulates.

The present inventors made studies on fixing agents other than thiosulfates to improve the fixing ability. In particular, extensive studies were made on mesoionic compounds. As a result, it was found that mesoionic compounds containing water-soluble groups as substituents can provide a great improvement in the fixing ability. These mesoionic compounds containing water-soluble substituents exhibited excellent results in the inhibition of thermostain as those free of water-soluble substituents. It was an unexpected fact that the presence of substituents in the fixing agent can provide improvements not only in desilvering properties but also in thermostain after processing.

The reason for these phenomena is probably that the incorporation of water-soluble substituents prevents a silver complex produced during fixing from being left in the film. However, the reason is unknown.

The compound of the present invention can also be incorporated in the rinse bath or stabilizing bath to effectively eliminate thermostain. The concentration of the compound of the present invention in these baths is preferably $10^{-3}$ to 0.5 times the concentration of the fixing agent in the prebath.

The mesoionic compounds represented by the general formulae (III) and (IV) to be incorporated as fixing agents in the blix bath used in the second embodiment of the present invention will be described hereinafter.

Preferred among mesoionic compounds to be used in the present invention are those represented by the following general formula (III):

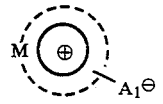

wherein M represents a 5- or 6-membered heterocyclic group formed of carbon atom, nitrogen atom, oxygen atom, sulfur atom or selenium atom; and $A_1^{\ominus}$ represents $-O^{\ominus}$, $-S^{\ominus}$ or $-N^{\ominus}-R_{11}$ in which $R_{11}$ represents an alkyl group, a cycloalkyl group, an alkenyl group, an alkynyl group, an aralkyl group, an aryl group or a heterocyclic group.

The general formula (III) will be further described hereinafter.

Examples of a 5-membered heterocyclic group represented by M include imidazoliums, pyrazoliums, oxazoliums, thiazoliums, triazoliums, tetrazoliums, thiadiazoliums, oxadiazoliums, thiatriazoliums, and oxatriazoliums.

$R_{11}$ represents a substituted or unsubstituted alkyl group (e.g., methyl, ethyl, n-propyl, n-butyl, isopropyl, n-octyl, ethoxycarbonylmethyl, dimethylaminoethyl), a substituted or unsubstituted cycloalkyl group (e.g., cyclohexyl, 4-methylcyclohexyl, cyclopentyl), a substituted or unsubstituted alkenyl group (e.g., propenyl, 2-methylpropenyl), a substituted or unsubstituted alkynyl group (e.g., propargyl, butynyl, 1-methylpropargyl), a substituted or unsubstituted aralkyl group (e.g., benzyl, 4-methoxybenzyl), a substituted or unsubstituted aryl group (e.g., phenyl, naphthyl, 4-methylphenyl, 3-methoxyphenyl, 4-ethoxycarbonylphenyl), or a substituted or unsubstituted heterocyclic group (e.g., pyridyl, imidazolyl, morpholino, triazolyl, tetrazolyl, thienyl).

The heterocyclic group represented by M may be substituted by a nitro group, halogen atom (e.g., chlorine, bromine), mercapto group, cyano group, substituted or unsubstituted alkyl group (e.g., methyl, ethyl, propyl, t-butyl, methoxyethyl, methylthioethyl, dimethylaminoethyl, morpholinoethyl, methylthiomethyl, methoxyethoxyethoxyethyl, trimethylammonioethyl, cyanoethyl, phosphonomethyl, phosphonoethyl), aryl group (e.g., phenyl, 4-methanesulfonamidephenyl, 4-methylphenyl, 3-methoxyphenyl, 4-dimethylaminophenyl, 3,4-dichlorophenyl, naphthyl), alkenyl group (e.g., allyl), cycloalkyl group (e.g., cyclohexyl, cyclopentyl), alkynyl group (e.g., propargyl), aralkyl group (e.g., benzyl, 4-methylbenzyl, phenethyl, 4-methoxybenzyl), alkoxy group (e.g., methoxy, ethoxy, methoxyethoxy, methylthioethoxy, dimethylaminoethoxy), aryloxy group (e.g., phenoxy, 4-methoxyphenoxy), alkylthio group (e.g., methylthio, ethylthio, propylthio, methylthioethylthio, dimethylaminoethylthio, methoxyethylthio), arylthio group (e.g., phenylthio, 4-dimethylaminophenylthio), heterocyclic oxy group (e.g., 2-pyridyloxy, 2-imidazolyloxy), heterocyclic thio group (e.g., 2-benzthiazolylthio, 4-pyrazolylthio), sulfonyl group (e.g., methanesulfonyl, ethanesulfonyl, p-toluenesulfonyl, methoxyethylsulfonyl), carbamoyl group (e.g., substituted carbamoyl, methylcarbamoyl, dimethylaminoethylcarbamoyl, methoxyethylcarbamoyl, methylthioethylcarbamoyl, phenylcarbamoyl), thiocarbamoyl group (e.g., dimethylthiocarbamoyl), sulfamoyl group (e.g., unsubstituted sulfamoyl, methylsulfamoyl, imidazolylethylsulfamoyl, phenylsulfamoyl), carbonamide group (e.g., acetamide, benzamide, methoxypropionamide, dimethylaminopropionamide), sulfonamide group (e.g., methanesulfonamide, benzenesulfonamide, p-toluenesulfonamide), acyloxy group (e.g., acetyloxy, benzoyloxy), sulfonyloxy group (e.g., methanesulfonyloxy), ureide group (e.g. , unsubstituted ureide, methylureide, ethylureide, methoxyethylureide, dimethylaminopropylureide, methylthioethylureide, morpholinoethylureide, phenylureide), thioureide group (e.g., unsubstituted thioureide, methylthioureide, methoxyethylthioureide), sulfamoylamino group (e.g., unsubstituted sulfamoyl, dimethylsulfamoylamino), acyl group (e.g., acetyl, benzoyl, 4-methoxybenzoyl), thioacyl group (e.g., thioacetyl), heterocyclic group (e.g., 1-morpholino, 1piperidino, 2-pyridyl, 4-pyridyl, 2-thienyl, 1pyrazolyl, 1-imidazolyl, 2-tetrahydrofuryl, tetrahydrothienyl), oxycarbonyl group (e.g., methoxycarbonyl, phenoxycarbonyl, methoxyethoxycarbonyl, methylthioethoxycarbonyl, methoxyethoxyethoxyethoxycarbonyl, dimethylaminoethoxycarbonyl, morpholinoethoxycarbonyl), oxycarbonylamino group (e.g., methoxycarbonylamino, pohenoxycarbonylamino, 2-ethylhexyloxycarbonylamino), amino group (e.g., unsubstituted amino, dimethylamino, methoxyethyiamino, anilino), carboxylic acid or salt thereof, sulfonic acid or salt thereof, or hydroxyl group.

The compound represented by the general formula (III) may form a salt (e.g., acetate, nitrate, salicylate, hydrochloride, iodate, bromate).

In the general formula (III), $A_1^{\ominus}$ preferably represents $-S^{\ominus}$.

Further preferred among mesoionic compounds which can be used in the present invention are those represented by the general formula (IV):

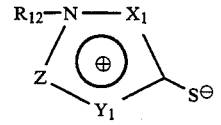

wherein $X_1$ represents N or C—$R_{13}$; $Y_1$ represents O, S, N or N—$R_{14}$; and Z represents N, N—$R_{15}$ or C—$R_{16}$.

$R_{12}$, $R_{13}$, $R_{14}$, $R_{15}$ and $R_{16}$ each represents an alkyl group, cycloalkyl group, alkenyl group, alkynyl group, aralkyl group, aryl group, heterocyclic group, amino group, acylamino group, sulfonamide group, ureide group, sulfamoylamino group, acyl group, thioacyl group, carbamoyl group or thiocarbamoyl group.

$R_{13}$ and $R_{16}$ each may be a hydrogen atom. $R_{12}$ and $R_{13}$, $R_{12}$ and $R_{15}$, $R_{12}$ and $R_{16}$, $R_{14}$ and $R_{15}$, and $R_{14}$ and $R_{16}$ may together form a ring.

The compound represented by the general formula (IV) will be further described hereinafter.

$R_{12}$, $R_{13}$, $R_{14}$, $R_{15}$ and $R_{16}$ each represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, aminoethyl, methylthiomethyl, trimethylammonioethyl, phosphonomethyl, phosphonoethyl), substituted or unsubstituted cycloalkyl group (e.g., cyclohexyl, cyclopentyl, 2-methylcyclohexyl), substituted or unsubstituted alkenyl group (e.g., allyl, 2-methylallyl), substituted or unsubstituted alkynyl group (e.g., propargyl), substituted or unsubstituted aralkyl group (e.g., benzyl, phenethyl, 4-methoxybenzyl), aryl group (e.g., phenyl, naphthyl, 4-methylphenyl, 4-methoxyphenyl, 4-carboxyphenyl, 4-methylphenyl, 3,4-disulfophenyl), substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), substituted or unsubstituted amino group (e.g., unsubstituted amino, dimethylamino, methylamino), acylamino group (e.g., acetylamino, benzoylamino, methoxypropionylamino), sulfonamide group (e.g., methanesulfonamide, benzenesulfonamide, 4-toluenesulfonamide), ureide group (e.g., unsubstituted ureide, 3-methylureide), sulfamoylamino group (e.g., unsubstituted sulfamoylamino, 3-methylsulfamoylamino), acyl group (e.g., acetyl, benzoyl), thioacyl group (e.g., thioacetyl), carbamoyl group (e.g., unsubstituted carbamoyl, dimethylcarbamoyl), or thiocarbamoyl group (e.g., dimethylthiocarbamoyl). $R_2$ and $R_5$ each may be a hydrogen atom.

In the general formula (IV), $X_1$ preferably represents N or C—$R_{13}$. $Y_1$ preferably represents N—$R_{14}$, S or O. Z preferably represents N or C—$R_{16}$. $R_{12}$, $R_{13}$ or $R_{16}$ each represents an unsubstituted or substituted alkyl group, substituted or unsubstituted alkenyl group, substituted or unsubstituted alkynyl group or substituted or unsubstituted heterocyclic group. $R_{13}$ and $R_{16}$ each may be a hydrogen atom. $R_{14}$ is preferably a substituted or unsubstituted alkyl group, substituted or unsubstituted alkenyl group, substituted or unsubstituted alkynyl group, substituted or unsubstituted heterocyclic group, substituted or unsubstituted amino group, substituted or unsubstituted thioacyl group, or substituted or unsubstituted thiocarbamoyl group.

Specific examples Of mesoionic compounds represented by the general formulae (III) and (IV) to bemused in the second embodiment of the present invention will be set forth below, but the present invention should not be construed as being limited thereto.
B-1.
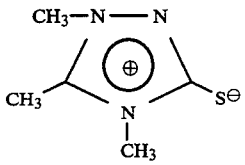
B-2.
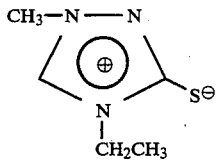
B-3.
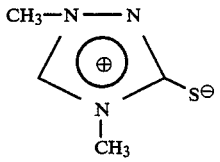
B-4.
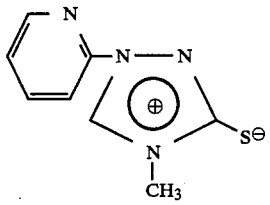
B-5.
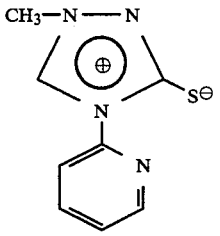
B-6.
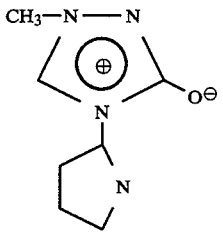
B-7.
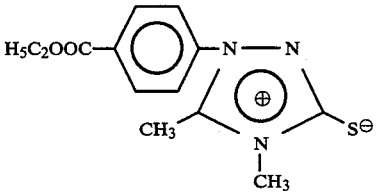
-continued
B-8.
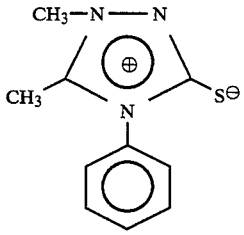
B-9.
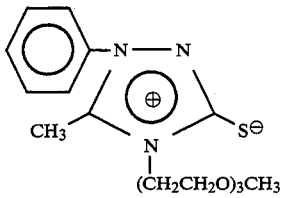
B-10.
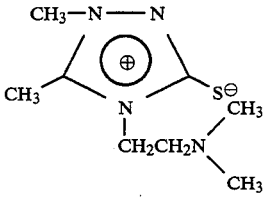
B-11.
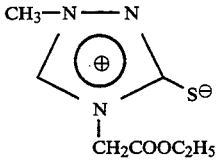
B-12.
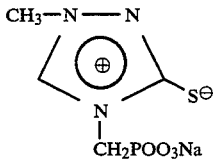
B-13.
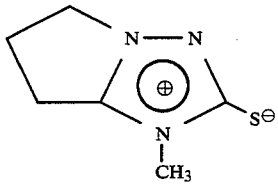
B-14.
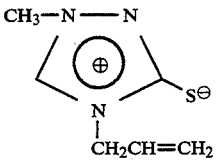
B-15.
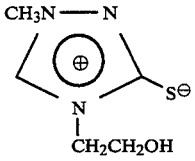

-continued
B-16.
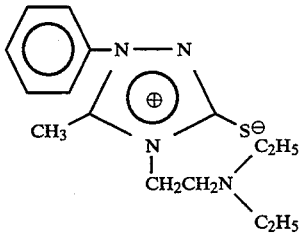
B-17.
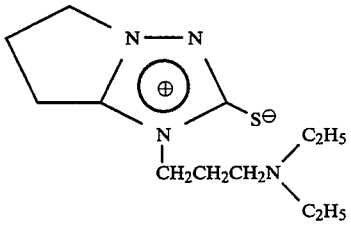
B-18.
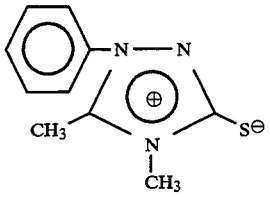
B-19.
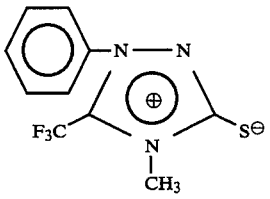
B-20.
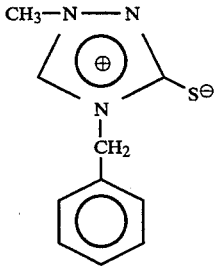
B-21.
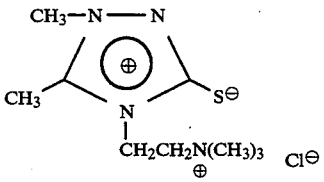
B-22.
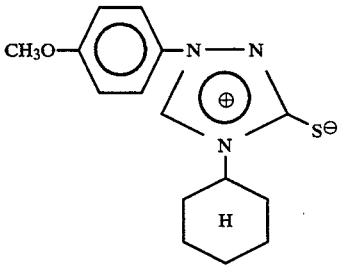
-continued
B-23.
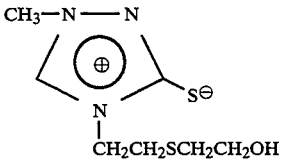
B-24.
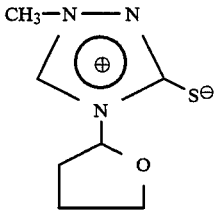
B-25.
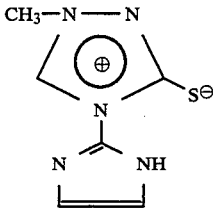
B-26.
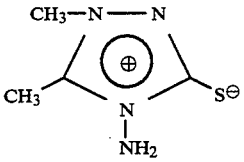
B-27.
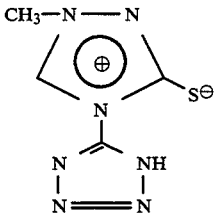
B-28.
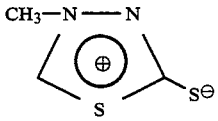
B-29.
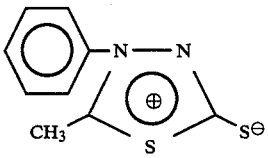
B-30.
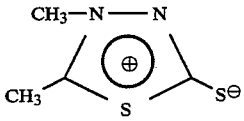
B-31.
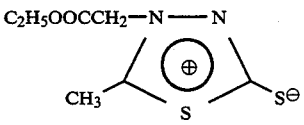

-continued
B-32.
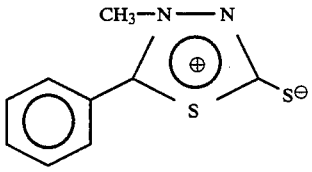
B-33.
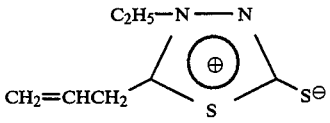
B-34.
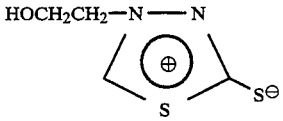
B-35.
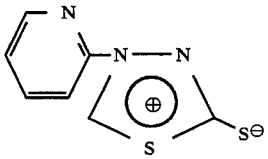
B-36.
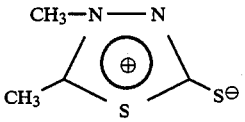
B-37.
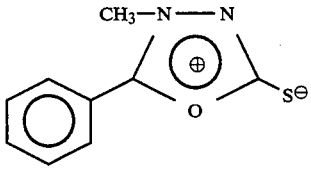
B-38.
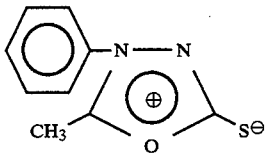
B-39.
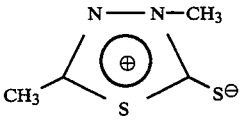
B-40.
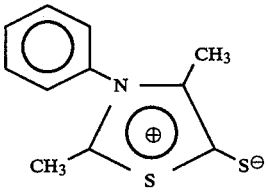
B-41.
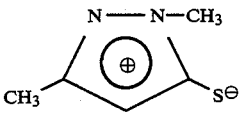
-continued
B-42.
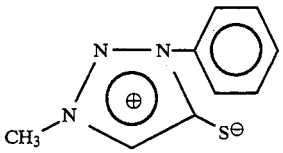
B-43.
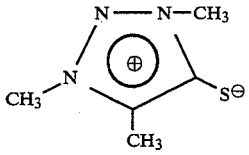
B-44.
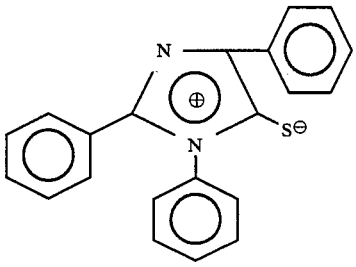
B-45.
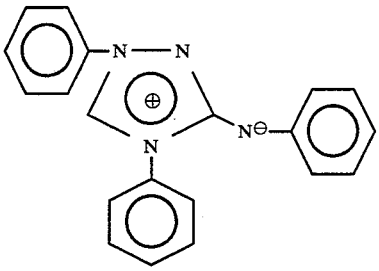
B-46.
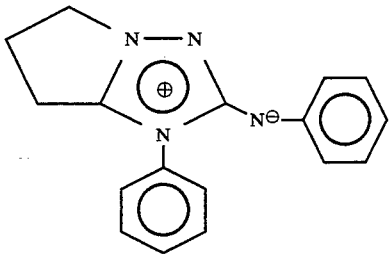
B-47.
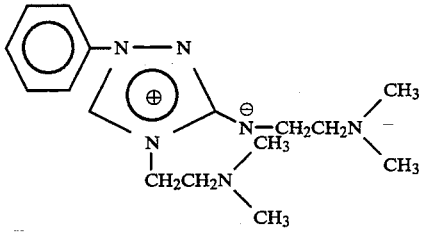
B-48.
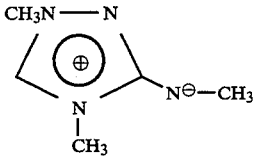

-continued
B-49.
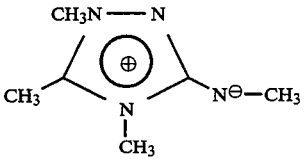
B-50.
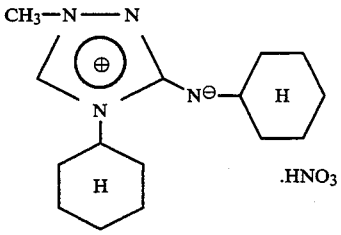
B-51.
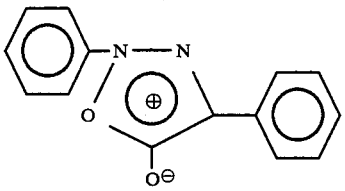
B-52.
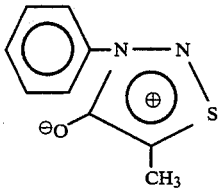
B-53.
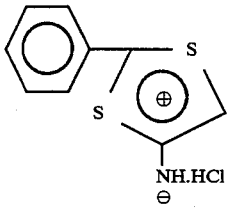
B-54.
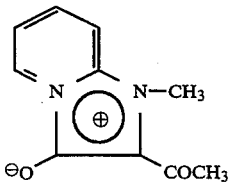
B-55.
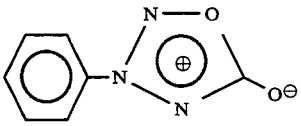
B-56.
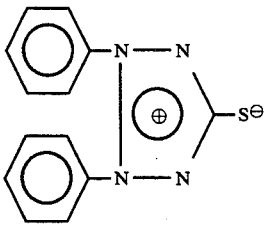
-continued
B-57.
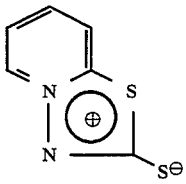
B-58.
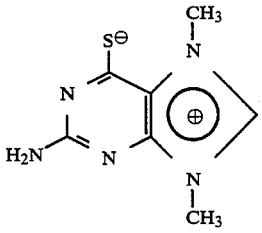
B-59.
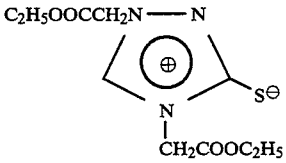
B-60.
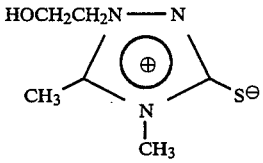
B-61.
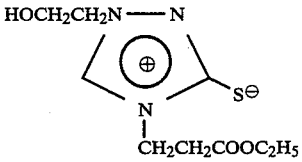
B-62.
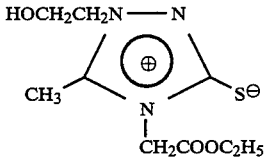
B-63.
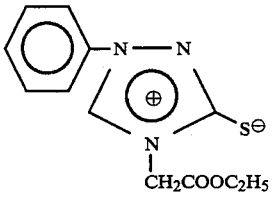
B-64.
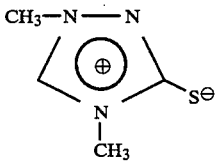

-continued

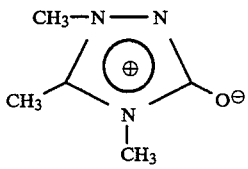

B-65.

The synthesis of the compound of the present invention represented by the general formula (III) or (IV) can be accomplished by any suitable method as described in "Journal of Heterocyclic Chemistry" 2, 105 (1965), "Journal of Organic Chemistry", 32, 2245 (1967), "Journal of the Chemical Society" 3799 (1969), "Journal of the American Chemical Society" 80, 1895 (1958), "Chemical Communications", 1222 (1971), "Tetrahedron Letters" 2939 (1972), JP-A-60-87322, "Berichte der Deutschen Chemischen Gesellschaft", 38, 4049 (1905), "Journal of the Chemical Society, Chemical Communications", 1224 (1971), JP-A-60-122936, JP-A-60-117240, "Advances in Heterocyclic Chemistry", 19, 1(1976), "Tetrahedron Letters", 5881 (1968), "Journal of Heterocyclic Chemistry" 5, 277 (1968), "Journal of the Chemical Society, Perkin Transactions I", 627 (1974), "Tetrahedron Letters", 1809 (1967) and 1578 (1971), "Journal of the Chemical Society", 899 (1935) and 2865 (1959), and "Journal of Organic Chemistry", 30, 567 (1965).

In the second embodiment of the present invention, it is described with reference to the use of a compound represented by the general formula (III) or (IV) that the system contains substantially no other fixing agents. This means that the system contains other fixing agents in an amount of 0.05 mol/l or less, preferably 0.01 mol/l or less. It was an unexpected fact that the compound of the present invention can be allowed to effectively serve as fixing agent by causing substantially no other fixing agents, e.g., commonly used thiosulfates to be contained in the system. The amount of the compound of the present invention to be incorporated in the blix bath is such that it can serve as fixing agent, e.g., $1\times10^{-1}$ mol/l or more, preferably $1.5\times10^{-1}$ mol/l or more, more preferably $2\times10^{-1}$ mol/l or more, particularly preferably $2\times10^{-1}$ to 3 mol/l.

If the halogen composition of the silver halide emulsion contained in the light-sensitive material to be processed is AgBrI ($I\geqq1$ mol % preferably 3 to 15 mol %), it is preferably used in an amount of 0.5 to 2 mol/l, more preferably 1.2 to 2 mol/l. If the halogen composition is AgBr, AgBrCl or high silver chloride content ($AgCl\geqq80$ mol %), it is preferably used in an amount of 0.2 to 0.9 mol/l, more preferably 0.4 to 0.9 mol/l.

The former is normally for the case of light-sensitive material for picture taking which has a relatively great coated amount of silver (e.g., 2 to 10 g/m$^2$) while the latter is normally for the case of light-sensitive material for print which has a relatively small coated amount of silver (e.g., 0.4 to 0.9 g/m$^2$).

In recent years, as the replenishment rate becomes lower, it has been desired to further improve the solution stability of each processing solution. The problem with the solution stability of the blix bath and its after-bath is precipitation of sulfides caused by oxidative deterioration of thiosulfates used as fixing agents. The problem with the rinse bath is caused by the introduction of the blix solution into the rinse bath during processing. In order to inhibit the precipitation, sulfites are normally used as oxidation inhibitors. However, when a lower replenishment rate is used, the precipitation problem can no longer be solved by only increasing the amount of sulfites to be used due to the limited solubility of sulfites or precipitation of Glauber's salt produced by the oxidation of sulfites.

The present inventors made extensive studies on fixing agents with an excellent oxidative stability as substitute for thiosulfates. It was found that mesionic compounds have a fixing ability and are stable to oxidation and thus cause no precipitation even when a lower replenishment rate is used. Mesoionic compounds were also found to exhibit a smaller bleach fogging than thiosulfates and attain excellent results particularly when used in combination with a high potential oxidizer in a blix bath.

The reasons why mesoionic compounds exhibit an excellent oxidation resistance and good fixing properties can be believed as follows. In particular, —S$^\ominus$ group, —N$^\ominus$R$_{11}$ group, etc. connected to the aromatic ring are relatively stable to oxidation. Since the charge of a —S$^\ominus$ group, —N$^\ominus$R$_{11}$ group etc., has a structure that is not neutralized due to tautomerism, the mesoionic compounds containing a —S$^\ominus$ group, —N$^\ominus$R$_{11}$ group etc. have a large affinity to silver. However, the reasons for this are not clearly understood.

The reason why bleach fogging is improved when a mesoionic compound is used instead of a thiosulfate is believed to be that the amount of the developing agent remaining in the film after processing is reduced. The inventors are presently investigating this matter in greater detail.

The compound of the present invention can also be effectively incorporated in the rinse bath or stabilizing bath to inhibit the precipitation in the rinse bath. The concentration of the compound of the present invention in the bath is preferably $10^{-3}$ to 0.5 times that of the fixing agent in the prebath.

The silver halide color photographic material and the processing method therefor will be further described hereinafter.

The present silver halide color photographic light-sensitive material can comprise at least one blue-sensitive layer, at least one green-sensitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color stain inhibitor as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932 (the term "JP-B" as used herein means an "examined Japanese patent publication"), a blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest light sensitivity, the middle layer is a silver halide emulsion layer having a lower light sensitivity, and the lowermost layer is a silver halide emulsion layer having a lower light sensitivity than that of the middle layer. In such a layer arrangment, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in the same color-sensitive layer as described in JP-A-59-202464.

As described above, various layer structures and arrangements can be selected depending on the purpose of light-sensitive material.

If the silver halide color photographic material is a color negative film or color reverse film, a suitable silver halide to be incorporated in the photographic emulsion layer is silver iodobromide, silver iodochloride or silver iodochlorobromide containing silver iodide in an amount of about 30 mol % or less. Particularly suitable is silver iodobromide or silver iodochlorobromide containing silver iodide in an amount of about 2 mol % to about 25 mol %.

If the silver halide color photographic material is a color photographic paper, there can be used as silver halide to be contained in the photographic emulsion layer silver chlorobromide or silver chloride substantially free of silver iodide. Specifically, the term "substantially free of silver iodide" means the silver iodide content of 1 mol % or less, preferably 0.2 mol % or less. The halogen composition of these silver chlorobromide emulsions may have arbitrary silver bromide/silver chloride ratio. This ratio can be widely selected depending on the purpose. Preferably, the proportion of silver chloride is 2 mol % or more. Light-sensitive materials adapated for rapid processing preferably comprise a so-called high silver chloride emulsion having a high silver chloride content. The silver chloride content of these high silver chloride emulsions is preferably 90 mol % or more, more preferably 95 mol % or more. For the purpose of reducing the replenishment rate of the developer, a substantially pure silver chloride emulsion having a silver chloride content of 98 to 99.9 mol % may be preferably used.

Silver halide grains in the photographic emulsion layers may be so-called regular grains having a regular crystal form, such as cube, octahedron and tetradecahedron, or those having an irregular crystal form such as sphere and tabular form, those having a crystal defect such as twinning plane, or those having a combination of these crystal forms.

The silver halide grains may be either fine grains of about 0.2 μm or smaller in diameter or giant grains having a projected area diameter or up to about 10 μm. The emulsion may be either a monodisperse emulsion or a polydisperse emulsion.

The preparation of the silver halide photographic emulsion which can be used in the present invention can be accomplished by any suitable method as described in Research Disclosure, No. 17643 (December, 1978), pp. 22–23, "I. Emulsion Preparation and Types", and No. 18716 (November, 1979), page 648, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can be preferably used in the present invention.

Tabular grains having an aspect ratio of about 5 or more can be used in the present invention. The preparation of such tabular grains can be easily accomplished by any suitable method as described in Gutoff, "Photograpahic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have conjugated thereto a silver halide having a different halogen composition or a compound other than silver halide, e.g., silver thiocyanate, lead oxide, etc. by an epitaxial junction.

Mixtures of grains having various crystal forms may also be used.

The silver halide emulsion to be used in the present invention is normally subjected to physical ripening, chemical ripening and spectral sensitization. During the physical ripening, various polyvalent metallic ion impurities (e.g., salt or complex salt of cadmium, zinc, lead, copper, thallium, iron, ruthenium, rhodium, palladium, osmium, iridium, platinum) can be introduced into the system. As compounds for use in the chemical sensitization there can be used those described in JP-A-62-215272, lower right column on page 18—upper right column on page 22. Additives to be used in these steps are described in Research Disclosure Nos. 17643 and 18716 as tabulated below. Known photographic additives which can be used in the present invention are also described in the above cited two references as shown in the table.

| Kind of additive | RD17643 | RD18716 |
|---|---|---|
| 1. Chemical sensitizer | p. 23 column (RC) | p. 648 right |
| 2. Sensitivity increasing agent | | do. |
| 3. Spectral sensitizer and supersensitizer | pp. 23–24 | p. 648 RC-p. 649 RC |
| 4. Brightening agent | p. 24 | |
| 5. Antifoggant and stabilizer | pp. 24–25 | p. 649 RC- |
| 6. Light absorbent, filter dye, and ultraviolet absorbent | pp. 25–26 | p. 649 RC-p. 650 LC |
| 7. Stain inhibitor | p. 25 RC | p. 650 LC-RC |
| 8. Dye image stabilizer | p. 25 | |
| 9. Hardening agent | p. 26 | p. 651 LC |
| 10. Binder | p. 26 | do. |
| 11. Plasticizer and lubricant | p. 27 | p. 650 RC |
| 12. Coating aid and surface active agent | pp. 26–27 | p. 650 RC |
| 13. Antistatic agent | p. 27 | do. |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material to be processed in the present invention can comprise various color couplers. Specific examples of the color couplers are described in the patents described in the above cited Research Disclosure No. 17643, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,064, 4,500,630, 4,540,654, and 4,556,630, European Patent 73,636, JP-A-60-33552, JP-A-60-43659, JP-A-61-72238, JP-A-60-35730, JP-A-55-118034, and JP-A-60-185951, RD Nos. 24220 (June, 1984) and 24230 (June, 1984), and WO(PCT)88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, and 4,296,199, West German Patent Application (OLS) No. 3,329,729, European Patents 121,365A and 249,453A, and JP-A-61-42658.

Colored couplers for correction of unnecessary absorptions of the developed dye preferably include those described in Research Disclosure No. 17643, VII-G, U.S. Pat. Nos. 4,163,670, 4,004,929, and 4,138,258, JP-B-57-39413, and British Patent 1,146,368. Furthermore, couplers for correction of unnecessary absorptions of the developed dye by a fluorescent dye released upon coupling as described in U.S. Pat. No. 4,774,181 and couplers containing as a releasable group a dye precursor group capable of reacting with a developing agent to form a dye as described in U.S. Pat. No. 4,777,120 can be preferably used.

Couplers which form a dye having moderate diffusibility preferably include those described in U.S. Pat. No. 4,366,237, British Patent 2,125,570, European Patent 96,570, and West German Patent Appplication (OLS) No. 3,234,533.

Typical examples of polymerized dye-forming couplers are described in U.S. Pat. Nos. 3,451,820, 4,080,211, 4,367,282, 4,409,320, and 4,576,910, and British Patent 2,102,173.

Couplers capable of releasing a photographically useful residual upon coupling can also be used in the present invention. Preferred examples of DIR couplers which release a developing inhibitor are described in the patents cited in RD 17643, VII-F, JP-A-57-151944, JP-A-57-154234, JP-A-60-184248, and JP-A-63-37346, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and JP-A-59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound-releasing couplers or DIR coupler-releasing couplers or DIR coupler-releasing redox compounds or DIR redox-releasing redox compounds as described in JP-A-60-185950 and JP-A-62-24252, couplers capable of releasing a dye which returns to its original color after release as described in European Patent 173,302A, couplers capable of releasing a bleach accelerator as described in RD Nos. 11449 and 24241, and JP-A-61-201247, couplers capable of releasing a ligand as described in U.S. Pat. No. 4,553,477, couplers capable of releasing a leuco dye as described in JP-A 63-75747, and couplers capable of releasing a fluorescent dye as described in U.S. Pat. No. 4,774,181.

The incorporation of these couplers in the light-sensitive material can be accomplished by any suitable known dispersion method.

Examples of high boiling solvents to be used in the oil-in-water dispersion process are described in U.S. Pat. No. 2,322,027. Specific examples of high boiling organic solvents having a boiling point of 175° C. or higher at normal pressure which can be used in the oil-in-water dispersion process include phthalic esters (e.g., dibutyl phthalate, dicylohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) No. 2,541,274, and 2,541,230.

Alternatively, these couplers can be emulsion-dispersed in an aqueous solution of hydrophilic colloid in the form of impregnation in a loadable latex polymer (e.g., U.S. Pat. No. 4,203,716) in the presence or absence of the above mentioned high boiling organic solvent or solution in a water-insoluble and organic solvent-soluble polymer.

Preferably, homopolymers or copolymers as described in International Patent Disclosure WO88/00723, pp. 12–30, may be used. In particular, acrylamide polymers may be preferably used in view of dye stability.

The present invention is applicable to various types of color light-sensitive materials, particularly preferably to color negative films for common use or motion picture, color reversal films for slide or television, color papers, direct positive color light-sensitive materials and color reversal papers.

Suitable supports which can be used in the present invention are described in the above cited RD 17643 (page 28) and 18716 (right column on page 647 to left column on page 648).

In the present light-sensitive material, the total thickness of all hydrophilic colloidal layers on the emulsion side is preferably in the range of 25 μm or less, more preferably 20 μm or less. The film swelling rate $T_{\frac{1}{2}}$ is preferably in the range of 30 seconds or less, more preferably 15 seconds or less. In- the present invention, the film thickness is determined after being stored at a temperature of 25° C. and a relative humidity of 55% for 2 days. The film swelling rate $T_{\frac{1}{2}}$ can be determined by a method known in the art, e.g., by means of a swellometer of the type as described in A. Green et al., "Photographic Science and Engineering" vol. 19, No. 2, pp. 124–129. $T_{\frac{1}{2}}$ is defined as the time taken until half the saturated film thickness is reached wherein the saturated film thickness is 90% of the maximum swollen film thickness reached when the light-sensitive material is processed with a color developer at a temperature of 30° C. over 195 seconds.

The film swelling rate $T_{\frac{1}{2}}$ can be adjusted by adding a film hardener to gelatin as binder or altering the ageing condition after coating. The percentage swelling of the light-sensitive material is preferably in the range of 150 to 400%. The percentage swelling can be calculated from the maximum swollen film thickness determined as described above in accordance with the equation: (maximum swollen film thickness−film thickness)/film thickness.

The above mentioned color photographic light-sensitive material can be developed in accordance with an ordinary method as described in RD Nos 17643 (pp. 28–29) and 18716 (left column—right column on page 651).

The color developer to be used in the development of the light-sensitive material is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-β-methoxyethylaniline, and sulfates, hydrochlorides and ptoluenesulfonates thereof. These compounds can be used in combination of two or more thereof depending on the purpose of application.

The color developer normally contains a pH buffer such as carbonate, borate and phosphate of alkaline metal or a development inhibitor or fog inhibitor such as bromides, iodides, benzimidazoles, benzothiazoles and mercapto compounds. If desired, the color developer may further contain various preservatives such as hydroxylamine, diethylhydroxylamine, sulfites, hydrazines, phenylsemicarbazides, triethanolamine, catecholsulfonic acids and triethylenediamine(1,4-diazabicyclo-[2,2,2]octane), organic solvents such as ethylene glycol and diethylene glycol, development accelerators such as benzyl alcohol, polyethylene glycol, quaternary ammonium salts, and amines, dye-forming couplers, competing couplers, fogging agents such as sodium boron hydride, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids, (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof), fluorescent brightening agent such as 4,4'-diamino-2,2-disulfostilbene, various surface active agents such as alkylsulfonic acid, arylsulfonic acid, aliphatic carboxylic acid and aromatic carboxylic acid, or the like.

However, it is preferred that substantially no benzyl alcohol be used in the system in view of pollution, ease of preparation of solution and inhibition of color stain. Specifically, the system may contain benzyl alcohol in an amount of 2 ml or less per l of color developer, more preferably none.

Reversal processing is usually carried out by black-and-white development followed by color development. Black-and-white developers to be used can contain one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 l or less per $m^2$ of the light-sensitive material, though depending on the type of the color photographic material to be processed. The replenishment rate may be reduced to 500 ml/$m^2$ or less by decreasing the bromide ion concentration in the replenisher. In particular, in the case where at so-called high silver chloride light-sensitive material used, excellent photographic properties and processability can be provided and the fluctuation in photographic properties can be inhibited by reducing the content of bromide ions and relatively increasing the content of chloride ions in the color developer. In this case, the replenishment rate can be reduced to about 20 ml per $m^2$ of light-sensitive material where there is substantially no overflow in the color development bath. When the replenishment rate is reduced, it is preferred to prevent the evaporation of liquid and aerial oxidization by reducing the contact area of processing bath with air. The replenishment rate can also be reduced by a means for suppressing accumuation of the bromide ion in the developing solution.

The processing temperature with the present color developer is in the range of 20° to 50° C., preferably 30° to 45° C. The processing time is normally in the range of 30 seconds to 3 minutes. The processing time can be further reduced by carrying out color development at an elevated temperaure and a high pH value with a color developing solution containing a color developing agent in a high concentration.

The photographic emulsion layer which has been color-developed is normally subjected to bleach. However, in the first embodiment of the present invention, bleach may be effected simultaneously with fixation (i.e., blix), or these two steps may be carried out separately the second embodiment of the present invention, bleach and fixing are simultaneously effected (blix). For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of polyvalent metals, e.g., iron (III), cobalt (III), chromium (IV) and copper (II), peroxides, quinones, and nitro compounds. Typical examples of these bleaching agents are ferricyanides, bichromates, organic complex salts of iron (III) or cobalt (III) (e.g., aminopolycarboxylic acis, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or complex salts of citric acid, tartaric acid, malic acid, etc), persulfates, bromates, permanganates, and nitrobenzenes. Of these, aminopolycarboxylic acid-iron (III) complex salts such as (ethylenediaminetetraacetato)iron (III) complex salts and persulfates are preferred in view of speeding up of processing and conservation of the environment. In particular, aminopolycarboxylic acid-iron (III) complex salts are useful in both of a bleaching solution and a blix solution.

The bleaching agent to be used in the present invention is preferably a so-called high potential oxidizer having a redox potential of 150 mV or higher, preferably 180 mV or higher, more preferably 200 mV or higher.

In the present invention, the redox potential of the oxidizer can be defined as value determined by the measurement method as described in "Transaction of the Faraday Society" vol. 55 (1959), pp. 1312–1313. In this case, the redox potential is determined at a pH value of 6.0 in accordance with the above mentioned method. The reason why the potential determined at a pH value of 6.0 is used is that the vicinity of the value of 6.0 gives a criterion for the generation of bleach fogging.

Specific examples of aminopolycarboxylic acid-iron (III) complex salts will be set forth below with their redox potential as determined as defined above, but the present invention should not be construed as being limited thereto. These aminopolycarboxylic acid-iron (III) complex salts may be preferably used in the form of sodium, potassium or ammonium salt, particularly in the form of ammonium salt in view of bleaching speed.

| Compound No. | Redox potential (mV vs. NHE; pH = 6) |
|---|---|
| 1. N-(2-acetamide) iminodiacetic acid-iron (III) complex salt | 180 |
| 2. Methyliminodiacetic acid-iron (III) complex salt | 200 |
| 3. Iminodiacetic acid-iron (III) complex salt | 210 |
| 4. 1,4-Butylenediaminetetraacetic acid-rion (III) complex salt | 230 |
| 5. Diethylenethioetherdiamine-tetraacetic acid-iron (III) complex salt | 230 |
| 6. Glycoletherdiaminetetraacetic acid-iron (III) complex salt | 240 |
| 7. 1,3-Propylenediaminetetraacetic acid-iron (III) complex salt | 250 |
| 8. Ethylenediaminetetraacetic acid-iron (III) complex salt | 110 |
| 9. Diethylenetriaminepentacetic acid-iron (III) complex salt | 80 |
| 10. Trans-1,2-cyclohexanediamine-tetraacetic acid-iron (III) complex salt | 80 |

The pH value of the bleaching solution or blix solution comprising these aminopolycarboxylic acid-iron (III) complex salts is normally in the range of 5.5 to 8. For speeding up a lower pH value can be processing, adopted.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812, and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, and JP-A-53-28426, and Research Disclosure No. 17129 (July, 1978), thiazolidine derivatives as described in JP-A-50-140129, thiourea derivatives as described in JP-B-45-8506, JP-A-52-20832, JP-A-53-32735 and U.S. Patent 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A-49-42434, JP-A-49-59644, JP-A-53-94927, JP-A-54-35727, JP-A-55-26506, and JP-A-58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812, and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The blix solution of the present invention may comprise known additives such as rehalogenating agent (e.g., ammonium bromide, ammonium chloride), pH buffer (e.g., ammonium nitrate) and metal corrosion inhibitor (e.g., ammonium sulfate).

The fixing bath in the first embodiment of the present invention can comprise known fixing agents besides the present compounds represented by the general formulae (I) and (II). Examples of such fixing agents include thiosulfates, thiocyanates, thioethers, thioureas, and a large amount of iodides. The thiosulfates are normally used, with ammonium thiosulfate being applicable most preferably in view of solubility or fixing speed. These thiosulfates may be preferably used in combination with other fixing agents. As preservatives of the blix bath there can be preferably used sulfites, bisulfites, carbonyl bisulfite adducts or sulfinic acid compounds. The fixing solution preferably contains aminopolycarboxylic acids or organic phosphonic chelating agents (preferably 1-hydroxyethylidene-1,1-diphosphonic acid and N,N,N',N'-ethylenediaminetetraphosphonic acid) for improving the stability.

The fixing solution can further contain various fluorescent brightening agents, anti-foaming agents, surface active agents, polyvinyl pyrrolidone, methanol or the like.

In the desilvering step, the agitation is preferably intensified as much as possible to reduce the desilvering time. As agitating means there can be used methods as described in JP-A-62-183460 and JP-A-62-183461. In the case where the processing solution may be jetted to the surface of the light-sensitive material, the collision of the processing solution to the light-sensitive material is effected within 15 seconds from the time at which the light-sensitive material is introduced into the processing solution.

In the present invention, the crossover time from the color developer to the bleaching solution (time during which the light-sensitive material is in the air between the time at which it comes out from the color developer and the time at which it is introduced into the bleaching solution) is preferably 10 seconds or less to eliminate bleach fogging or stain on the surface of the light-sensitive material. The crossover time from the bleaching solution to the processing solution having a fixing ability is preferably 10 seconds or less to prevent cyan dye from being disabled to restore its original color.

The replenishment rate of the fixing solution is preferably 800 ml/m$^2$ or less for color light-sensitive material for picture taking (e.g., having a coated amount of silver of 4 to 12 g/m$^2$). The replenishment rate of the blix solution is preferably 60 ml/m$^2$ or less.

As preservatives for the blix solution in the second embodiment of the present invention there can be used sulfites, bisulfites, carbonyl bisulfite adducts or sulfinic acid compounds. The blix solution preferably contains aminopolycarboxylic acids or organic phosphonic chelating agents (preferably 1-hydroxyethylidene-1,1-diphosphonic acid and N,N,N',N'-ethylenediaminetetraphosphonic acid) for improving the stability.

The blix solution can further contain various fluorescent brightening agents, anti-foaming agents, surface active agents, polyvinyl pyrrolidone, methanol or the like.

In the desilvering step, the agitation is preferably intensified as much as possible to reduce the desilvering time. As agitating means there can be used methods as described in JP-A-62-183460 and JP-A-62-183461. In the case where the processing solution may be jetted to the surface of the light-sensitive material, the collision of the processing solution to the light-sensitive material is effected within 15 seconds from the time at which the light-sensitive material is introduced into the processing solution.

In the present invention, the crossover time from the color developer to the blix solution (time during which the light-sensitive material is in the air between the time at which it comes out from the color developer and the time at which it is introduced into the blix solution) is preferably 10 seconds or less to eliminate bleach fogging or stain on the surface of the light-sensitive material.

The replenishment rate of the blix solution is preferably 800 ml/m$^2$ or less for color light-sensitive material for picture taking (e.g., having a coated amount of silver of 4 to 12 g/m$^2$) or 60 ml/m$^2$ or less for color photographic paper.

It is usual that the thus desilvered silver halide color photographic materials of the present invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or direct-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May, 1955).

According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine typoe bactericides, e.g., chlorinated sodium isocyanurate, benzotriazole, and bactericides described in Hiroshi Horiguchi, "Bokinbobaizai no kagaku" Eisei Gijutsu Kai (ed.), "Biseibutsu no mekkin, sakkin, bobaigijutsu", and Nippon Bokin Bobai Gakkai (ed.), "Bokin bobaizai jiten".

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 40° C. in temperature and from 30 seconds to 5 miniutes in time. The light-sensitive material of the present invention may be directly processed with a stabilizer in place of the washing step. For the! stabilization, any of the known techniques as described in JP-A-57-8543, JP-A-58-14834, and JP-A-60-220345 can be used.

The aforesaid washing step may be followed by stabilization in some cases. For example, a stabilizing bath containing a dye stabilizer as is used as a final bath for color light-sensitive materials for picture taking. Examples of such a dye stabilizer include formalin, hexamethylenetetramine, hexahydrotriazine, and N-methylol compounds. This stabilizing bath may also contain ammonium compounds, .compounds of metal such as Bi and Al, fluorescent brightening agents, various chelating agents, film pH adjustors, film hardeners, germicides, anti-fungal agents, alkanolamine or surface active agents (preferably silicone-based surface active agents) as necessary. As water to be used in the rinse step or stabilizing step there may be preferably used tap water, water which has been deionized with ion exchange resins such that the concentration of Ca ion and Mg ion are each reduced to 5 mg/l or less or water which has been sterilized with halogen, ultraviolet bactericidal lamp or the like.

The replenishment rate of the above mentioned rinsing solution and/or stabilizing solution is preferably 1 to 50 times, preferably 2 to 30 times, more preferably 2 to 15 times the amount of the processing solution carried over from the prebath per unit area of the light-sensitive material. The overflow accompanying replenishment of the washing bath and/or stabilizing bath can be reused in other steps such as desilvering.

The silver halide color light-sensitive material to be processed in the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color light-sensitive material to be processed in the present invention may optionally comprise various 1-phenyl-3-pyrazolidones for the purpose of accelerating color development. Typical examples of such compounds are described in JP-A-56-64339, JP-A-57-144547, and JP-A-58-115438.

In the present invention, the various processing solutions are used at a temperature of 10° C. to 50° C. The standard temperature range is normally from 33° C. to 38° C. However, a higher temperature range can be-mused to accelerate processing, reducing the processing time. On the contrary, a lower temperature range can be used to improve the picture quality or the stability of the processing solutions. In order to save the silver content in the light-sensitive material, processing methods can be effected utilizing cobalt intensification or hydrogen peroxide intensification as described in West German Patent 2,226,770 and U.S. Pat. No. 3,674,499.

One of examples of silver halide color light-sensitive materials is one comprising a direct positive type silver halide. The process for the processing of such a light-sensitive material will be described hereinafter.

The silver halide color photographic material which has been imagewise exposed to light is preferably color-developed with a surface developer containing an aromatic primary amine color developer and having a pH value of 11.5 or less after or simultaneously with fogging by light or nucleating agent, and then subjected to bleach and fixing to form a direct positive color image thereon. The pH value of this developer is more preferably in the range of 10.0 to 11.0.

The present fogging may be accomplished by either a so-called "light fogging process" which comprises subjecting the entire surface of the light-sensitive layer to second exposure or a so-called "chemical fogging process" which comprises development in the presence of a nucleating agent. The development may be effected in the presence of a nucleating agent or fogging light. Alternatively, a light-sensitive material containing a nucleating agent may be subjected to fog exposure.

The light fogging process is described in Japanese Patent Application No. 61-253716, line 4 on page 47—line 5 on page 49. The nucleating agent which can be used in the present invention is described in the above cited Japanese Patent Application No. 61-253716, line 6 on page 49—line 2 on page 67. In particular, compounds represented by the general formulae [N-1] and [N-2] may be preferably used. Preferred among these compounds are those represented by the general formulae [N-I-1] to [N-I-10] set forth between page 56 and page 58 and the general formulae [N-II-1] to [N-II-12] set forth between page 63 and page 66 in the above cited Japanese Patent Application No. 61-253716.

Nucleation acceletors which can be used in the present invention are described in the above cited Japanese Patent Application No. 61-253716, line 11 on page 68—line 3 on page 71. Particularly preferred among these nucleation accelerators are those represented by the general formula (A-1) to (A-13) set forth between page 69 and page 70 in the above cited Japanese Patent Application No. 61-253716.

Color developers which can be used in the color development of the light-sensitive material to be processed in the present invention are described in the above cited Japanese Patent Application No. 61-253716, line 4 on page 71—line 9 on page 72. In particular, as aromatic primary amine color developing agents there can be preferably used p-phenylenediamine compounds. Typical examples of such p-phenylenediamine compounds include 3-methyl-4-amino-N-ethyl-N-(β-methanesulfonamideethyl) aniline, 3-methyl-4-amino-N-ethyl-N-(β-hydroxyethyl) aniline, 3-methyl-4-amino-N-ethyl-N-methoxyethylaniline, and sulfates and hydrochlorides thereof.

The first embodiment of the present invention can be applied to silver halide black-and-white photographic materials. These silver halide black-and-white photographic materials and processing methods thereof will be further described hereinafter.

The halogen composition of the silver halide emulsion to be used in the present invention is not specifically limited and may be any of silver chloride, silver chlorobromide, silver iodobromide, silver bromide, and silver iodobromochloride. The silver iodide content of the halogen composition is preferably in the range of 10 mol % or less, particularly 5 mol % or less.

The silver halide grains in the photographic emulsion layer to be used in the present invention may have a relatively wide grain size distribution but preferably have a narrow grain size distribution. In particular, it is preferred that silver halide grains having a size within ±40% from the average grain size account for 90% of all the grains by weight or number.

Silver halide grains to be used for the formation of high contrast negative images are preferably finely divided grains (e.g., having a size of 0.7 μm or less), particularly having a size of 0.5 μm or less. The size distribution of silver halide grains is not essentially limited and is preferably monodisperse. The term "monodisperse" as used herein means "being formed of grains wherein those having a size within ±40 from the average grain size account for 95% of all the grains by weight or number".

The silver halide grains to be contained in the photographic emulsion may have a regular crystal form such as cube, octahedron, rhombododecahedron and tetradecahedron, irregular form such as sphere and tabular form, or composite thereof.

The silver halide grains may be uniform such that the core and the shell thereof are the same in phase or heterogeneous such that they differ in phase.

In the silver halide emulsion to be used in the present invention, there may be present cadmium salt, sulfite, lead salt, thallium salt, rhodium salt or complex salt thereof, iridium salt or complex salt thereof, etc during the formation or physical ripening of silver halide grains.

The silver halide to be used in the present invention may be prepared in the presence of an iridium salt or complex salt thereof in an amount of $10^{-8}$ to $10^{-5}$ mol per mol of silver. The silver halide to be used in the present invention is also a silver haloiodide having a surface silver iodide content greater than the average silver iodide content. The use of an emulsion containing such a silver haloiodide can provide a higher sensitivity and gamma value.

The silver halide emulsion to be used in the present process may or may not be subjected to chemical sensitization. As processes for chemical sensitization of the silver halide emulsion there have been known sulfur sensitization process, reduction sensitization process and noble metal sensitization process. These chemical sensitization processes can be used singly or in combination.

As the noble metal sensitization process there can be typically used gold sensitization process. In the gold sensitization process, there is used a gold compound, mainly gold complex salt. Noble metals other than gold, such as platinum, palladium and rhodium can be included. Specific examples of such compounds are described in U.S. Pat. No. 2,448,060, and British Patent 618,016. As sulfur sensitizers there may be used sulfur compounds contained in gelatin, various sulfur compounds such as thiosulfate, thiourea, thiazole and rhodanine, etc.

In the foregoing description, an iridium salt or rhodium salt may be preferably used before the completion of physical ripening, particularly during the formation of grains, in the step of preparation of silver halide emulsion.

In the present invention, the silver halide emulsion layer preferably contains two kinds of monodisperse emulsions having different average grain sizes as disclosed in JP-A-61-223734 and JP-A-62-90646 with respect to the rise in the maximum density (Dmax). The smaller size monodisperse grains are preferably subjected to chemical sensitization, most preferably sulfur sensitization. The larger size monodisperse emulsion may or may not be chemically sensitized. Since large size monodisperse grains are susceptible to black pepper, they are normally not subjected to chemical sensitization. However, if subjected to chemical sensitization, they are preferably sparingly subjected to chemical sensitization to such an extent that no black peppers are produced. Specifically, the sparing chemical sensitization can be accomplished by employing a shorter chemical sensitization time or a lower chemical sensitization temperature or a lower amount of chemical sensitizer than that required for the chemical sensitization of small size grains. The difference in sensitivity between the large size monodisperse emulsion and the small size monodisperse emulsion is not specifically limited and is normally in the range of 0.1 to 1.0, preferably 0.2 to 0.7 in terms of Δlog E, the sensitivity of the large size monodisperse emulsion being preferably larger than the other. The average grain size of the small size monodisperse grains is 90% or less, preferably 80% or less of that of the large size monodisperse silver halide grains. The average grain size of the silver halide emulsion grains is preferably in the range of 0.02μ to 1.0μ, more preferably 0.1μ to 0.5μ. Preferably, the average grain size of the large size monodisperse grains and the small size monodisperse grains fall within this range.

If the light-sensitive material to be processed in the present invention comprises two or more kinds of emulsions having different sizes, the coated amount of silver in the small size monodisperse emulsion is preferably in the range of 40 to 90 wt %, more preferably 50 to 80 wt % based on the total coated amount of silver.

In the light-sensitive material to be processed in the present invention, monodisperse emulsions having different grain sizes may be incorporated in the same emulsion layer or separate emulsion layers. If monodisperse emulsions are incorporated in separate layers, it is preferred that a large size emulsion be incorporated in a layer above that for a small size emulsion.

The total coated amount of silver is preferably in the range of 1 g/m$^2$ to 8 g/m$^2$.

The light-sensitive material to be used in the present invention can comprise sensitizing dyes as described in JP-A-55-52050, pp. 45–53 (e.g., cyanine dye, melocyanine dye) for the purpose of improving sensitivity. These sensitizing dyes may be used singly or in combination. Such a combination of sensitizing dyes may be used particularly for the purpose of supersensitization. In combination with such sensitizing dyes, a dye which doesn't exhibit a spectral sensitizing effect itself or a substance which doesn't substantially absorb visible light but exhibits a supersensitizing effect may be incorporated in the emulsion. Useful sensitizing dyes, combinations of supersensitizing dyes, and supersensitizing substances are described in Research Disclosure No. 17643, vol. 176 (December, 1978), page 23, IV-J.

The light-sensitive material to be processed in the present invention may comprise various compounds for the purpose of inhibiting fogging during the preparation, storage or photographic processing of light-sensitive material or stabilizing photographic properties. For example, many compounds known as fog inhibitor .and stabilizer can be used. Examples of such a fog inhibitor or stabilizer include azoles such as benzothiazolium salt, nitroindazole, chlorobenzimidazole, bromobenzimidazole, mercaptothiazole, mercaptobenzothiazole, mercaptothiadiazole, aminotriazole, benzothiazole, and nitrobenzotriazole, mercaptopyrimidines, mercaptotriazines, thioketo compounds such as oxazolinthione, azaindenes such as triazaindene, tetraazaindene (particularly 4-hydroxy-substituted (1,3,3a,7)tetraazaindene), and pentaazaindene, benzenethiosulfonic acid, benzenesulfinic acid, and amide benzenesulfonate. Preferred among these compounds are benzotriazoles (e.g., 5-methyl-benzotriazole), and nitroindazoles (e.g., 5-nitroindazole). These compounds may be incorporated in the processing solutions.

The light-sensitive material to be processed in the present invention may comprise a nucleating agent in the photographic emulsion layer or other hydrophilic colloidal layers.

As nucleating agents to be incorporated in the present light-sensitive material there may be used those described in Research Disclosure Item 23516 (November, 1983, page 346) and references cited therein, U.S. Pat. Nos. 4,080,207, 4,269,929, 4,276,346, 4,278,748, 4,385,108, 4,459,347, 4,560,638, 4,478,928, and 4,686,167, British Patent 2,011,391B, European Patent 217,310, JP-A-60-179734, JP-A-62-270948, JP-A-63-29751, JP-A-61-170733, JP-A-61-27744, JP-A-62-948, JP-A-62-178246, JP-A-63-32538, JP-A-63-104047, JP-A-63-121838, JP-A-63-129337 , JP-A-63-223744, JP-A-63-234244, JP-A-63-234245, JP-A-63-234246, JP-A-63-294552, JP-A-63-306438, JP-A-1-100530, JP-A-1-105941, JP-A-1-10594-3, JP-A-64-10233, and JP-A-1-90439, and Japanese Patent Application Nos. 63-105682, 63-114118, 63-110051, 63-114119, 63-116239, 63-147339, 63-179760, 63-229163, 1-18377, 1- 18378, 1-18379, 1-15755, 1-16814, 1-40792, 1-42615, 1-42616, 1-123693, and 1-126284.

As suitable development accelerators or nucleation infectious development accelerators to be incorporated in the present light-sensitive material there can be effectively used compounds as disclosed in JP-A-53-77616, JP-A-54-37732, JP-A-53-137133, JP-A-60-140340, and JP-A-60-14959 and various compounds containing nitrogen or sulfur atom.

The optimum amount of these accelerators depends on the kind thereof and is normally in the range of $1.0\times10^{-3}$ to 0.5 g/m$^2$, preferably $5.0\times10^{-3}$ to 0.1 g/m$^2$.

The light-sensitive material to be processed in the present invention may comprise a desensitizer in the photographic emulsion layer or other hydrophilic colloidal layers.

The organic desensitizer which can incorporated in the light-sensitive material to be used in the present invention can be specified by polarographical half-wave potential, i.e., redox potential determined by polarography. Specifically, the sum of polarographical anode potential and cathod potential is positive. The process for the measurement of polarographical redox potential is described in, e.g., U.S. Pat. No. 3,501,307. As such an organic desensitizer there can be preferably used one containing at least one water-soluble group. Specific examples of such a water-soluble group include sulfonic acid group, and carboxylic acid group. These groups may form salts with organic salt groups (e.g., ammonia, pyridine, triethylamine, piperidine, morpholine) or alkaline metals (e.g., sodium, potassium).

As such organic desensitizers there can be preferably used those represented by the general formulae (III) to (V) as described in JP-A-63-133145.

The organic desensitizer to be incorporated in the light-sensitive material to be processed in the present invention is preferably incorporated in the silver halide emulsion layer in an amount of $1.0\times10^{-8}$ to $10\times10^{-4}$ mol/m$^2$ particularly $10\times10^{-7}$ to $10\times10^{-5}$ mol/m$^2$.

The light-sensitive material to be processed in the present invention may contain a water-soluble dye in the emulsion layer or other hydrophilic colloidal layers as filter dye or for the purpose of inhibiting irradiation or other various purposes. As such a filter dye there can be a dye for further lowering photographic sensitivity, preferably an ultraviolet absorbent having a maximum spectral absorption in the inherent sensitivity range of silver-halide or a dye having a substantial light absorption mainly in the range of 38 nm to 600 nm for improving the safety to safelight when treated as daylight light-sensitive material.

These dyes may be preferably incorporated in the emulsion layer or in a layer above the silver halide emulsion layer, i.e., light-insensitive hydrophilic colloidal layer provided farther from the support than the silver halide emulsion layer, together with a mordant.

The amount of such an ultraviolet absorbent to be incorporated depends on its molar absorptivity and is normally in the range of $10^{-2}$ g/m$^2$ to 1 g/m$^2$, preferably 50 mg/m$^2$ to 500 mg/m$^2$.

The above mentioned ultraviolet absorbent may be incorporated in a coating solution in the form of solution in a proper solvent such as water, alcohol (e.g., methanol, ethanol, propanol), acetone, and methylcellosolve or a mixture thereof.

As such ultraviolet absorbents there may be used benzotriazole compounds substituted by aryl group, 4-thiazolidone compounds, benzophenone compounds, cinnamic ester compounds, butadiene compounds, benzoxazole compounds or ultraviolet-absorbing polymers.

Specific examples of ultraviolet absorbents are described in U.S. Pat. Nos. 3,533,794, 3,314,794, 3,352,618, 3,705,805, 3,707,375, 4,045,229, 3,700,455, and 3,499,863, JP-A-46-2784, and West German Patent Publication No. 1,547,863.

Examples of filter dyes include oxonol dyes, hemioxonol dyes, styryl dyes, melocyanine dyes, cyanine dyes, and azo dyes. In order to reduce colors left after development, as filter dyes there may be preferably used water-soluble dyes or dyes which are decolorized with an alkali or sulfurous acid ions.

Specific examples of such dyes include pyrazolone oxonol dyes as described in U.S. Pat. No. 2,274,782, diarylazo dyes as described in U.S. Pat. No. 2,956,879, styryl dyes and butadienyl dyes as described in U.S. Pat. Nos. 3,423,207 and 3,384,487, melocyanine dyes as described in U.S. Pat. No. 2,527,583, melocyanine dyes and oxonol dyes as described in U.S. Pat. Nos. 3,486,897, 3,652,284, and 3,718,472, enaminohemioxonol dyes as described in U.S. Pat. No. 3,976,661, and dyes as described in British Patents 584,609, and 1,177,429, JP-A-48-85130, JP-A-49-99620, and JP-A-49-114420, and U.S. Pat. Nos. 2,533,472, 3,148,187, 3,177,078, 3,247,127, 3,540,887, 3,575,704, and 3,653,905.

These dyes may be incorporated in the coating solution for the present light-insensitive hydrophilic colloidal layer in the form of solution in a proper solvent such as water, alcohol (e.g., methanol, ethanol, propanol), acetone, and methylcellosolve or a mixture thereof.

The optimum amount of these dyes to be used is normally in the range of $10^{-3}$ g/m$^2$ to 1 g/m$^2$, preferably $10^{-3}$ g/m$^2$ to 0.5 g/m$^2$.

The photographic light-sensitive material to be processed in the present invention may contain inorganic or organic film hardener in the photographic emulsion layer or other hydrophilic colloidal layers. For example, chromium salts, aldehydes (e.g., formaldehyde, glutaraldehyde), N-methylol compounds (e.g., dimethylolurea), activated vinyl compounds (e.g., 1,3,5-triacryloyl-hexahydro-s-triazine, 1,3-vinylsulfonyl- 2propanol), activated halogen compounds (e.g., 2,4-dichloro-6-hydroxy-s-triazine), and mucohalogenic acids may be used singly or in combination.

The photographic emulsion layer or other hydrophilic colloidal layers in the light-sensitive material to be processed in the present invention may comprise various surface active agents for the purpose of facilitating coating, inhibiting charging, emulsion dispersion and adhesion, and improving sliding properties and photographic properties (e.g., accelerating development, improving contrast, sensitization). Surface active agents which can be particularly preferably used in the present invention are polyalkylene oxides with a molecular weight of 600 or more as described in JP-B-58-9412. If these surface active agents are used as antistatic agents, fluorine-containing surface active agents as described in U.S. Pat. No. 4,201,586, and JP-A-60-80849, and JP-A-59-74554 can be particularly preferred.

The photographic emulsion to be incorporated in the present light-sensitive material may contain a matting agent such as silica, magnesium oxide and polymethyl methacrylate in the photographic emulsion layer or other hydrophilic colloidal layers for the purpose of inhibiting adhesion.

The photographic emulsion to be incorporated in the present light-sensitive material can contain a dispersion of a water-insoluble or sparingly water-soluble synthetic polymer for the purpose of improving dimensional stability or like purposes. For example, polymers can be used comprising as monomeric units alkyl (meth-)acrylate, alkoxyacryl (meth)acrylate, glycidyl (meth)acrylate, etc., singly or in combination, or combination thereof with acrylic acid, methacrylic acid, etc.

The present photographic light-sensitive material may preferably contain a compound containing an acid group in the silver halide emulsion layer and other layers. Examples of such a compound containing an acid group include organic acids such as salicylic acid, acetic acid and ascorbic acid, and polymers or copolymers containing as repeating units acid monomers such as acrylic acid, maleic acid and phthalic acid. For these compounds, reference can be made to JP-A-61-223834, JP-A-61-228437, JP-A-62-25745, and JP-A-62-55642. Particularly preferred among these compounds are ascorbic acid as low molecular compound, and a water-dispersible latex of a copolymer comprising an acid monomer such as acrylic acid and a crosslinkable monomer having two or more unsaturated groups such as divinylbenzene as high molecular compound.

In the present invention, the developer to be used for the development of the silver halide black-and-white light-sensitive material may contain commonly used additives (e.g., developing agent, alkaline agent, pH buffer, preservative, chelating agent). In the present processing, any known method can be used and any known processing solution can be used. The processing temperature is normally selected between 18° C. and 50° C. but may fall below 18° C. or exceed 50° C.

The black-and-white developer may comprise known developing agents such as dihydroxybenzenes, 1-phenyl-3 -pyrazolidones and aminophenols, singly or in combination.

Examples of hydroxybenzene developing agents to be incorporated in the above mentioned black-and-white developer include hydroquinone, chlorohydroquinone, bromohydroquinone, isopropylhydroquinone, methylhydroquinone, 2,3-dichlorohydroquinone, 2,3-dibromohydroquinone, and 2,5-dimethylhydroquinone. Particularly preferred among these developing agents is hydroquinone.

Examples of 1-phenyl-3-pyrazolidone or derivatives thereof as auxiliary developing agents include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4,4-dimethyl-3-pyrazolidone.

Examples of p-aminphenolic auxiliary developing agents include N-methyl-p-aminophenol, p-aminophenol, N-(β-hydroxyethyl-p-aminophenol, N-(4-hydroxyphenyl) glycine, 2-methyl-p-aminophenol, and p-benzylaminophenol. Particularly preferred among these compounds is N-methyl-p-aminophenol.

In general, the dihydroxybenzene developing agent is preferably used in an amount of 0.05 mol/l to 0.8 mol/l. If a combination of dihydroxybenzenes and 1 -phenyl-3-pyrazolidones or p-aminophenols is used, it is preferred that the former be used in an amount of 0.05 mol/l to 0.5 mol/l while the latter be used in an amount of 0.06 mol/l or less.

Examples of sulfite preservatives to be used in the present invention include sodium sulfite, potassium sulfite, lithium sulfite, sodium bisulfite, potassium metabisulfite, and sodium formaldehyde bisulfite.

The black-and-white developer particularly for graphic art may contain sulfites in an amount of 0.3 mol/l or more. However, if sulfites are used in too large an amount, they are precipitated in the developer, contaminating the developer. Therefore, the upper limit of the amount of sulfites to be used is preferably 1.2 mol/l.

Examples of alkaline agents to be incorporated in the present developer include pH adjustors or buffers such as sodium hydroxide, potassium hydroxide, sodium carbonate, potassium carbonate, tribasic sodium phosphate, tribasic potassium phosphate, sodium silicate and potassium silicate.

Examples of additives to be used besides the above mentioned components include compounds such as boric acid and borax, development inhibitors such as sodium bromide, potassium bromide and potassium iodide, organic solvents such as ethylene glycol, diethylene glycol, triethylene glycol, dimethyl formamide, methyl cellosolve, hexylene glcyol, ethanol and methanol, mercapto compounds such as 1-phenyl-5-mercaptotetrazole and sodium 2-mercaptobenzimidazole-5-sulfonate, indazole compounds such as 5-nitroindazole, and fog inhibitors or black pepper inhibitors such as benztriazole compound (e.g., 5-methylbenztriazole). Further, toners, surface active agents, anti-foaming agents, hard water softeners, film hardeners, etc may be included as necessary.

The developer to be used in the present invention may comprise compounds as described in JP-A-56-24347 as silver stain inhibitors, compounds as described in JP-A-62-212651 as uneven development inhibitors, and compounds as described in JP-A-61-267759 as dissolution aids.

The above mentioned developer may comprise as buffers boric acid as described in JP-A-62-186259, saccharides (e.g., saccharose), oxims (e.g., acetoxim), phenols (e.g., 5-sulfosalicylic acid) and tribasic phosphates (e.g., sodium salt, potassium salt) or the like as described in JP-A-60-93433.

The fixing solution to be used in the present invention is an aqueous solution containing besides fixing agents a film hardener (e.g., water-soluble aluminum compound), acetic acid and a dibasic acid (e.g., tartaric acid, citric acid, salt thereof), preferably having a pH value of 3.8 or more, more preferably 4.0 to 7.5.

The fixing bath to be used in the present invention may contain known fixing agents in combination with the compound of the present invention. Examples of such fixing agents include sodium sulfate and ammonium thiosulfate. In particular, ammonium thiosulfate may be preferably used in view of fixing speed. The amount of the fixing agent to be used can be properly altered and is normally in the range of about 0.1 mol/l to about 5 mol/l. The water-soluble aluminum salt which serves mainly as film hardener in the fixing solution is a compound commonly known as film hardener for acidic film-hardening fixing solution. Examples of such a compound include aluminum chloride, aluminum sulfate, and potassium alum.

As the above mentioned dibasic acids there can be used tartatic acid or derivatives thereof and citric acid or derivatives thereof, singly or in combination. These compounds may be effectively incorporated in the fixing solution in an amount of 0.005 mol/l or more, particularly 0.01 mol/l to 0.03 mol/l.

Specific examples of such dibasic acids include tartaric acid, potassium tartarate, sodium tartarate, potassium sodium tartarate, ammonium tartarate, and ammonium potassium tartarate.

Examples of citric acid and derivatives thereof which can be effectively used in the present invention include citric acid, sodium citrate, and potassium citrate.

If necessary, the fixing solution may further contain a preservative (e.g., sulfite, bisulfite), a pH buffer (e.g., acetic acid, boric acid), a pH adjustor (e.g., ammonia, sulfuric acid), an image preservability improver (e.g., potassium iodide), and a chelating agent. Such a pH buffer is preferably used in an amount of 10 to 40 g/l, more preferably 18 to 25 g/l because the pH value of the developer is high.

The fixing temperature and time are the same as that of development and are preferably in the range of about 20° C. to about 50° C. and 10 seconds to 1 minute, respectively. The replenishment rate of the fixing solution is preferably in the range of 400 ml/m$^2$ or less.

The rinse solution may contain an anti-fungal agent (e.g., compound as described in Horiguchi, "Bokin Bobai no Kagaku", and JP-A-62-115154), rinse accelerator (e.g., sulfite), chelating agent or the like.

The replenishment rate of the rinse solution may be in the range of 1,200 ml/l or less (including none). The case where the replenishment rate of the rinse solution (or stabilizing solution) is zero means a so-called reservoir rinse process. As means for reducing the replenishment rate there has been heretofore known a multi-stage countercurrent process (e.g., two stages, three stages).

If any problem arises when the replenishment rate of water such as rinse water is low, excellent processing properties can be obtained by combining the following approaches.

The rinse bath or stabilizing bath may further contain isothiazoline compounds as described in R. T. Kreiman, "J. Image, Tech.", vol. 10, No. 6,242, 1984 and Research Disclosure Nos. 20,526, vol. 205, May 1981 and 22,845, vol. 228, April 1983, compounds as described in JP-A-61-115154 and JP-A-62-209532, or the like as microbiocides. In addition, the rinse bath or stabilizing bath may contain compounds as described in Hiroshi Horiguchi, "Bokin Bobai no Kagaku", Sankyo Shuppan, 1982, Nihon Bokin Bobai Gakkai, "Bokin Bobai Gijutsu Handbook", Hakuhodo, 1986, L. E. West, "Water Quality Criteria", Photo. Sci. & Eng. Vol. 9, No. 6 (1965), M. W. Beach, "Microbiological Growths in Motion Picture Processing", SMPTE Journal Vol. 85 (1976), and R. O. Deegan, "Photo Processing Wash Water Biocides", J. Imaging Tech. Vol. 10, No. 6 (1984).

If the light-sensitive material which has been processed in the present method is washed with a small amount of water, it is further preferred that there be provided a squeeze roller and a crossover rack washing tank as described in JP-A-63-18350 and JP-A-62-287252.

The overflow solution from the rinse bath or stabilizing bath caused by replenishing the rinse bath or stabilizing bath to be used after the present processing with water treated with an anti-fungal agent can be partially or entirely used as a processing solution having a fixing ability as its prebath as described in JP-A-60-235133 and JP-A-63-129343. Further, a water-soluble surface active agent or anti-foaming agent may be incorporated in the system to inhibit unevenness due to bubbling upon rinse with a small amount of wash water and/or transfer of components of the processing agent attached to the squeeze rollers to the processed film.

In order to inhibit stain with a dye eluted from the light-sensitive material, a dye adsorbent as described in JP-A-63-163456 may be introduced into the rinse bath.

In accordance with the above mentioned method, the photographic material which has been developed and fixed is then rinsed and dried. The rinse is effected to entirely remove silver salts dissolved by fixing. The rinse is preferably effected at a temperature of about 20° C. to about 50° C. for 10 seconds to 3 minutes. The drying is effected at a temperature of about 40° C. to about 100° C. The drying time can be properly altered depending on the ambient conditions and is normally in the range of about 5 seconds to 210 seconds.

Roller conveyor type automatic developing machines are described in U.S. Pat. Nos. 3,025,779 and 3,545,971 and will be simply referred to as "roller conveyor type processors" hereinafter. Roller conveyor type processors consist of four step sections, i.e., development portion, fixing portion, rinse portion and drying portion. The process of the present invention doesn't exclude other steps (e.g., stop step). In the most preferred embodiment, the process of the present invention consists of these four steps. In the rinse step, a 2- or 3-stage countercurrent rinse process can be employed to save water.

The developer to be used for the development of the light-sensitive material to be processed in the present invention is preferably stored in a wrapping material having a low oxygen permeability as described in JP-A-61-73147. The above mentioned developer may be preferably used with a replenishment system as described in JP-A-62-91939.

As previously mentioned, the first embodiment of the present invention can be applied to color photographic light-sensitive materials as well as black-and-white light-sensitive materials. Examples of such black-and-white light-sensitive materials include ordinary black-and-white silver halide photographic materials (e.g., black-and-white light-sensitive material for picture taking, X-ray black-and-white light-sensitive material, black-and-white light-sensitive material for print), and infrared light-sensitive materials for laser scanner.

BEST MODE FOR CARRYING OUT THE INVENTION

The present invention will be further described in the following examples, but the present invention should not be construed as being limited thereto.

Examples corresponding to the first embodiment of the present invention will be described as Examples 1 through 19.

EXAMPLE 1

A multilayer color light-sensitive material was prepared as Specimen 101 by coating on a undercoated cellulose triacetate film support various layers having the following compositions.

Composition of Light-sensitive Layer

The coated amount of silver halide and colloidal silver is represented in g/m$^2$ as calculated in terms of amount of silver. The coated amount of coupler, additive and gelatin is represented in g/m$^2$. The coated amount of sensitizing dye is represented in mol per mol of silver halide contained in the same layer.

| | |
|---|---|
| 1st Layer: anti-halation layer | |
| Black colloidal silver | 0.15 |
| Gelatin | 1.5 |
| ExM-8 | 0.8 |
| UV-1 | 0.03 |
| UV-2 | 0.06 |
| Solv-2 | 0.08 |
| UV-3 | 0.07 |
| Cpd-5 | $6 \times 10^{-4}$ |
| 2nd Layer: interlayer | |
| Gelatin | 1.5 |
| UV-1 | 0.03 |
| UV-2 | 0.06 |
| UV-3 | 0.07 |
| ExF-1 | 0.004 |
| Solv-2 | 0.07 |
| Cpd-5 | $6 \times 10^{-4}$ |
| 3rd layer: 1st red-sensitive emulsion layer | |
| Silver iodobromide emulsion (silver iodide content: 2 mol %, internal high AgI type; grain diameter: 0.3 μm as calculated in terms of sphere; coefficient of fluctuation in grain diameter: 29% as calculated in terms of sphere; mixture of normal crystal and twin crystal; diameter/thickness: 2.5) | 0.5 |
| Gelatin | 0.8 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.22 |
| ExC-4 | 0.02 |
| Cpd-5 | $3 \times 10^{-4}$ |
| 4th Layer: 2nd red-sensitive emulsion layer | |
| Silver iodobromide emulsion (silver iodide content: 4 mol %; internal high AgI type; grain diameter: 0.55 μm as calculated in terms of sphere; coefficient of fluctuation in grain diameter: 20% as calculated in terms of sphere; mixture of normal crystal and twin crystal; diameter/thickness: 1) | 0.7 |
| Gelatin | 1.26 |
| ExS-1 | $1 \times 10^{-4}$ |
| ExS-2 | $3 \times 10^{-4}$ |
| ExS-3 | $1 \times 10^{-5}$ |
| ExC-3 | 0.33 |
| ExC-4 | 0.01 |
| ExY-16 | 0.01 |
| ExC-7 | 0.04 |

-continued

| | |
|---|---|
| ExC-2 | 0.08 |
| Solv-1 | 0.03 |
| Cpd-5 | $5 \times 10^{-4}$ |
| 5th Layer: 3rd red-sensitive emulsion layer | |
| Silver iodobromide emulsion (silver iodide content: 10 mol %; internal high AgI type; grain diameter: 0.7 μm as calculated in terms of sphere; coefficient of fluctuation in grain diameter: 30% as calculated in terms of sphere; mixture of twin crystals; diameter/thickness: 2) | 0.7 |
| Gelatin | 0.8 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.06 |
| Solv-1 | 0.15 |
| Solv-2 | 0.08 |
| Cpd-5 | $3 \times 10^{-5}$ |
| 6th Layer: interlayer | |
| Gelatin | 1.0 |
| Cpd-5 | $4 \times 10^{-4}$ |
| Cpd-1 | 0.10 |
| Cpd-4 | 1.23 |
| Solv-1 | 0.05 |
| Cpd-3 | 0.25 |
| 7th Layer: 1st green-sensitive emulsion layer | |
| Silver iodobromide emulsion (silver iodide content: 2 mol %; internal high AgI type; grain diameter: 0.3 μm as calculated in terms of sphere; coefficient of fluctuation in grain diameter: 28% as calculated in terms of sphere; mixture of normal crystal and twin crystal; diameter/thickness: 2.5) | 0.30 |
| Gelatin | 0.4 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.2 |
| Cpd-5 | $2 \times 10^{-4}$ |
| 8th Layer: 2nd green-sensitive emulsion layer | |
| Silver iodobromide emulsion (silver iodide content: 4 mol %; internal high AgI type; grain diameter: 0.55 μm as calculated in terms of sphere; coefficient of fluctuation in grain diameter: 20% as calculated in terms of sphere; mixture of normal crystal and twin crystal; diameter/thickness: 4) | 0.6 |
| Gelatin | 0.8 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.04 |
| Solv-1 | 0.2 |
| Cpd-5 | $3 \times 10^{-4}$ |
| 9th Layer: 3rd green-sensitive emulsion layer | |
| Silver iodobromide emulsion (silver iodide content: 10 mol %; internal high AgI type; grain diameter: 0.7 μm as calculated in terms of sphere; coefficient of fluctuation in grain diameter: 30% as calculated in terms of sphere; mixture of normal crystal and twin crystal; diameter/thickness: 2.0) | 0.85 |
| Gelatin | 1.0 |
| ExS-4 | $2.0 \times 10^{-4}$ |
| ExS-5 | $2.0 \times 10^{-4}$ |

-continued

| | |
|---|---|
| ExS-6 | $0.2 \times 10^{-4}$ |
| ExS-7 | $3.0 \times 10^{-4}$ |
| ExM-12 | 0.06 |
| ExM-13 | 0.02 |
| ExM-8 | 0.02 |
| Solv-1 | 0.20 |
| Solv-2 | 0.05 |
| Cpd-5 | $4 \times 10^{-4}$ |
| 10th Layer: yellow filter layer layer | |
| Gelatin | 0.9 |
| Yellow colloidal silver | 0.05 |
| Cpd-1 | 0.2 |
| Solv-1 | 0.15 |
| Cpd-5 | $4 \times 10^{-4}$ |
| 11th Layer: 1st blue-sensitive emulsion layer | |
| Silver iodobromide emulsion (silver iodide content: 4 mol %; internal high AgI type; grain diameter: 0.5 μm as calculated in terms of sphere; coefficient of fluctuation in grain diameter: 15% as calculated in terms of sphere; octahedral grain) | 0.4 |
| Gelatin | 1.0 |
| ExS-8 | $2 \times 10^{-4}$ |
| ExY-16 | 0.9 |
| ExY-14 | 0.09 |
| Solv-1 | 0.3 |
| Cpd-5 | $4 \times 10^{-4}$ |
| 12th Layer: 2nd blue-sensitive emulsion layer | |
| Silver iodobromide emulsion (silver iodide content: 10 mol %; internal high AgI type; grain diameter: 1.3 μm as calculated in terms of sphere; coefficient of fluctuation in grain diameter: 25% as calculated in terms of sphere; mixture of normal crystal and twin crystal; diameter/thickness: 4.5) | 0.5 |
| Gelatin | 0.6 |
| ExS-8 | $1 \times 10^{-4}$ |
| ExY-16 | 0.12 |
| Solv-1 | 0.04 |
| Cpd-5 | $2 \times 10^{-4}$ |
| 13th Layer: 1st protective layer | |
| Finely divided silver iodobromide emulsion (average grain diameter: 0.07 μm; AgI content: 1 mol %) | 0.2 |
| Gelatin | 0.8 |
| UV-3 | 0.1 |
| UV-4 | 0.1 |
| UV-5 | 0.2 |
| Solv-3 | 0.04 |
| Cpd-5 | $3 \times 10^{-4}$ |
| 14th Layer: 2nd protective layer | |
| Gelatin | 0.9 |
| Polymethyl methacrylate grains (diameter: 1.5 μm) | 0.2 |
| Cpd-5 | $4 \times 10^{-4}$ |
| H-1 | 0.4 |

In addition to the above mentioned components, a surface active agent was incorporated in each of these layers as coating aid. Thus, Specimen 101 was obtained.

The chemical structural formula and chemical name of the compounds used herein will be set forth below.

UV-4

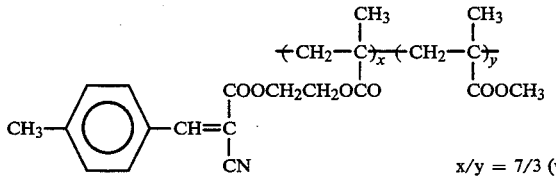

x/y = 7/3 (weight ratio)

UV-5

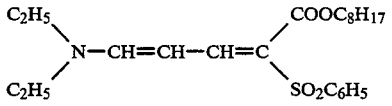

UV-1

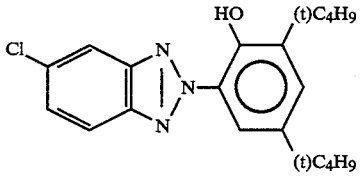

UV-2

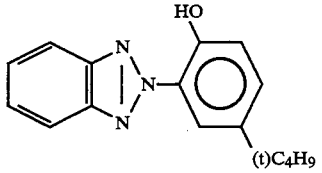

UV-3

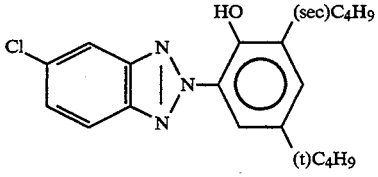

Solv-1: Tricresyl phosphate

Solv-2: Dibutyl phthalate

Solv-3: Bis(2-ethylhexyl)phthalate

-continued
ExM-8:
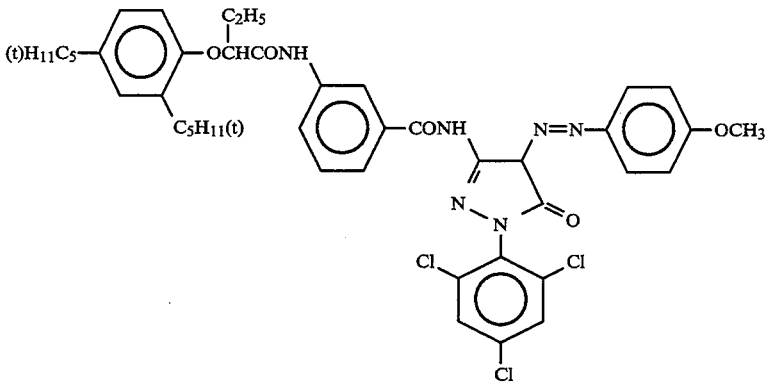
ExF-1:
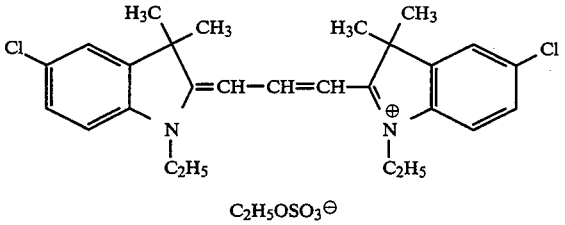
ExC-2:
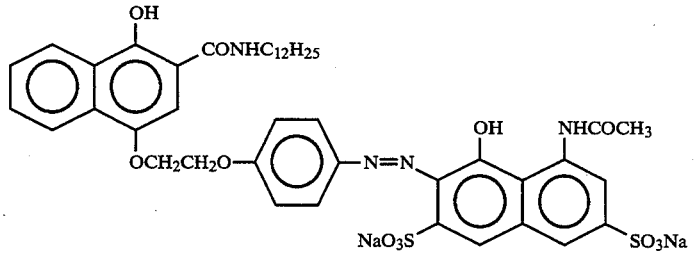
ExC-3:
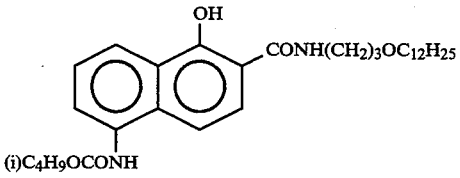
ExY-14:
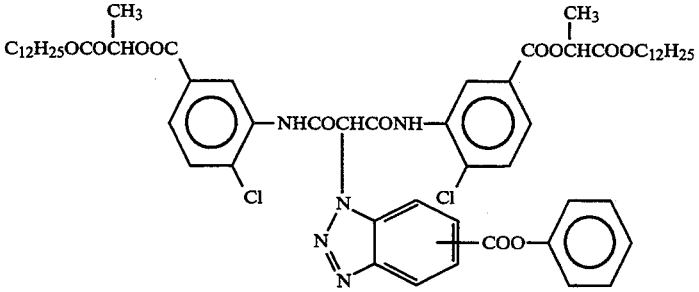

-continued
ExC-4:
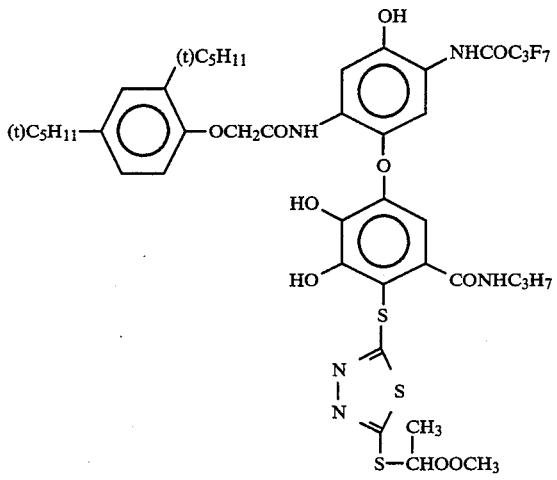
ExY-15:
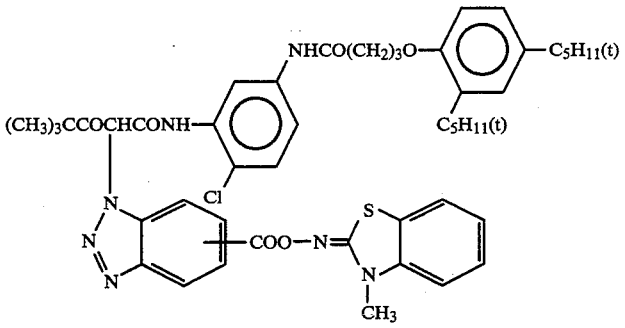
ExC-5:
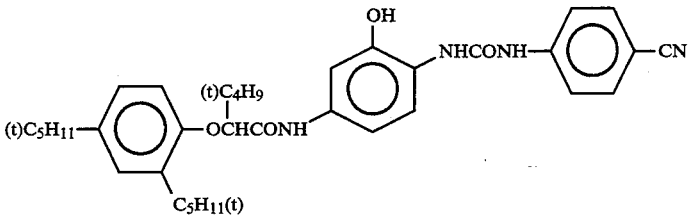
ExC-6:
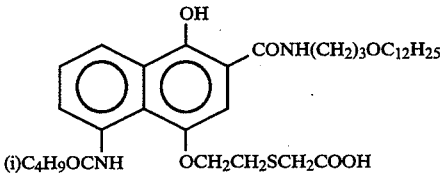
ExC-7:
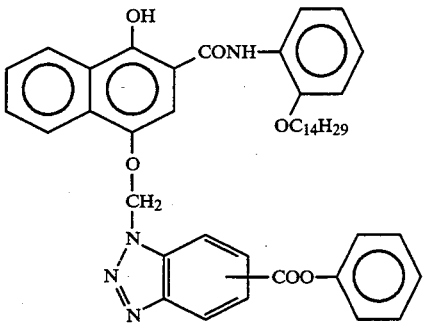

-continued
ExM-9:
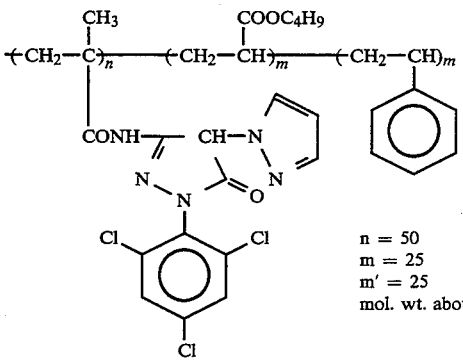
n = 50
m = 25
m' = 25
mol. wt. about 20,000
ExM-10:
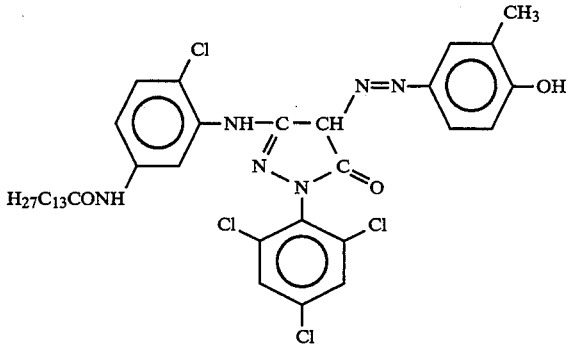
ExM-12:
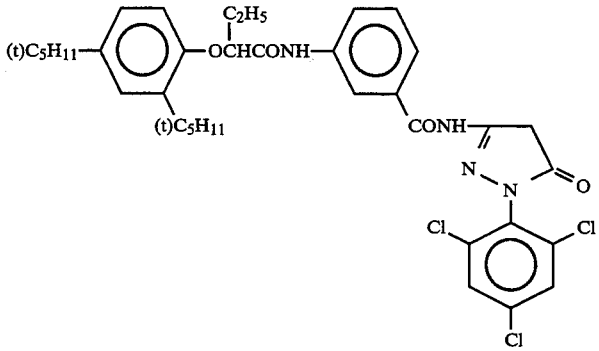
ExM-13:
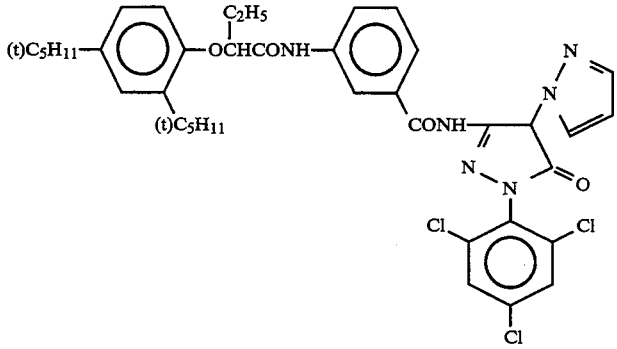

-continued
ExM-16:
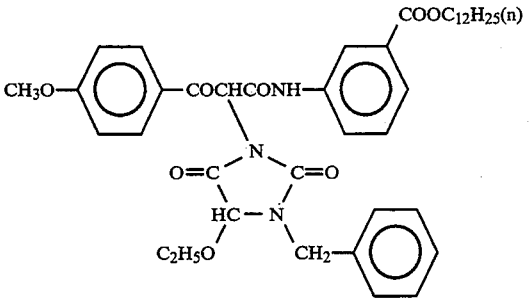
Cpd-1:
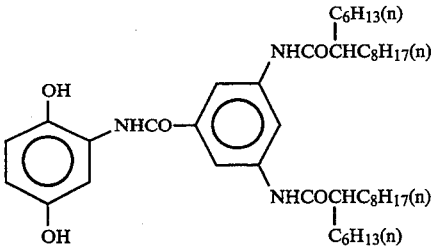
Cpd-2:
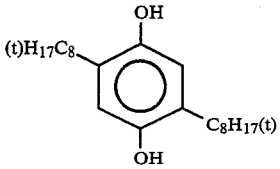
ExS-1:
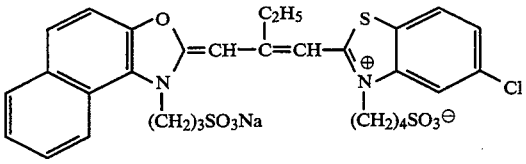
ExS-2:
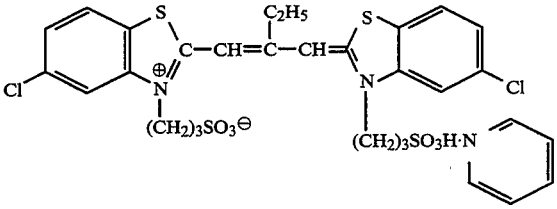
ExS-3:
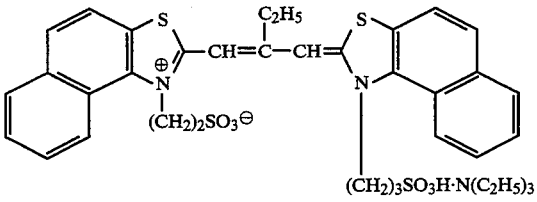
ExS-4:
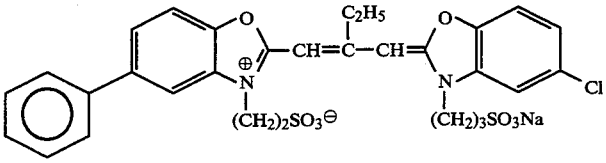
ExS-5:
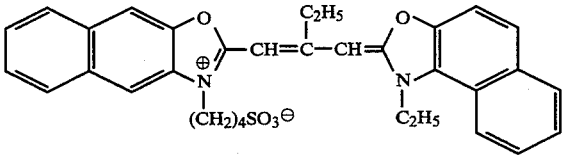

-continued

ExS-6:

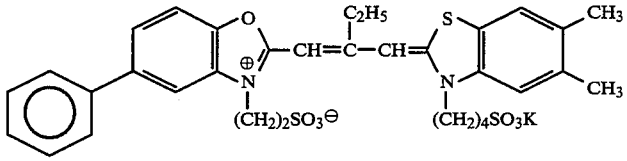

ExS-7:

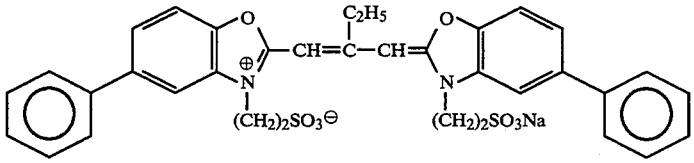

ExS-8:

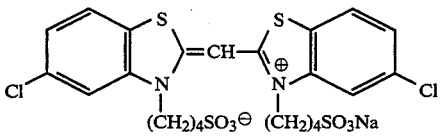

H-1:

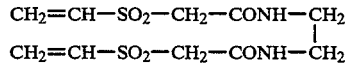

Cpd-3:

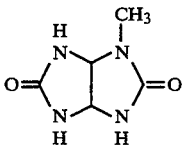

Cpd-4:

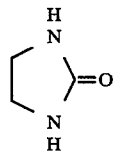

Cpd-5:

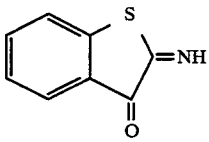

The dried thickness of all the coat layers of Specimen 101 except the support and its subbing layer was 17.6 μm, and its swelling speed ($T_{\frac{1}{2}}$) was 8 seconds.

The specimen thus prepared was then cut into 35-mm wide strips. These strips were then imagewise exposed to light, and subjected to running processing in accordance with the following steps by means of an automatic developing machine until the accummulated replenishment of the fixing solution reached 3 times the tank capacity.

| | | Processing step | | |
|---|---|---|---|---|
| Step | Time | Temperature | Replenishment rate* | Tank capacity |
| Color development | 3 min. 15 sec. | 38° C. | 15 ml | 20 l |
| Bleach | 4 min. 30 sec. | 38° C. | 10 ml | 40 l |
| Rinse | 2 min. 10 sec. | 35° C. | 10 ml | 20 l |
| Fixing | 4 min. 20 sec. | 38° C. | 30 ml | 30 l |
| Washing (1) | 1 min. 05 sec. | 35° C. | — | 10 l |
| Washing (2) | 1 min. 00 sec. | 35° C. | 20 ml | 20 l |
| Stabilization | 1 min. 05 sec. | 38° C. | 10 ml | 0 l |
| Drying | 4 min. 20 sec. | 55° C. | | |

*Determined per 35-mm width and 1-m length

The washing step was effected in a countercurrent process wherein the washing water flows backward.

The various processing solutions had the following compositions:

| | Running Solution | Replenisher |
|---|---|---|
| Color developer | | |

-continued

| | Running Solution | Replenisher |
|---|---|---|
| Diethylenetriamine-pentaacetic acid | 1.0 g | 1.1 g |
| 1-Hydroxyethylidene-1,1-diphosphonic acid | 3.0 g | 3.2 g |
| Sodium sulfite | 4.0 g | 4.9 g |
| Potassium carbonate | 30.0 g | 30.0 g |
| Potassium bromide | 1.4 g | — |
| Potassium iodide | 1.5 mg | — |
| Hydroxylamine sulfate | 2.4 g | 3.6 g |
| 4-[N-ethyl-N-(β-hydroxyethyl)amino] aniline sulfate | 4.5 g | 7.2 g |
| Water to make | 1.0 l | 1.0 l |
| pH | 10.05 | 10.10 |
| Bleaching solution | | |
| Ferric ammonium 1,3-propylenediamine-tetraacetate monohydrate | 144.0 g | 206.0 g |
| Ammonium bromide | 84.0 g | 12.0 g |
| Ammonium sulfate | 30.0 g | 41.7 g |
| 98% Acetic acid | 28.0 g | 40.0 g |
| Hydroxyacetic acid | 63.0 g | 90.0 g |
| Water to make | 1.0 l | 1.0 l |
| 27% Aqueous ammonia to make | pH 3.0 | pH 2.8 |
| Fixing solution | | |
| Disodium ethylenediamine-tetraacetate | 0.5 g | 1.0 g |
| Sodium sulfite | 7.0 g | 12.0 g |
| Sodium bisulfite | 5.0 g | 9.5 g |
| Fixing agent 70 wt. % Aqueous solution of ammonium thiosulfate | 170.0 ml | 240.0 ml |
| or fixing agent as set forth in Table 1 | 0.8 mol | 1.1 mol |
| Water to make | 1.0 l | 1.0 l |

-continued

| | Running Solution | Replenisher |
|---|---|---|
| pH | 6.7 | 6.7 |

Washing Solution (The running solution was used also as replenisher)

Tap water was passed through a mixed bed column packed with an H-type strongly acidic cation exchange resin (Amberlite IR-120B available from Rohm & Haas) and an OH-type anion exchange resin (Amberlite IR-400 available from the same company) so that the calcium and magnesium ion concentrations were each reduced to 3 mg/l or less. Dichlorinated sodium isocyanurate and sodium sulfate were then added to the solution in amounts of 20 mg/l and 0.15 g/l, respectively.

The washing solution thus obtained had a pH value of 6.5 to 7.5.

Stabilizing solution

| | Running Solution | Replenisher |
|---|---|---|
| 37% Formalin | 2.0 ml | 3.0 ml |
| Polyoxyethylene-p-mononononylphenylether (mean polymerization degree: 10) | 0.3 g | 0.45 g |
| Disodium ethylenediamine-tetraacetate | 0.05 g | 0.08 g |
| Water to make | 1.0 l | 1.0 l |
| pH | 5.0–8.0 | 5.0–8.0 |

The specimen which had been subjected to running processing was then subjected to fixing for 2 minutes and 3 minutes.

The specimens thus processed were then measured for amount of silver left on the unexposed portion by X-ray fluorescence.

Another batch of the specimen which had been subjected to running processing was stored at a temperature of 60° C. and a relative humidity of 70% for 10 days. The change in the minimum density of magenta (ΔDmin) between before and after storage was determined.

Comparative specimens were prepared in the same manner as in Specimen 101 except that the compound of the present invention was replaced by the following comparative compound (A) as described in U.S. Pat. No. 4,378,424, the comparative compounds (B) and (C) as described in JP-A-1201659, and the comparative compound (D) as described in JP-A-2-44355 in the equimolecular amount, respectively. These comparative specimens were then subjected to the same tests as described above.

Comparative Compound (A)

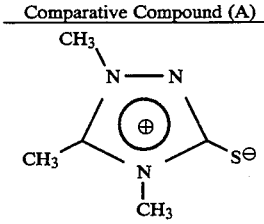

Comparative Compound (B)

-continued

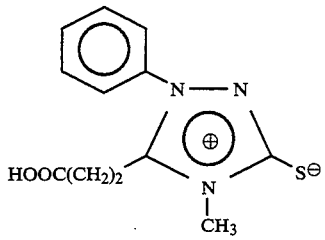

Comparative Compound (C)

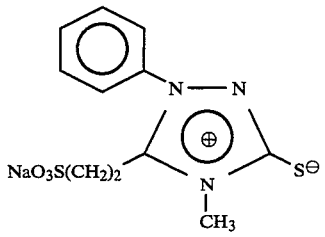

Comparative Compound (D)

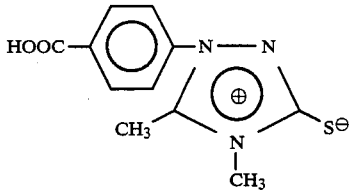

The results are set forth in Table 1.

Table 1 shows that the use of the compound of the present invention as fixing agent can provide excellent results, i.e., excellent desilvering properties upon rapid processing and little stain after heat and humidity test.

TABLE 1

| Fixing agent | Residual amount of silver (μg/cm²) 2-min. fixing | 3-min. fixing | Change in minimum magenta density (ΔDmin) between before and after thermal test | Remarks |
|---|---|---|---|---|
| Ammonium thiosulfate | 25.0 | 4.0 | +0.07 | Comparative |
| Compound A-1 | 5.1 | 0.7 | +0.03 | Present Invention |
| Compound A-2 | 5.8 | 0.7 | +0.03 | Present Invention |
| Compound A-6 | 5.7 | 0.7 | +0.03 | Present Invention |
| Comparative Compound A | 10.0 | 0.8 | +0.10 | Comparative |
| Comparative Compound B | 9.0 | 0.8 | +0.8 | Comparative |
| Comparative Compound C | 9.1 | 0.7 | +0.08 | Comparative |
| Comparative Compound D | 0.5 | 0.8 | +0.09 | Comparative |

EXAMPLE 2

Specimens were prepared in the same manner as in Specimen 101 except that Compound A-1 was replaced by. Compounds A-3, A-5, A-7, A-9 and A-13, respectively, and then subjected to the same tests as in Example 1.

As a result, it was found that the use of the fixing agents of the present invention can provide excellent properties as in Example 1, i.e., excellent image preservability (after heat and humidity test) and excellent desilvering properties (fixining properties) upon rapid processing.

EXAMPLE 3

A color negative film for picture taking which had been prepared in the same manner as in Example 2 in JP-A-2-93641 was imagewise exposed to light by means of a sensitometer (Type FWH, available from Fuji Photo Film Co., Ltd.).

The specimen was then subjected to continuous processing (running test) in the following steps by means of an automatic developing machine for color negative film until the replenishment reached twice the capacity of the fixing bath.

| Processing step | | | | |
|---|---|---|---|---|
| Step | Time | Temperature | Replenishment rate* | Tank capacity |
| Color development | 3 min. 15 sec. | 38° C. | 23 ml | 15 l |
| Bleach | 50 sec. | 38° C. | 5 ml | 5 l |
| Blix | 50 sec. | 38° C. | — | 5 l |
| Fixing | 50 sec. | 38° C. | 16 ml | 5 l |
| Washing (1) | 30 sec. | 38° C. | — | 3 l |
| Washing (2) | 20 sec. | 38° C. | 34 ml | 3 l |
| Stabilization | 20 sec. | 38° C. | 20 ml | 3 l |
| Drying | 1 min. | 55° C. | | |

*Determined per 35-mm width and 1-m length

The washing step was effected in a countercurrent process wherein the washing water flows backward. The overflow from the washing tanks were all introduced into the fixing bath. In the automatic developing machine, the upper portion of the bleaching bath and the lower portion of the blix bath, and the upper portion of the fixing bath and the lower portion of the blix bath were connected to each other via a pipe so that the overflow produced by the supply of the replenisher to the bleaching bath and the fixing bath entirely flew into the blix bath. The amount of the developer brought over to the bleaching step, the amount of the bleaching solution brought over to the blix step, and the amount of the fixing solution brought over to the washing step were 2.5 ml, 2.0 ml, and 2.0 ml per m of 35-mm wide light-sensitive material, respectively. The time for crossover was 5 seconds in all the steps. This crossover time is included in the processing time at the previous step.

The various processing solutions had the following compositions:

| | Running Solution | Replenisher |
|---|---|---|
| Developer | | |
| Diethylenetriamine-pentaacetic acid | 2.0 g | 2.2 g |
| 1-Hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-Methyl-4-[N-ethyl-N-(β-hydroxyethyl)amino] aniline sulfate | 4.5 g | 6.1 g |
| Water to make | 1.0 l | 1.0 l |
| pH | 10.05 | 10.15 |
| Bleaching solution | | |
| Ferric ammonium 1,3-propylenediamine-tetraacetate monohydrate | 144.0 g | 206.0 g |
| Ammonium bromide | 84.0 g | 120.0 g |
| Ammonium nitrate | 17.5 g | 25.0 g |
| Hydroxyacetic acid | 63.0 g | 90.0 g |
| Acetic acid | 33.2 g | 47.4 g |
| Water to make | 1.0 l | 1.0 l |
| pH adjusted with aqueous ammonia | 3.20 | 2.80 |

Blix Solution (running solution)

15:85 Mixture of the running solution of the bleaching bath and the running solution of the fixing bath.

| Fixing solution | Running Solution | Replenisher |
|---|---|---|
| Ammonium sulfite | 19.0 g | 57.0 g |
| Aqueous solution of ammonium thiosulfate (700 g/l) | 280 ml | 840 ml |
| or fixing agent of the present invention | 1.32 mol | 3.97 mol |
| Imidazole | 28.5 g | 85.5 g |
| Ethylenediaminetetraacetic acid | 12.5 g | 37.5 g |
| Water to make | 1.0 l | 1.0 l |
| pH adjusted with aqueous ammonia and acetic acid | 7.40 | 7.45 |

Washing Solution (The running solution was used also as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

| Stabilizing solution (The running solution was also used as replenisher) | |
|---|---|
| 37% Formalin | 2.0 ml |
| Polyoxyethylene-p-monononylphenylether (mean polymerization degree: 10) | 0.3 g |
| Disodium ethylenediaminetetraacetate | 0.05 g |
| Water to make | 1.0 l |
| pH | 5.0–8.0 |

The specimen which had been subjected to running processing was then subjected to fixing for 40 seconds and 45 seconds.

The specimens thus processed were then measured for amount of silver left on the unexposed portion by X-ray fluorescence.

Another batch of the specimen which had been subjected to running processing was stored at a temperature of 60° C. and a relative humidity of 70% for 10 days. The change in the minimum density of magenta (ΔDmin) between before and after storage was determined.

Comparative specimens were prepared in the same manner as in Specimen 101 except that the compound of the present invention was replaced by Comparative Compounds (A), (B), (C) and (D) in the equimolecular amount, respectively. These comparative specimens were then subjected to the same tests as described above.

The results are set forth in Table 2.

Table 2 shows that the use of the compound of the present invention as fixing agent can provide excellent results, i.e., excellent desilvering properties upon rapid processing and little stain after heat and humidity test.

TABLE 2

| Fixing agent | Residual amount of silver ($\mu g/cm^2$) 40-sec. fixing | 45-sec. fixing | Change in minimum magenta density (ΔDmin) between before and after thermal test | Remarks |
|---|---|---|---|---|
| Ammonium thiosulfate | 20 | 1.1 | +0.06 | Comparative |
| Compound A-1 | 1.1 | 0.8 | +0.03 | Present Invention |
| Compound A-2 | 1.3 | 0.9 | +0.03 | Present Invention |
| Compound A-6 | 1.2 | 0.8 | +0.03 | Present Invention |
| Comparative Compound A | 7.5 | 0.9 | +0.10 | Comparative |
| Comparative Compound B | 7.3 | 0.9 | +0.8 | Comparative |
| Comparative Compound C | 6.8 | 0.9 | +0.07 | Comparative |
| Comparative Compound D | 7.2 | 0.9 | +0.08 | Comparative |

EXAMPLE 2

Specimens were prepared in the same manner as in Example 3 except that Compound A-1 was replaced by Compounds A-3, A-4, A-5, A-7, A-8, A-9, A-12, A-13, A-14, A-17, A-18, A-20, A-22, A-24, A-29, A-30, A-31, A-39, A-43, A-45, A-52, and A-54, respectively, and then subjected to the same tests as in Example 3.

As a result, it was found that the use of the fixing agents of the present invention can provide excellent properties as in Example 3, i.e., little thermostain after heat and humidity test and excellent desilvering properties (fixing properties) upon rapid processing.

EXAMPLE 5

A multi-layer color photographic paper was prepared by coating on a polyethylene double-laminated paper support various layers having the following compositions. The coating solutions for the various layers were prepared as follows:

Preparation of 1st Layer Coating Solution 19.1 g of a yellow coupler (ExY), 4.4 g of a dye image stabilizer (Cpd-1) and 0.8 g of a dye image stabilizer (Cpd-7) were dissolved in 27.2 cc of ethyl acetate and 8.2 g of a solvent (Solv-1). The solution was then emulsion-dispersed in 185 cc of a 10% aqueous solution of gelatin containing 8 cc of 10% sodium dodecylbenzenesulfonate. On the other hand, to a silver chlorobromide emulsion (3:7 (silver molar ratio) of an emulsion of cubic grains with an average grain size of 0.88 μm and a grain size distribution fluctuation coefficient of 0.08 and an emulsion of cubic grains with an average grain size Of 0.70 μm and a grain size distribution fluctuation coefficient of 0.10, each emulsion comprising 0.2 mol % silver bromide localized thereon) was added a blue-sensitive sensitizing dye as set forth below in an amount of $2.0\times10^{-4}$ mol per mol of silver for large size emulsion and $2.5\times10^{-4}$ mol per mol of silver for small size emulsion. The emulsion was then subjected to sulfur sensitization. The emulsion dispersion previously prepared and the emulsion thus prepared were mixed to prepare the first layer coating solution having the composition as set forth below.

Coating solutions for the 2nd to 7th layers were prepared in the same manner as in the 1st layer coating solution. As gelatin hardener for each of these layers there was used sodium salt of 1-oxy-3,5-dichloro-s-triazine.

As spectral sensitizing dyes for each of these layers there were used the following compounds:

Blue-sensitive emulsion layer

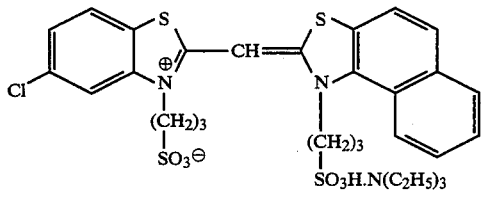

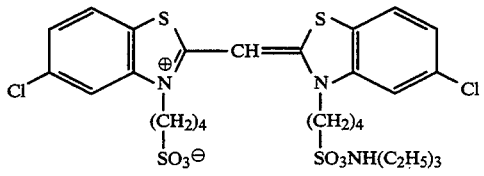

($2.0\times10^{-4}$ mol per mol of silver halide for large size emulsion and $2.5\times10^{-4}$ mol per mol of silver halide for small size emulsion)

Green-sensitive emulsion layer

-continued

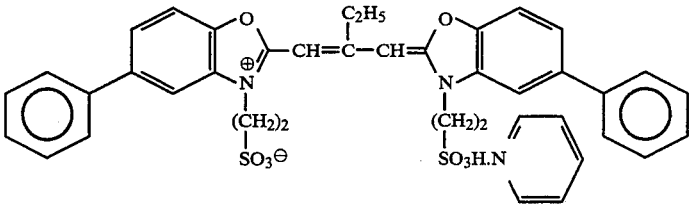

(4.0 × $10^{-4}$ mol per mol of silver halide for large size emulsion and 5.6 × $10^{-4}$ mol per mol of silver halide for small size emulsion)

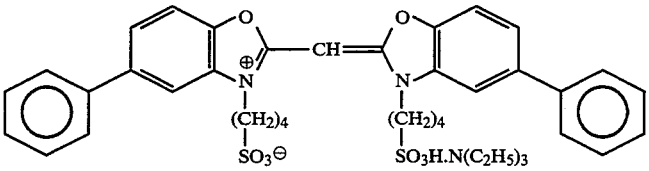

(7.0 × $10^{-5}$ mol per mol of silver halide for large size emulsion and 1.0 × $10^{-5}$ mol per mol of silver halide for small size emulsion)

Red-sensitive emulsion layer

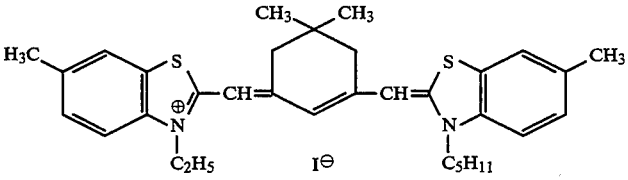

(0.9 × $10^{-4}$ mol per mol of silver halide for large size emulsion and 1.1 × $10^{-4}$ mol per mol of silver halide for small size emulsion)

To the red-sensitive emulsion layer was added the following compound in an amount of $2.6\times10^{-3}$ mol per mol of silver halide:

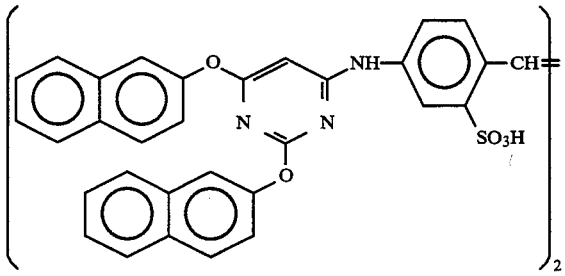

To the blue-sensitive emulsion layer, the green-sensitive emulsion layer and the red-sensitive emulsion layer was added 1-(5-methylureidephenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and the green-sensitive emulsion layer was added 4-hydroxy-6-methyl-1,3,3a,7-tetraazaindene in amounts of $1\times10^{-4}$ mol and $2\times10^{-4}$ mol per mol of silver halide, respectively.

In order to inhibit irradiation, the following dyes were added to the emulsion layer.

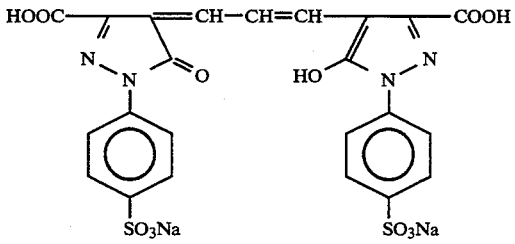

and

-continued

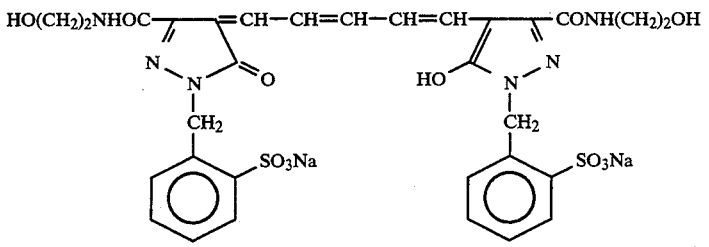

Layer Structure

The composition of the various layers will be set forth below. The figure indicates the coated amount of each component (g/m$^2$). The coated amount of silver halide emulsion is represented as calculated in terms of silver.

Support

Polyethylene-laminated paper [Polyethylene on the 1st layer side contains a white pigment ($TiO_2$) and a bluish dye (ultramarine)]

| | |
|---|---|
| 1st layer: blue-sensitive layer | |
| Previously mentioned silver chlorobromide emulsion | 0.30 |
| Gelatin | 1.86 |
| Yellow coupler (ExY) | 0.82 |
| Dye image stabilizer (Cpd-1) | 0.19 |
| Solvent (Solv-1) | 0.35 |
| Dye image stabilizer (Cpd-7) | 0.06 |
| 2nd layer: color stain inhibiting layer | |
| Gelatin | 0.99 |
| Color stain inhibitor (Cpd-5) | 0.08 |
| Solvent (Solv-1) | 0.16 |
| Solvent (Solv-4) | 0.08 |
| 3rd layer: green-sensitive layer | |
| Silver chlorobromide emulsion (1:3 (Ag molar ratio) mixture of cubic grains with an average grain size of 0.55 μm and a grain size distribution fluctuation coefficient of 0.10 and cubic grains with an average grain size of 0.39 μm and a grain size distribution fluctuation coefficient of 0.08, each emulsion comprising 0.8 mol % AgBr localized thereon) | 0.12 |
| Gelatin | 1.24 |
| Magenta coupler (ExM) | 0.20 |
| Dye image stabilizer (Cpd-2) | 0.03 |
| Dye image stabilizer (Cpd-3) | 0.15 |
| Dye image stabilizer (Cpd-4) | 0.02 |
| Dye image stabilizer (Cpd-9) | 0.02 |
| Solvent (Solv-2) | 0.40 |
| 4th layer: ultraviolet absorbing layer | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| 5th layer: red-sensitive layer | |
| Silver chlorobromide emulsion (1:4 (Ag molar ratio) mixture of cubic grains with an average grain size of 0.58 μm and a grain size distribution fluctuation coefficient of 0.90 and cubic grains with an average grain size of 0.45 μm and a grain size distribution fluctuation coefficient of 0.11, each emulsion comprising 0.6 mol % AgBr localized thereon) | 0.23 |
| Gelatin | 1.34 |
| Cyan coupler (ExC) | 0.32 |
| Dye image stabilizer (Cpd-6) | 0.17 |
| Dye image stabilizer (Cpd-7) | 0.40 |
| Dye image stabilizer (Cpd-8) | 0.04 |
| Solvent (Solv-6) | 0.15 |
| 6th layer: ultraviolet absorbing layer | |
| Gelatin | 0.53 |
| Ultraviolet absorbent (UV-1) | 0.16 |
| Color stain inhibitor (Cpd-5) | 0.02 |
| Solvent (Solv-5) | 0.08 |

-continued
| 7th layer: protective layer | |
|---|---|
| Gelatin | 1.33 |
| Acryl-modified copolymer of polyvinyl alcohol (modification degree: 17%) | 0.17 |
| Liquid paraffin | 0.03 |
Yellow Coupler (ExY)
1:1 (molar ratio) mixture of:
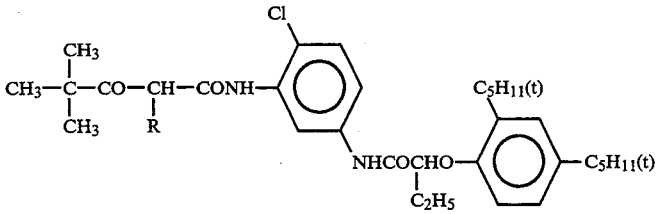
R = 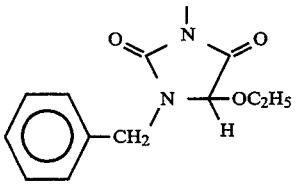 and
R = 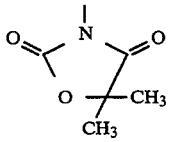
Magenta Coupler (ExM)
1:1 (molar ratio) mixture of:
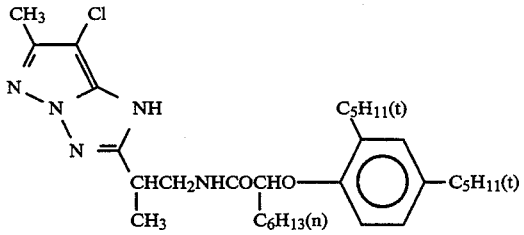
and
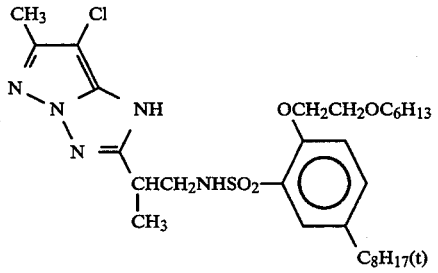
Cyan Coupler (ExC)
2:4:4 (weight ratio) mixture of:

-continued
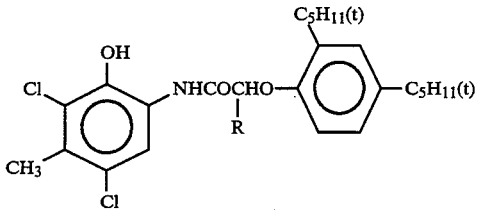
R = $C_2H_5$ and $C_4H_9$
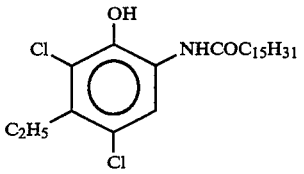
Dye image stabilizer (Cpd-1)
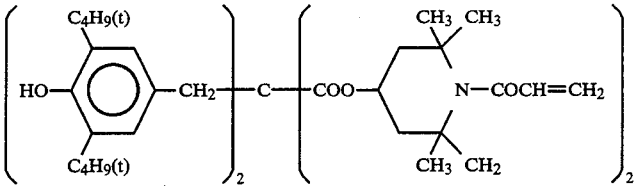
Dye image stabilizer (Cpd-2)
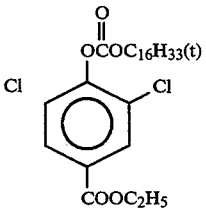
Dye image stabilizer (Cpd-3)
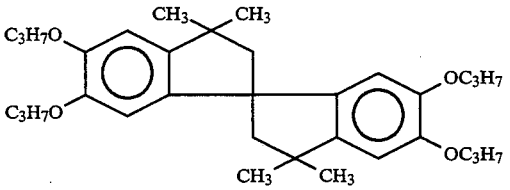
Dye image stabilizer (Cpd-4)
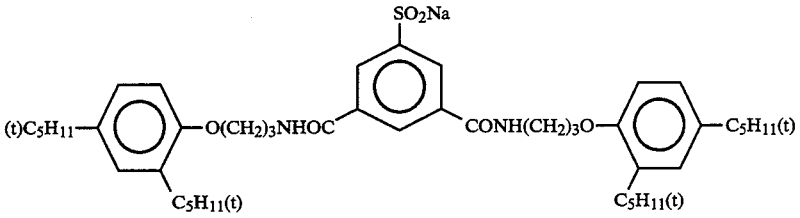
Dye image stabilizer (Cpd-5)

-continued
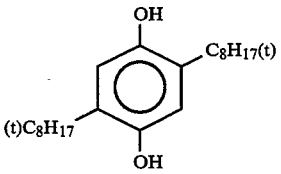
Dye image stabilizer (Cpd-6)
2:4:4 (weight ratio) mixture of:
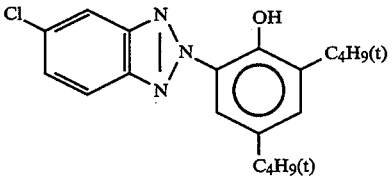
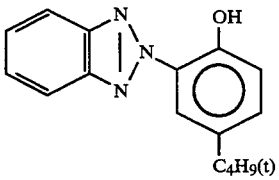
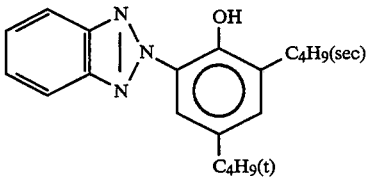
Dye image stabilizer (Cpd-7)
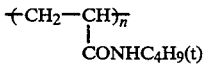
average molecular weight: 60,000
Dye image stabilizer (Cpd-8)
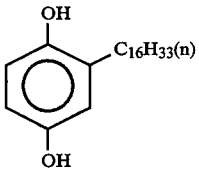
Dye image stabilizer (Cpd-9)
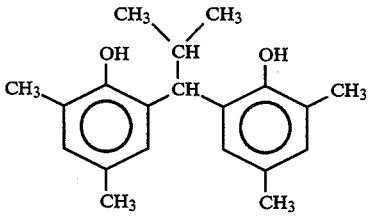
Ultraviolet absorbent (UV-1)
4:2:4 (weight ratio) mixture of:

-continued
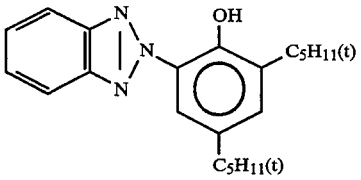
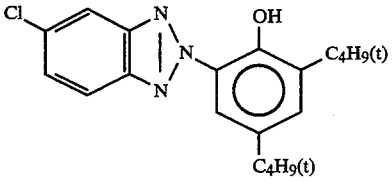
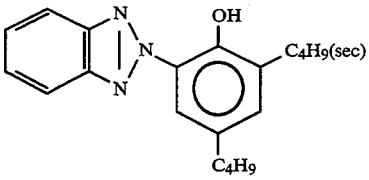
Solvent (Solv-1)
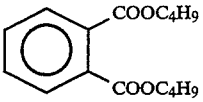
Solvent (Solv-2)
2:1 (volume ratio) mixture of:
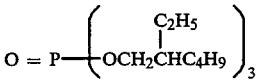
and
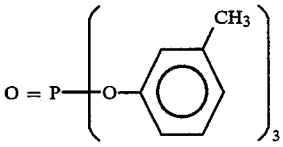
Solvent (Solv-4)
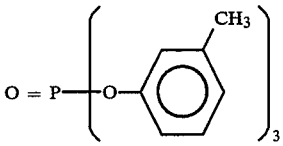
Solvent (Solv-5)
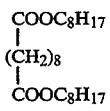
Solvent (Solv-6)

-continued

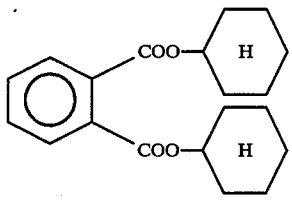

The above mentioned light-sensitive material was imagewise exposed to light, and then subjected to continuous processing (running test) in the following steps by means of a paper processing machine until the replenishment reached twice the tank capacity of the blix bath.

| Processing Step | Temperature | Time | Replenishment rate | Tank capacity |
|---|---|---|---|---|
| Color development | 35° C. | 45 sec. | 109 ml | 17 l |
| Blix | 35° C. | 45 sec. | 61 ml | 17 l |
| Rinse 1 | 35° C. | 30 sec. | — | 10 l |
| Rinse 2 | 35° C. | 30 sec. | — | 10 l |
| Rinse 3 | 35° C. | 30 sec. | 300 ml | |
| Drying | 80° C. | 60 sec. | | |

*Determined per $m^2$ of light-sensitive material

*The blix bath was replenished with its replenisher and the solution from Rinse 1 (121 ml).

*The rinse was effected in a 3-stage countercurrent process wherein water flows backward.

| | Running Solution | Replenisher |
|---|---|---|
| Color developer | | |
| Water | 800 ml | 800 ml |
| Ethylenediamine-N,N,N,N-tetramethylenephosphonic acid | 3.0 g | 3.0 g |
| Triethanolamine | 5.0 g | 5.0 g |
| Potassium chloride | 3.1 g | — |
| Potassium bromide | 0.015 g | — |
| Potassium carbonate | 25 g | 25 g |
| Hydraziondiacetic acid | 5.0 g | 7.0 g |
| N-ethyl-N-(β-methanesulfonamideethyl)-3-methyl-4-aminoaniline sulfate | 5.0 g | 9.5 g |
| Fluorescent brightening agent (WHITEX-4, available from Sumitomo Chemical Co., Ltd.) | 1.0 g | 2.5 g |
| Water to make | 1,000 ml | 1,000 ml |
| pH adjusted with potassium hydroxide | 10.05 | 10.60 |
| Blix solution | | |
| Water | 600 ml | 600 ml |
| 70 wt. % Ammonium thiosulfate | 100 ml | 245 ml |
| or compound of the present invention | 0.4 mol | 1.0 mol |
| Ammonium sulfite | 45 g | 105 g |
| Ferric ammonium ethylenediaminetetraacetate | 55 g | 135 g |
| Ethylenediaminetetraacetic acid | 3.0 g | 8.0 g |
| Ammonium bromide | 30 g | 75 g |
| Nitric acid (67%) | 27 g | 68 g |
| Water to make | 1 l | 1 l |
| pH | 5.80 | 5.60 |

Rinse Solution (The running solution was used also as replenishmer)

Ion-exchanged water (Ca and Mg concentration: 3 ppm or less each)

The specimen which had been subjected to running processing was then stored at a temperature of 60° C. and a relative humidity of 70% for 10 days. The change in the minimum magenta density (ΔDmin) between before and after the heat and humidity test was determined. The specimen was further measured for the amount of silver left on the unexposed portion by means X-ray fluorescence.

Comparative specimens were prepared in the same manner as in Example 1 except that the compound of the present invention was replaced by Comparative Compounds (A), (B), (C) and (D) in the equimolecular amount, respectively. These comparative specimens were then subjected to the same tests as described above.

The results are set forth in Table 3.

Table 3 shows that the use of the compound of the present invention as fixing agent can provide excellent results, i.e., excellent desilvering properties upon rapid processing and little stain after heat and humidity test.

TABLE 3

| Fixing agent | Residual amount of silver ($\mu g/cm^2$) | Change in minimum magenta density (ΔDmin) between before and after thermal test | Remarks |
|---|---|---|---|
| Ammonium thiosulfate | 0.4 | +0.03 | Comparative |
| Compound A-1 | 0.4 | +0 | Present Invention |
| Compound A-2 | 0.4 | +0 | Present Invention |
| Compound A-6 | 0.3 | +0 | Present Invention |
| Comparative Compound A | 1.4 | +0.04 | Comparative |
| Comparative Compound B | 1.5 | +0.05 | Comparative |
| Comparative Compound C | 1.3 | +0.04 | Comparative |
| Comparative Compound D | 1.3 | +0.04 | Comparative |

EXAMPLE 6

Specimens were prepared in the same manner as in Example 5 except that Compound A-1 was replaced by Compounds A-3, A-5, A-7, A-9, and A-13, respectively, and then subjected to the same tests as in Example 5.

As a result, it was found that the use of the fixing agents of the present invention can provide excellent properties as in Example 5.

EXAMPLE 7

The same light-sensitive material as prepared in Example 5 was imagewise exposed to light, and then subjected to continuous processing (running test) in the following steps by means of a paper processing machine until the replenishment reached twice the tank capacity of the blix bath.

| Processing Step | Temperature | Time | Replenishment rate* | Tank capacity |
|---|---|---|---|---|
| Color development | 39° C. | 45 sec. | 70 ml | 20 l |
| Blix | 35° C. | 45 sec. | 60 ml** | 20 l |
| Rinse 1 | 35° C. | 20 sec. | — | 10 l |
| Rinse 2 | 35° C. | 20 sec. | — | 10 l |
| Rinse 3 | 35° C. | 20 sec. | 360 ml | 10 l |
| Drying | 80° C. | 60 sec. | | |

*Determined per m2 of light-sensitive material The rinse was effected in a 3-stage counter-current process wherein water flows backward.

*In addition to 60 ml replenishment, the solution from Rinse 1 was introduced into the blix bath at a flow rate of 120 ml per $m^2$ of light-sensitive material.

| | Running Solution | Replenisher |
|---|---|---|
| Color developer | | |
| Water | 700 ml | 700 ml |
| Diethylenetriaminepentaacetic acid | 0.4 g | 0.4 g |
| N,N,N-tetrakis(methylene-phosphonic acid) | 4.0 g | 4.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Fluorescent brightening agent (WHITEX-4, available from Sumitomo Chemical Co., Ltd.) | 1.0 g | 3.0 g |
| Sodium sulfite | 0.1 g | 0.1 g |
| N,N-bis(sulfoethyl) hydroxylamine | 10.0 g | 13.0 g |
| N-ethyl-N-(β-methane-sulfonamideethyl)-3-methyl-4-aminoaniline sulfate | 5.0 g | 11.5 g |
| Water to make | 1,000 ml | 1,000 ml |
| pH (25%) | 10.10 | 11.10 |
| Blix solution | | |
| Water | 600 ml | 150 ml |
| 700 g/l Ammonium thiosulfate | 100 ml | 250 ml |
| or compound of the present invention | 0.47 mol | 1.2 mol |
| Ammonium sulfite | 40 g | 100 g |
| Ferric ammonium ethylene-diaminetetraacetate | 55 g | 135 g |
| Ethylenediaminetetraacetic acid | 5 g | 12.5 g |
| Ammonium bromide | 40 g | 75 g |
| 67% Nitric acid | 30 g | 65 g |
| Water to make | 1,000 ml | 1,000 ml |
| pH at 25° C. adjusted with acetic acid and aqueous ammonia | 5.8 | 5.6 |

Rinse Solution (The running solution was used also as replenishmer)

Ion-exchanged water (Ca and Mg concentration: 3 ppm or less each)

The specimen which had been subjected to running processing was then stored at a temperature of 60° C. and a relative humidity of 70% for 10 days. The change in the minimum magenta density (ΔDmin) between before and after the heat and humidity test was determined. The specimen was further measured for the amount of silver left on the unexposed portion by means of a fluorescent X-ray analyzer.

Comparative specimens were prepared in the same manner as in Example 1 except that the compound of the present invention was replaced by Comparative Compounds (A), (B), (C) and (D) in the equimolecular amount, respectively. These comparative specimens were then subjected to the same tests as described above.

The results are set forth in Table 4.

Table 4 shows that the use of the compound of the present invention as fixing agent can provide excellent results, i.e., excellent desilvering properties upon rapid processing and little stain after heat and humidity test.

EXAMPLE 8

Specimens were prepared in the same manner as in Example 7 except that Compound A-1 was replaced by Compounds A-3, A-5, A-7, A-9, A-12, A-14, A-18, A-22, A-29, A-30, A-43, and A-52, respectively, and then subjected to the same tests as in Example 7.

As a result, it was found that the use of the fixing agents of the present invention can provide excellent properties as in Example 7.

TABLE 4

| Fixing agent | Residual amount of silver ($\mu g/cm^2$) | Change in minimum magenta density (ΔDmin) between before and after thermal test | Remarks |
|---|---|---|---|
| Ammonium thiosulfate | 0.4 | +0.04 | Comparative |
| Compound A-1 | 0.5 | ±0 | Present Invention |
| Compound A-2 | 0.4 | ±0 | Present Invention |
| Compound A-6 | 0.3 | ±0 | Present Invention |
| Comparative Compound A | 1.5 | +0.05 | Comparative |
| Comparative Compound B | 1.7 | +0.06 | Comparative |
| Comparative Compound C | 1.4 | +0.05 | Comparative |
| Comparative Compound D | 1.5 | +0.05 | Comparative |

EXAMPLE 9

Preparation of Emulsion 30 g of gelatin and 6 g of potassium bromide were added to 1 l of water. The solution was kept at a temperature of 60° C. An aqueous solution of 5 g of silver nitrate and an aqueous solution of potassium bromide containing 0.15 g of potassium iodide were added to the solution with stirring by a double jet process in 1 minute. Further, an aqueous solution of 145 g of silver nitrate and an aqueous solution of potassium bromide containing 4.2 g of potassium iodide were added to the system by a double jet process. The flow rate was accelerated such that the flow rate at the end of the addition became 5 times that at the beginning of the addition. After the completion of the addition, soluble salts were removed at a temperature of 35° C. by a sedimentation process. The emulsion was then heated to a temperature of 40° C. 75 g of gelatin was then added to the emulsion so that the pH value thereof was adjusted to 6.7. The emulsion thus obtained comprised tabular grains with a diameter of 0.98 μm as calculated in terms of projected area, an average thickness of 0.138 μm and a silver iodide content of 3 mol %. The emulsion was then subjected to chemical sensitization, i.e., gold sensitization and sulfur sensitization in combination.

Preparation of Photographic Material

As surface protective layer component there was used an aqueous solution of gelatin containing a polyacrylamide having an average molecular weight of 8,000, sodium polystyrenesulfonate, finely divided polymethylmethacrylate grains (average grain size: 3.0 μm), polyethylene oxide, and film hardener.

To the emulsion were added sodium salt of anhydro-5,5'-dichloro-9-ethyl-3,3'-di(3-sulfopropyl) oxacarbocyaninehydroxide and potassium iodide in amounts of 500 mg/mol silver and 200 mg/mol silver, respectively, as sensitizing dyes. To the system were further added 4-hydroxy-6-methyl-1,3,3a,7-tetrazaindene, 2,6-bis(hydroxyamino)-4-diethylamino-1,3,5-triazine and nitron as stabilizers, trimethylpropane as dry fog inhibitor, a coating aid, and a film hardening aid. The coating solution thus prepared was coated on both surfaces of a polyethylene terephthalate support simultaneously with the surface protective layer coating solution, and then dried to prepare a photographic material. The coated amount of silver on one surface of the photographic material was g/m$^2$. The photographic material exhibited a percent swelling of 180% as defined above.

The photographic material was exposed to X-ray by 50% , and then processed with the following developer, fixing solution and rinse solution.

| | Processing step | | | |
|---|---|---|---|---|
| Step | Time | Temperature | Replenishment rate | Tank capacity |
| Development | 13.7 sec. | 35° C. | 20 ml (+10 ml diluent) | 15 l |
| Fixing | 12.5 sec. | 32° C. | 10 ml (+30 ml diluent) | 15 l |
| Rinse | 6.2 sec. | 20° C. | 500 ml | 10 l |
| Squeeze roller washing tank | | | | 200 ml |

*Replenishment rate: per quater size (10 inch × 12 inch) sheet of light-sensitive material

| | Running Solution | Replenisher |
|---|---|---|
| Color developer | | |
| Potassium hydroxide | 24 g | 60 g |
| Sodium sulfite | 40 g | 100 g |
| Potassium sulfite | 50 g | 125 g |
| Diethylenetriaminepentaacetic acid | 2.4 g | 6 g |
| Boric acid | 10 g | 25 g |
| Hydroquinone | 35 g | 87.5 g |
| Diethylene glycol | 11.2 g | 28 g |
| 4-Hydroxymethyl-4-methyl-1-phenyl-3-pyrazolidone | 2.5 g | 6.25 g |
| 5-Methylbenzotriazole | 0.06 g | 0.15 g |
| pH | 10.05 | 11.00 |
| Fixing solution | | |
| Ammonium thiosulfate | 140 g | 560 g |
| or compound of the present invention | 1 mol | 4 mol |
| Sodium sulfite | 15 g | 60 g |
| Disodium ethylenediaminetetraacetate dihydrate | 0.025 g | 0.1 g |
| Sodium hydroxide | 6 g | 24 g |
| pH | 5.5 | 5.10 |
| Rinse solution | | |
| Disodium ethylenediaminetetraacetate dihydrate | 0.5 g | 0.5 g |

The specimen was then subjected to running processing at a rate of 50 quarter size sheets a day (percentage development per one sheet of film: 40%) until the accummulated replenishment of the fixing solution reached 3 times the tank capacity of the running solution.

The circulated amount of the developer was set to 20 l/min. while the light-sensitive material was developed and 6 l/min. while the light-sensitive material was ready for development.

The specimen which had been subjected to running processing was then subjected to fixing for 10.5 seconds and 11.5 seconds.

The specimens thus processed were then measured for amount of silver left on the unexposed portion by means of a fluorescent X-ray analyzer.

Another batch of the specimen which had been subjected to running processing was stored at a temperature of 60° C. and a relative humidity of 70% for 10 days. The change in the minimum density (ΔDmin) between before and after storage was determined.

Comparative specimens were prepared in the same manner as in Specimen 101 except that the compound of the present invention was replaced by Comparative Compounds (A), (B), (C) and (D) in the equimolecular amount, respectively. These comparative specimens were then subjected to the same tests as described above.

Further, the light-sensitive material B was subjected to the same tests as described above.

The results are set forth in Table 5.

Table 5 shows that the use of the compound of the present invention as fixing agent can provide excellent results, i.e., excellent desilvering properties upon rapid processing and little stain after heat and humidity test.

TABLE 5

| Fixing agent | Residual amount of silver (μg/cm$^2$) 10.5-sec. fixing | 11.5-sec. fixing | Change in minimum magenta density (ΔDmin) between before and after thermal test | Remarks |
|---|---|---|---|---|
| Ammonium thiosulfate | 10.3 | 3.2 | +0.24 | Comparative |
| Compound A-1 | 1.0 | 0.7 | +0.07 | Present Invention |
| Compound A-2 | 1.1 | 0.7 | +0.0 | Present Invention |
| Compound A-6 | 1.1 | 0.7 | +0.08 | Present Invention |
| Comparative Compound A | 5.0 | 0.8 | +0.29 | Comparative |
| Comparative | 3.9 | 0.9 | +0.25 | Comparative |

TABLE 5-continued

| Fixing agent | Residual amount of silver ($\mu g/cm^2$) 10.5-sec. fixing | 11.5-sec. fixing | Change in minimum magenta density ($\Delta$Dmin) between before and after thermal test | Remarks |
|---|---|---|---|---|
| Compound B Comparative | 3.8 | 0.8 | +0.22 | Comparative |
| Compound C Comparative | 3.9 | 0.8 | +0.24 | Comparative |
| Compound D | | | | |

EXAMPLE 10

Specimens were prepared in the same manner as in Example 9 except that Compound A-1 was replaced by Compounds A-3, A-5, A-7, A-9, and A-14, respectively, and then subjected to the same tests as in Example 9.

As a result, it was found that the use of the fixing agents of the present invention can provide excellent properties as in Example 9, i.e., little thermostain after heat and humidity test and excellent desilvering properties (fixing properties) upon rapid processing.

EXAMPLE 11

(1) Preparation of Tabular Grains

Preparation of Emulsion 5 g of potassium bromide, 0.05 g of potassium iodide, 30 g of gelatin and 2.5 cc of a 5% aqueous solution of thioether $HO(CH_2)_2S(CH_2)_2S(CH_2)_2OH$ were added to 1 l of water. The solution was kept at a temperature of 73° C. An aqueous solution of 8.33 g of silver nitrate and an aqueous solution of 5.94 g of potassium bromide and 0.726 g of potassium iodide were added to the solution with stirring by a double jet process in 45 seconds. 2.5 g of potassium bromide was then added to the system. An aqueous solution of 8.33 g of silver nitrate was then added to the system in 26 minutes in such a manner that the flow rate at the end of the addition became twice that at the beginning of the addition.

Thereafter, the emulsion was subjected to physical ripening with 20 cc of a 25% ammonia solution and 10 cc of a 50% $NH_4NO_3$ solution for 20 minutes. The emulsion was then neutralized with 240 cc of 1N sulfuric acid. Subsequently, an aqueous solution of 153.34 g of silver nitrate and an aqueous solution of potassium bromide were added to the emulsion by a controlled double jet process in 40 minutes while the potential thereof was kept at a pAg value of 8.2. The flow rate was accelerated such that the flow rate at the end of the addition became 9 times that at the beginning of the addition. After the completion of the addition, 15 cc of a 2N solution of potassium thiocyanate was added to the emulsion. Further, 25 cc of a 1% aqueous solution of potassium iodide was added to the emulsion in 30 seconds. The emulsion was then cooled to a temperature of 35° C. so that soluble salts were removed by sedimentation. The emulsion was then heated to a temperature of 40° C. 30 g of gelatin and 2 g of phenol were then added to the emulsion. The emulsion was then adjusted with caustic soda and potassium bromide to a pH value of 6.40 and a pAg value of 8.10.

The emulsion was then heated to a temperature of 56° C. 600 mg of a sensitizing dye having the following structure and 150 mg of a stabilizer having the following structure were added to the emulsion. After 10 minutes, 2.4 mg of hydrate of sodium thiosulfate, 140 mg of potassium thiocyanate and 2.1 mg of chloroauric acid were added 'to the emulsion. After 80 minutes, the emulsion was quenched and solidified to prepare the desired emulsion. The emulsion thus obtained comprised grains wherein 98% of all grains have as aspect ratio of 3 or more as calculated in terms of projected area. All grains having an aspect ratio of 2 or more had an average diameter of 1.4 $\mu$m as calculated in terms of projected area, a standard deviation in diameter distribution of 22%, an average thickness of 0.187 $\mu$m and an aspect ratio of 7.5.

Sensitizing Dye

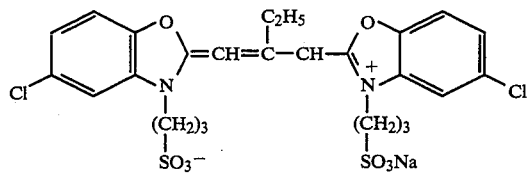

Preparation of Emulsion Coating Solution

To the emulsion was added the following chemicals (per mol of silver halide):

| | |
|---|---|
| Gelatin | Added amount adjusted such that Ag/(gelatin + polymer) weight ratio was 1.10 |
| Water-soluble polyester | 20 wt. % based on gelatin |
| Polymer latex (poly(ethylacrylate/methacrylic acid = 97/3) | 25.0 g |
| Film hardener | |
| 1,2-Bis(vinylsulfonylacetamide)ethane | 8 m mol/100 g of gelatin in emulsion layer on surface protective layer |
| Phenoxyethanol | 2 g |
| 2,6-Bis(hydroxyamino)-4-diethylamino-1,3,5-triazine | 80 mg |
| Sodium polyacrylate (average molecular weight: 41,000) | 4.0 g |
| Potassium polystyrenesulfonate (average molecular weight: 600,000) | 1.0 g |

Preparation of Light-Sensitive Material A

The coating solution thus obtained was then coated simultaneously with a surface protective layer coating solution on a 175-$\mu$m thick transparent PET support.

The sum of the coated amount of silver on both surfaces was 3.2 g/m$^2$.

The surface protective layer coating solution was prepared in such a manner that the coated amount of each component was as set forth below.

| Component of surface protective layer | Coated amount |
|---|---|
| Gelatin | 1.15 g/m$^2$ |
| Polyacrylamide (average molecular weight: 45,000) | 0.25 g/m$^2$ |
| Sodium polyacrylate (average molecular weight: 400,000) | 0.02 g/m$^2$ |
| Sodium salt of p-t-octylphenoxydiglycerylbutylsulfonate | 0.02 g/m$^2$ |
| Polyoxyethylene ethyl ether (polymerization degree: 10) | 0.035 g/m$^2$ |
| Polyoxyethylene(polymerization degree: 10)-polyoxyglyceryl (polymerization degree: 3)-p-octylphenoxyether | 0.01 g/m$^2$ |
| 2-Chlorohydroquinone | 0.046 g/m$^2$ |
| $C_8F_{17}SO_3K$ | 0.003 g/m$^2$ |
| $C_8F_{17}SO_3N(C_3H_7)(CH_2-CH_2O)_4(CH_2)_4SO_3Na$ | 0.001 g/m$^2$ |
| $C_8F_{17}SO_2N(C_3H_7)(CH_2CH_2O)_{15}H$ | 0.003 g/m$^2$ |
| Proxel | 0.001 g/m$^2$ |
| Polymethyl methacrylate (average grain diameter: 3.5 μm) | 0.025 g/m$^2$ |
| Poly(methylmethacrylate/methacrylate) (molar ratio: 7:3; average grain diameter: 2.5 μm) | 0.020 g/m$^2$ |

(2) Preparation of Potato-Shaped Grains

Preparation of Emulsion 20 g of gelatin, 30 g of potassium bromide, and 3.91 g of potassium iodide were added to 900 cc of water. The solution was kept at a temperature of 48° C. 35 g of silver nitrate was added to the solution with stirring in the form of aqueous solution in 4 minutes.

Ammonia silver nitrate (165 g of silver nitrate) was added to the system simultaneously with an aqueous solution of potassium bromide by a double jet process in 5 minutes. After the completion of the addition, soluble salts were removed from the system at a temperature of 35° C. by sedimentation. The system was then heated to a temperature of 40° C. 100 g of gelatin was further added to the system so that the pH value thereof was adjusted to 6.7. The resulting emulsion comprised potato-shaped grains. The average grain diameter of grains having the same volume was 0.82 μm. The silver iodide content of the grains was 2 mol %. The emulsion was then subjected to chemical sensitization, i.e., gold sensitization and sulfur sensitization in combination.

Preparation of Light-Sensitive Material B

As surface protective layer component there was used an aqueous solution of gelatin containing a polyacrylamide having an average molecular weight of 8,000, sodium polystyrenesulfonate, finely divided polymethylmethacrylate grains (average grain size: 3.0 μm), polyethylene oxide, and film hardener.

To the emulsion were added sodium salt of anhydro-5,5'-dichloro-9-ethyl-3,3'-di(3-sulfopropyl) oxacarbocyaninehydroxide and potassium iodide in amounts of 500 mg/mol silver and 200 mg/mol silver, respectively, as sensitizing dyes.

To the system were further added 4-hydroxy-6-methyl-1,3,3a, 7-tetrazaindene, 2,6-bis (hydroxyamino) -4-diethylamino-1,3,5-triazine and nitron as stabilizers, trimethylpropane as dry fog inhibitor, a coating aid, and a film harder. The coating solution thus prepared was coated on both surfaces of a polyethylene terephthalate support simultaneously with the surface protective layer coating solution, and then dried to prepare Light—Sensitive Material B. The sum of the coated amount of silver on both surfaces of the support was 6.4 g/m$^2$.

| Development Preparation of concentrated solution | |
|---|---|
| <Developer> | |
| Part A | |
| Potassium hydroxide | 330 g |
| Potassium sulfite | 630 g |
| Sodium sulfite | 240 g |
| Potassium carbonate | 90 g |
| Boric acid | 45 g |
| Diethylene glycol | 180 g |
| Diethylenetriaminepentaacetic acid | 30 g |
| 1-(Diethylaminoethyl)-5-mercaptotetrazole | 0.75 g |
| Hydroquinone | 450 g |
| Water to make | 4,125 ml |
| Part B | |
| Diethylene glycol | 525 g |
| Glacial acetic acid | 102.6 g |
| 5-Nitroindazole | 3.75 g |
| 1-Phenyl-3-pyrazolidone | 34.5 g |
| Water to make | 750 ml |
| Part C | |
| Glutaraldehyde (50 wt/wt %) | 150 ml |
| Potassium methabisulfite | 150 ml |
| Potassium bromide | 15 g |
| Water to make | 750 ml |
| <Fixing Solution> | |
| Ammonium thiosulfate (70 wtvol. %) | 200 ml |
| or compound of the present invention | 0.95 mol |
| Disodium ethylenediaminetetraacetate dihydrate | 0.03 g |
| Sodium thiosulfate pentahydrate | 10 g |
| Sodium sulfite | 20 g |
| Boric acid | 4 g |
| 1-(N,N-dimethylamino)-ethyl-5-mercaptotetrazole | 1 g |
| Tartaric acid | 3.2 g |
| Glacial acetic acid | 45 g |
| Sodium hydroxide | 15 g |
| 36 N Sulfuric acid | 3.9 g |
| Aluminum sulfate | 10 g |
| Water to make | 400 ml |
| pH | 4.68 |

Preparation of Processing Solution

These parts of the concentrated developer thus obtained were each charged into the respective polyethylene vessels which were connected to one point.

The concentrated fixing solution was similarly charged into a polyethylene vessel.

The concentrated developer was then stored in the vessel at a temperature of 50° C. for 3 months for later preparation as developer.

The developer and fixing solution were then charged into the development tank and fixing tank of an automatic developing machine in the following proportions by means of a constant delivery pump.

| | |
|---|---|
| Developer I | |
| Agent A | 55 ml |
| Agent B | 10 ml |
| Agent C | 10 ml |
| Water | 125 ml |
| pH | 10.50 |
| Fixing Solution | |
| Concentration solution | 80 ml |
| Water | 120 ml |
| pH | 4.64 |

The rinse tank was filled with tap water. Four non-wovon bags containing 50 g of a silver-releasing agent which comprises a soluble glass consisting of $Na_2O$ (10 wt %), $B_2O_5$ (65 wt %) and $SiO_2$ (25 wt %) containing 1.7 wt % of $Ag_2O$ were sent to the bottom of the rinse tank.

Structure of Automatic Developing Machine

There was used an automatic developing machine having the following structure:

The flow rate of the rinse solution was 5 l/min. for Processing 2 and 10 l/min. for Processing 1. A solenoid valve was opened in synchronous with the processing of the light-sensitive material so that the rinse solution was supplied (about 1 l/quater size sheet). At the end of a day's operation, a solenoid valve was automatically opened to remove the rinse solution from the tank. The crossover rollers between development and fixing and between fixing and rinse were provided with an apparatus which automatically sprays wash water thereto for cleaning (method as described in Japanese Patent Application No. 61-131338).

2,000 quater size sheets of the specimen were processed at the same position (running test). The specimen which had been subjected to running test was then stored at a temperature of 60° C. and a relative humidity of 70% for 10 days. The change in the minimum density (ΔDmin) between before and after storage was determined. The specimen was further processed with the fixing time slightly reduced. The specimen was measured for the amount of silver left on the unexposed portion.

| Step | Tank capacity | Processing temp. | Length of path processed | Processing 1 time | Processing 2 time |
|---|---|---|---|---|---|
| Development | 15 l | 35° C. (for Processing 1) 32° C. (for Processing 2) | 613 mm | 13.3 sec. | 24.5 sec. |
| (Ratio of liquid surface to tank capacity = 35 $cm^2/l$) | | | | | |
| Fixing | 15 l | 32° C. | 541 mm | 11.7 sec. | 21.6 sec. |
| Fixing | 13 l | 17° C. running water | 305 mm | 5.7 sec. | 10.5 sec. |
| Squeeze | | | | 6.6 sec. | 12.2 sec. |
| Drying | | 58° C. | 368 mm | 8.0 sec. | 14.7 sec. |
| Total | | | 1,827 mm | 45.3 sec. | 83.6 sec. |

Processing

Specimens 102 to 113

Light-Sensitive Material A was exposed to X-ray by 50%, and then subjected to development with the above mentioned processing solutions for the processing time or processing 2 time by means of the above mentioned automatic developing machine with the replenishment rate of developer and fixing solution controlled to 45 ml and 30 ml per quater size sheet (10×12 inch), respectively.

Comparative specimens were prepared in the same manner as in Example 1 except that the compound of the present invention was replaced by Comparative Compounds (A), (B), (C) and (D) in the equimolecular amount, respectively, and then subjected to the same tests as described above.

Further, Light-Sensitive Material B was subjected to the same tests as described above.

The results are set forth in Table 6.

Table 6 shows that the use of the compound of the present invention as fixing agent can provide excellent results, i.e., excellent desilvering properties upon rapid processing and little stain after heat and humidity test.

TABLE 6

(Light-Sensitive Material A; Processing 1)

| Fixing agent | Residual amount of silver ($\mu g/cm^2$) | | Change in minimum magenta density (ΔDmin) between before and after thermal test | Remarks |
|---|---|---|---|---|
| | 10.9-sec. fixing | 11.7-sec. fixing | | |
| Ammonium thiosulfate | 6.0 | 0.9 | +0.25 | Comparative |
| Compound A-1 | 0.9 | 0.7 | +0.07 | Present Invention |
| Compound A-2 | 1.0 | 0.7 | +0.08 | Present Invention |
| Compound A-6 | 1.0 | 0.7 | +0.08 | Present Invention |
| Comparative Compound A | 3.6 | 0.8 | +0.30 | Comparative |

TABLE 6-continued

| Fixing agent | (Light-Sensitive Material A; Processing 1) Residual amount of silver ($\mu g/cm^2$) | | Change in minimum magenta density ($\Delta Dmin$) between before and after thermal test | Remarks |
|---|---|---|---|---|
| Comparative Compound B | 3.7 | 0.9 | +0.26 | Comparative |
| Comparative Compound C | 3.4 | 0.8 | +0.22 | Comparative |
| Comparative Compound D | 3.4 | 0.9 | +0.24 | Comparative |
| | 20.8-sec. fixing | 21.6-sec. fixing | | |
| Ammonium thiosulfate | 5.5 | 0.8 | +0.20 | Comparative |
| Compound A-1 | 0.8 | 0.6 | +0.06 | Present Invention |
| Compound A-2 | 0.9 | 0.6 | +0.07 | Present Invention |
| Compound A-6 | 0.8 | 0.6 | +0.07 | Present Invention |
| Comparative Compound A | 3.1 | 0.7 | +0.25 | Comparative |
| Comparative Compound B | 3.0 | 0.8 | +0.21 | Comparative |
| Comparative Compound C | 2.9 | 0.7 | +0.19 | Comparative |
| | 10.9-sec. fixing | 11.7-sec. fixing | | |
| Ammonium thiosuflate | 5.8 | 0.8 | +0.24 | Comparative |
| Compound A-1 | 0.7 | 0.6 | +0.07 | Present Invention |
| Compound A-2 | 0.8 | 0.6 | +0.07 | Present Invention |
| Compound A-6 | 0.8 | 0.6 | +0.08 | Present Invention |
| Comparative Compound A | 3.2 | 0.7 | +0.30 | Comparative |
| Comparative Compound B | 3.3 | 0.7 | +0.26 | Comparative |
| Comparative Compound C | 3.0 | 0.7 | +0.22 | Comparative |
| | 20.8-sec. fixing | 21.6-sec. fixing | | |
| Ammonium thiosulfate | 5.5 | 0.7 | +0.21 | Comparative |
| Compound A-1 | 0.7 | 0.6 | +0.06 | Present Invention |
| Compound A-2 | 0.7 | 0.6 | +0.06 | Present Invention |
| Compound A-6 | 0.9 | 0.5 | +0.07 | Present Invention |
| Comparative Compound A | 3.1 | 0.6 | +0.25 | Comparative |
| Comparative Compound B | 3.1 | 0.7 | +0.23 | Comparative |
| Comparative Compound C | 2.9 | 0.6 | +0.20 | Comparative |

EXAMPLE 12

Specimens were prepared in the same manner as in Example 11 except that Compound A-1 was replaced by Compounds A-3, A-4, A-5, A-7, A-8, A-9, A-13, A-17, A-20, A-24, A-31, and A-52, respectively, and then subjected to the same tests as in Example 11.

As a result, it was found that the use of the fixing agents of the present invention can provide excellent properties as in Example 11, i.e., little thermostain after heat and humidity test and excellent desilvering properties upon rapid processing.

EXAMPLE 13

Preparation of Light-Sensitive Emulsion Layer

An aqueous solution of silver nitrate and an aqueous solution containing potassium iodide and potassium bromide were simultaneously added to an aqueous solution of gelatin which had been kept at a temperature of 50° C. in the presence of iridium (III) hexacholoride in an amount of $4\times10^{-7}$ per mol of silver and ammonia while the pAg value of the system was kept at 7.8. As a result, a monodisperse emulsion of cubic grains with an average grain size of 0.28$\mu$ and an average silver iodide content of 0.3 mol % was obtained. The emulsion was then subjected to desalting by a flocculation method. Inactive gelatin was then added to the emulsion in an amount of 40 g per mol of silver. 5,5'-Dichloro-9-ethyl-3,3'-bis(3-sulfapropyl)oxacarbocyanine as sensitizing dye and a potassium iodide solution ($10^{-3}$ mol per mol silver) were added to the emulsion. The emulsion was then aged for 15 minutes, and cooled.

Coating of Light-Sensitive Emulsion Layer

The emulsion was re-dissolved. To the emulsion was added the following hydrazine derivative at a temperature of 40° C:

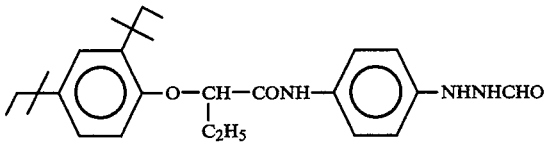

$7.1 \times 10^{-5}$ mol/Ag mol

To the emulsion were further added 5-methylbenztriazole, 4-hydroxy-1,3,3a,7-tetrazaindene, a compound of the general formula (i) set forth below, a compound of the general formula (ii) set forth below, polyethylene acrylate in an amount of 30 wt % based on gelatin, and a compound of the general formula (iii) set forth below as gelatin hardener. The coating solution thus obtained was then coated on a 150-μ thick polyethylene terephthalate film having a subbing layer (0.5μ) made of a vinylidene chloride copolymer in an amount such that the coated amount of silver reached 3.4 g/m².

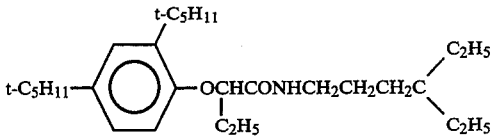

(i) 3.5 mg/m²

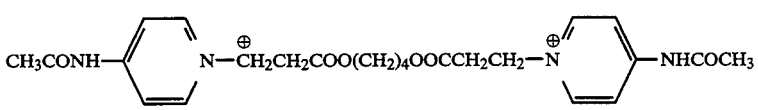

(ii) 15.0 mg/m²

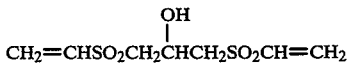

(iii) 2.0 wt % based on gelatin

Coating of Protective Layer

As protective layer components there were coated gelatin in an amount of 1.5 g/m², polymethyl methacrylate grains (average grain diameter: 2.5μ) in an amount of 0.3 g/m², and finely divided AgCl grains prepared as set forth below in an amount of 0.3 g/m² as calculated in terms of silver with the aid of the following surface active agents:

Surface active agent

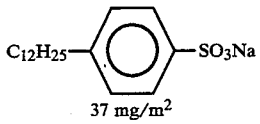

37 mg/m²

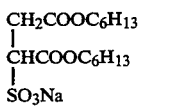

-continued

Surface active agent 37 mg/m²

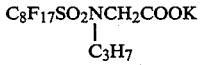

2.5 mg/m²

These specimens were then cut into large full size sheets (50.8 cm/61.0 cm). These specimens were subjected to 50% blackening exposure to tungsten light at 3,200° K. 200 sheets of these specimens were then processed in the following processing steps:

| Step | Processing time | Processing temperature | Replenishment rate |
|---|---|---|---|
| | Processing step | | |
| Development | 30 sec. | 34° C. | 240 ml |
| Fixing | 30 sec. | 34° C. | 390 ml |
| Rinse | 30 sec. | 20° C. | 2 l |

The replenishment rate was determined per m2 of light-sensitive material.

| Developer (running solution = replenisher) | |
|---|---|
| Hydroquinone | 50.0 g |
| N-methyl-p-aminophenol | 0.3 g |
| Sodium hydroxide | 18.0 g |
| Boric acid | 20.0 g |
| Potassium sulfite | 110.0 g |
| Disodium ethylenediamine-tetraacetate | 1.0 g |
| Potassium bromide | 10.0 g |
| 5-Methylbenzotriazole | 0.4 g |
| 5-Mercaptobenzimidazole-5-sulfonic acid | 0.3 g |
| Sodium 3-(5-mercaptotetrazole) benzenesulfonate | 0.2 g |
| 6-Dimethylamino-1-hexanol | 4.0 g |
| Sodium p-toluenesulfonate | 15.0 g |
| 5-Sulfosalicylic acid | 30.0 g |
| Water to make | 1 l |
| Potassium hydroxide to make pH | 11.7 |
| Fixing solution (running solution = replenisher) | |
| Ammonium thiosulfate | 190.0 g |
| or compound of the present invention | 1 mol |
| Sodium sulfite | 22.0 g |
| Disodium ethylenediamine-tetraacetate | 0.1 g |
| Tartaric acid | 3.0 g |
| 27% Aqueous ammonia | 10.0 g |
| 90% Acetic acid | 30.0 g |
| 27% Aluminum sulfate | 35.0 g |
| Water to make | 1 l |

-continued

| | |
|---|---|
| Sodium hydroxide to make pH | 4.8 |

The specimen which had been just subjected to the sequential running test was then stored at a temperature of 60° C. and a relative humidity of 70% for days. The change in the minimum density (ΔDmin) between before and after storage Was determined.

The specimen was further processed with the fixing time altered to 25 seconds and 30 seconds. The specimen was measured for the amount of silver left on the unexposed portion.

Comparative specimens were prepared in the same manner as in Example 1 except that the compound of the present invention was replaced by Comparative Compounds (A), (B), (C) and (D) in the equimolecular amount, respectively, and then subjected to the same tests as described above.

The results are set forth in Table 7.

Table 7 shows that the use of the compound of the present invention as fixing agent can provide excellent results, i.e., excellent desilvering properties upon rapid processing and little stain after heat and humidity test.

TABLE 7

| Fixing agent | Residual amount of silver (μg/cm²) 25 sec. fixing | 30 sec. fixing | Change in minimum magenta density (ΔDmin) between before and after thermal test | Remarks |
|---|---|---|---|---|
| Ammonium thiosulfate | 5.0 | 0.6 | +0.20 | Comparative |
| Compound A-1 | 0.6 | 0.5 | +0.06 | Present Invention |
| Compound A-2 | 0.6 | 0.5 | +0.07 | Present Invention |
| Compound A-6 | 0.6 | 0.6 | +0.07 | Present Invention |
| Comparative Compound A | 2.0 | 0.6 | +0.26 | Comparative |
| Comparative Compound B | 2.2 | 0.5 | +0.24 | Comparative |
| Comparative Compound C | 1.8 | 0.6 | +0.20 | Comparative |
| Comparative Compound D | 1.9 | 0.6 | +0.23 | Comparative |

EXAMPLE 14

Specimens were prepared in the same manner as in Example 13 except that Compound A-1 was replaced by Compounds A-3, A-4, A-5, A-7, A-9, A-14, A-18, A-22, A-24, A-30, A-31, A-39, A-43, and A-52, respectively, and then subjected to the same Zests as in Example 13.

As a result, it was found that the use of the fixing agents of the present invention can provide excellent properties as in Example 13, i.e., little thermostain after heat and humidity test and excellent desilvering properties upon rapid processing.

EXAMPLE 15

Silver halide grains were precipitated by a double jet process. The emulsion was then subjected to physical ripening and desilvering processes. The emulsion was further subjected to chemical ripening to obtain a silver chloroiodobromide emulsion (bromine content: 30 mol %; iodine content: 0.1 mol %). The emulsion comprised silver halide grains with an average diameter of 0.3 μm. The emulsion contained silver halide in an amount of 0.6 mol per kg.

1 kg of the emulsion was weighed out. The emulsion was then heated to a temperature of 40° C. so that it was dissolved. A methanol solution of a sensitizing dye was added to the emulsion. Further, an aqueous solution of sodium bromide was added to the emulsion in a predetermined amount. 25 ml of a 1.0 wt % methanol solution of disodium 4,4'-bis[4,6-di(benzothiazolyl-2-thio)-pyrimidin-2-ylamino]stilbene-2,2'-disulfonate was added to the emulsion. Further, 30 ml of a 1.0 wt % aqueous solution of sodium 1-hydroxy-3,5-dichlorotriazine was added to the emulsion. Further, 40 ml of a 1.0 wt % aqueous solution of sodium dodecylbenzenesulfonate was added to the emulsion. The emulsion was then stirred. The finished emulsion was then coated on a cellulose triacetate film base to a dried thickness of 5 μm, and dried to obtain a light-sensitive material specimen. The film specimen was then exposed to light through an optical wedge by means of a sensitometer having a light source with a color temperature of 2,666° K. The light source was covered with a dark red filter (SC-66, available from Fuji Photo Film., Co., Ltd.). After exposure, the specimen was subjected to continuous processing until the replenishment rate reached 3 times the tank capacity of the developer tank.

| Step | Processing step: Time | Temperature | Replenishment rate* | Tank capacity |
|---|---|---|---|---|
| Development | 20 sec. | 38° C. | 320 ml | 18 l |
| Fixing | 20 sec. | 38° C. | 320 ml | 18 l |
| Rinse | 20 sec. | 20° C. | 2 l | 18 l |

*per m² of light-sensitive material

| | |
|---|---|
| (Developer) running solution = replenisher | |
| Methol | 0.31 g |
| Sodium sulfite anhydride | 39.6 g |
| Hydroquinone | 6.0 g |
| Sodium carbonate anhydride | 18.7 g |
| Potassium bromide | 0.86 g |
| Citric acid | 0.68 g |
| Potassium metabisulfite | 1.5 l |
| Water to make | 1 l |
| (Fixing solution) running solution = replenisher | |
| Ammonium thiosulfate | 200 ml |
| or compound of the present | 1 mol |

-continued

| | |
|---|---|
| invention | |
| Sodium hydrogensulfite | 12.0 g |
| Disodium ethylenediamine-tetraacetate | 0.1 g |
| Tartaric acid | 3.0 g |
| 27% Aqueous ammonia | 7.0 g |
| 90% Acetic acid | 20.0 g |
| 27% Aluminum sulfate | 35.0 g |
| Water to make | 1 l |
| Sodium hydroxide to make pH | 4.2 |

The specimen which had been just subjected to the sequential running test was then stored at a temperature of 60° C. and a relative humidity of 70% for days. The change in the minimum density (ΔDmin) between before and after storage was determined by using a P type densitometer manufactured by Fuji Photo Film Co., Ltd.

The specimen was further processed with the fixing time altered to 16 seconds and 20 seconds. The specimen was measured for the amount of silver left on the unexposed portion.

Comparative specimens were prepared in the same manner as in Example 1 except that the compound of the present invention was replaced by Comparative Compounds (A), (B), (C) and (D) in the equimolecular amount, respectively, and then subjected to the same tests as described above.

The results are set forth in Table 8.

Table 8 shows that the use of the compound of the present invention as fixing agent can provide excellent results, i.e., excellent desilvering properties upon rapid processing and little stain after heat and humidity test.

TABLE 8

| Fixing agent | Residual amount of silver (μg/cm²) 16 sec. fixing | 20 sec. fixing | Change in minimum magenta density (ΔDmin) between before and after thermal test | Remarks |
|---|---|---|---|---|
| Ammonium thiosulfate | 4.0 | 0.5 | +0.20 | Comparative |
| Compound A-1 | 0.6 | 0.5 | +0.07 | Present Invention |
| Compound A-2 | 0.7 | 0.6 | +0.08 | Present Invention |
| Compound A-6 | 0.7 | 0.5 | +0.08 | Present Invention |
| Comparative Compound A | 2.0 | 0.5 | +0.26 | Comparative |
| Comparative Compound B | 2.4 | 0.6 | +0.23 | Comparative |
| Comparative Compound C | 1.9 | 0.5 | +0.19 | Comparative |
| Comparative Compound D | 1.9 | 0.6 | +0.20 | Comparative |

EXAMPLE 16

Specimens were prepared in the same manner as in Example 15 except that Compound A-1 was replaced by Compounds A-3, A-4, A-5, A-7, A-8, A-9, A-14, A-20, A-22, A-30, A-39, A-43, A-45, and A-52, respectively, and then subjected to the same tests as in Example 15.

As a result, it was found that the use of the fixing agents of the present invention can provide excellent properties as in Example 15, i.e., little thermostain after heat and humidity test and excellent desilvering properties (fixing properties) upon rapid processing.

EXAMPLE 17

A light-sensitive material (color reversal film) prepared in the same manner as in Specimen 101 in Example 1 in JP-A-2-854 was subjected to the same tests in the same manner as in Example 1 in the above cited patent application except that sodium thiosulfate to be used as fixing solution was replaced by the compound of the present invention. The results were similar to that described above.

EXAMPLE 18

A light-sensitive material (direct positive color light-sensitive material) prepared in the same manner as in Specimen 1 in Example 1 in JP-A-2-90145 was subjected to the same tests in the same manner as in Example 1 in the above cited patent application except that ammonium thiosulfate to be used as blix solution was replaced by the compound of the present invention. The results were similar to that described above.

EXAMPLE 19

A light-sensitive material (color reversal paper) prepared in the same manner as in the color photographic light-sensitive material in Example 2 in JP-A-1-158431 was subjected to the same tests in the same manner as in Example 2 in the above cited patent application except that ammonium thiosulfate to be used as blix solution was replaced by the compound of the present invention. The results were similar to that described above.

Examples corresponding to the second embodiment of the present invention will be set forth hereinafter.

EXAMPLE 20

A multilayer color photographic paper was prepared in the same manner as in Example 5. The specimen was imagewise exposed to light, and then subjected to processing in the same manner as in Example 5 except that the compound (fixing agent) to be incorporated in the blix solution as set forth in Table 3 was replaced by the compound set forth in Table 9.

After the running processing, the blix bath and the rinse bath 1 were visually examined for the presence of precipitates.

The specimen was measured for magenta reflection density (Dmin) on the unexposed portion by means of an X-rite densitometer.

Another batch of the specimen was subjected to the same running processing as mentioned above except that ferric ammonium ethylenediaminetetraacetate to be incorporated in the blix solution was replaced by ferric ammonium 1,3-propylenediaminetetraacetate. The blix bath and the rinse bath 1 were then visually examined for the presence of precipitates. The specimen was measured for magenta reflection density (Dmin) on the unexposed portion by means of an X-rite densitometer. The results are set forth in Table 9. Table 9 shows that the use of the compound of the present invention as fixing agent in stead of thiosulfate can provide excellent results, i.e., no precipitation, excellent solution stability and low density (Dmin, bleach fog) on the unexposed portion. This tendency was remarkable particularly when a bleaching agent having a high redox potential was used as bleaching agent.

TABLE 9

| Fixing agent | Bleaching agent in blix bath | Magenta density (Dmin) on unexposed portion | Presence of precipitates in blix bath | Presence of precipitates in rinse bath 1 | |
|---|---|---|---|---|---|
| Ammonium thiosulfate | 1 | 0.15 | B | C | Comparative |
| | 2 | 0.18 | D | D | |
| Compound B-1 | 1 | 0.11 | A | A | Present invention |
| | 2 | 0.10 | A | A | |
| Compound B-15 | 1 | 0.11 | A | A | Present invention |
| | 2 | 0.11 | A | A | |
| Compound B-30 | 1 | 0.11 | A | A | Present invention |
| | 2 | 0.11 | A | A | |
| Compound B-40 | 1 | 0.12 | A | A | Present invention |
| | 2 | 0.11 | A | A | |
| Compound B-64 | 1 | 0.11 | A | A | Present invention |
| | 2 | 0.10 | A | A | |

<Evaluation of the presence of precipitates>
A: No precipitates visually observed
B: A small amount of precipitates visually observed
C: A large amount of precipitates visually observed
D: An extremely large amount of precipitates visually observed
Note)
Bleaching agent 1: Ferric ammonium ethylenediaminetetraacetate
Bleaching agent 2: Ferric ammonium 1,3-propylenediaminetetraacetate

EXAMPLE 21

Tests were effected in the same manner as in Example 20 except that Compound B-1 was replaced by Compounds B-5, B-23, B-41 and B-67, respectively.

As a result, excellent results were obtained, i.e., no precipitation and little bleach fog even upon running processing.

This tendency was particularly remarkable when a bleaching agent having a high redox potential was used as bleaching agent.

EXAMPLE 22

Tests were effected in the same manner as in Example 1 except that the concentration of the fixing agent (compound of the present invention) in the blix bath was altered to 0.02, 0.08, 0.2, and 0.5 mol/l, respectively. The specimen was then measured for the amount of silver left on the unexposed portion by X-ray fluorescence.

However, as bleaching agent there was used only ferric ammonium ethylenediaminetetraacetate.

The results are set forth in Table 10.

Table 10 shows that the use of the compound of the present invention in an amount of 0.2 mol/l or more can provide excellent results.

TABLE 10

| Fixing agent | Fixing agent concentration (mol/l) | Residual amount of silver on unexposed portion ($\mu g/cm^2$) | Magenta density on unexposed portion (Dmin) | Presence of precipitates in blix bath | Presence of precipitates in Rinse bath 1 |
|---|---|---|---|---|---|
| Ammonium thiosulfate | 0.02 | 65 | 1.85 | B | B (C) |
| | 0.08 | 58 | 1.70 | B | B (C) |
| | 0.20 | 1.8 | 0.30 | B | C (C) |
| | 0.50 | 0.3 | 0.15 | c | D (C) |
| Compound B-1 | 0.02 | 65 | 1.85 | A | A (C) |
| 0.08 | 59 | 1.75 | A | A (C) | |
| | 0.20 | 1.4 | 0.11 | A | A (P) |
| | 0.50 | 0.2 | 0.10 | A | A (P) |
| Compound B-15 | 0.02 | 65 | 1.84 | A | A (C) |
| | 0.08 | 61 | 1.77 | A | A (C) |
| | 0.20 | 1.2 | 0.11 | A | A (P) |
| | 0.50 | 0.3 | 0.11 | A | A (P) |
| Compound B-30 | 0.02 | 65 | 1.85 | A | A (C) |
| | 0.08 | 60 | 1.70 | A | A (C) |
| | 0.20 | 1.5 | 0.11 | A | A (P) |

TABLE 10-continued

| Fixing agent | Fixing agent concentration (mol/l) | Residual amount of silver on unexposed portion ($\mu g/cm^2$) | Magenta density on unexposed portion (Dmin) | Presence of precipitates in blix bath | Presence of precipitates in Rinse bath 1 |
|---|---|---|---|---|---|
| | 0.50 | 0.3 | 0.10 | A | A (P) |

<Evaluation of the presence of precipitates>
A: No precipitates visually observed
B: A small amount of precipitates visually observed
C: A large amount of precipitates visually observed
D: An extremely large amount of precipitates visually observed
Note)
P: Present invention
C: Comparative

EXAMPLE 23

Tests were effected in the same manner as in Example 22 except that Compound B-1 was replaced by Compounds B-5, B-23, B-41 and B-67, respectively.

As a result, it was found that the use of the compound of the present invention in an amount of 0.2 mol/l or more can provide excellent results as in Example 22.

EXAMPLE 24

The light-sensitive material as prepared in Example 22 was imagewise exposed to light, and then processed in the same manner as in Example 7 except that the fixing agent to be incorporated in the blix solution was replaced by the compounds set forth in Table 11.

After the running processing, the blix bath and the rinse bath 1 were visually examined for the presence of precipitates.

The specimen was measured for magenta reflection density (Dmin) on the unexposed portion by means of an X-rite densitometer.

Another batch of the specimen was subjected to the same running processing as mentioned above except that ferric ammonium ethylenediaminetetraacetate to be incorporated in the blix solution was replaced by ferric ammonium 1,3-propylenediaminetetraacetate. The blix bath and the rinse bath 1 were then visually examined for the presence of precipitates. The specimen was measured for magenta reflection density (Dmin) on the unexposed portion by means of an X-ray densitometer. The results are set forth in Table 11. Table 11 shows that the use of the compound of the present invention as fixing agent in stead of thiosulfate can provide excellent results, i.e., no precipitation, excellent solution stability and low density (Dmin, bleach fog) on the unexposed portion. This tendency was remarkable particularly when a bleaching agent having a high redox potential was used as bleaching agent.

TABLE 11

| Fixing agent | Bleaching agent in blix bath | Magenta density (Dmin) on unexposed portion | Presence of precipitates in blix bath | Presence of precipitates in rinse bath 1 | |
|---|---|---|---|---|---|
| Ammonium thiosulfate | 1 | 0.17 | B | C | Comparative |
| | 2 | 0.20 | D | D | |
| Compound B-1 | 1 | 0.12 | A | A | Present invention |
| | 2 | 0.11 | A | A | |
| Compound B-15 | 1 | 0.12 | A | A | Present invention |
| | 2 | 0.12 | A | A | |
| Compound B-30 | 1 | 0.12 | A | A | Present invention |
| | 2 | 0.12 | A | A | |
| Compound B-40 | 1 | 0.13 | A | A | Present invention |
| | 2 | 0.12 | A | A | |
| Compound B-64 | 1 | 0.12 | A | A | Present invention |
| | 2 | 0.11 | A | A | |

<Evaluation of the presence of precipitates>
A: No precipitates visually observed
B: A small amount of precipitates visually observed
C: A large amount of precipitates visually observed
D: An extremely large amount of precipitates visually observed
Note)
Bleaching agent 1: Ferric ammonium ethylene-diaminetetraacetate
Bleaching agent 2: Ferric ammonium 1,3-propylenediaminetetraacetate

EXAMPLE 25

Tests were effected in the same manner as in Example 24 except that Compound B-1 was replaced by Compounds B-5, B-23, B-41 and B-67, respectively.

As a result, excellent results were obtained, i.e., no precipitation and little bleach fog even upon running processing as in Example 24.

This tendency was particularly remarkable when a bleaching agent having a high redox potential was used as bleaching agent.

EXAMPLE 26

A multilayer color photographic paper was prepared by coating various layers having the following compositions on a polyethylene double-laminated paper support which had been corona-discharged on the surface thereof. The coating solutions for the various layers were prepared as follows:

Preparation of 1st Layer Coating Solution 60.0 g of a yellow coupler (ExY) and 28.0 g of a discoloration inhibitor (Cpd-1) were dissolved in 150 cc of ethyl acetate, 1.0 cc of a solvent (Solv-3) and 3.0 cc of a solvent (Solv-4). The solution was added to 450 cc of a 10% aqueous solution of sodium dodecylbenzenesulfonate. The mixture was then subjected to dispersion by means of an ultrasonic homogenizer. The dispersion was then mixed with 420 g of a silver chlorobromide emulsion containing a blue-sensitive sensitizing dye as set forth below (silver bromide content: 0.7 mol %) to prepare the 1st layer coating solution.

Coating solutions for the 2nd layer to the 7th layer were prepared in the same manner as mentioned above. As gelatin hardener for each of these layers there was used 1,2-bis(vinylsulfonyl)ethane.

As spectral sensitizing dyes for each of these layers there were used the following compounds:

Blue-sensitive emulsion layer:

Anhydro-5,5'-dichloro-3,3'-disulfoethylthiacyanine hydroxide

Green-sensitive emulsion layer:

Anhydro-9-ethyl-5,5'-diphenyl-3,3'-disulfoethyloxacarbocyanine hydroxide

Red-sensitive emulsion layer:

3,3'-Diethyl-5-methoxy-9,11-neopentylthiadicarbodianine iodide

As stabilizer for each of these layers there was used a 7:2:1 (molar ratio) mixture of 1-(2-Acetoaminophenyl)-5-mercaptotetrazole, 1-phenyl-5-mercaptotetrazole and 1-(p-methoxyphenyl)-5-mercaptotetrazole.

As irradiation-inhibiting dyes there were used the following compounds:

Disodium [3-carboxy-5-hydroxy-4-(3-(3-carboxy-5-oxo-1-(2,5-bisulfonate phenyl)-2-pyrazolin-4-ylidene)-1-propenyl)-1-pyrazolyl]benzene-2,5-disulfonate;

Tetrasodium N,N'-(4,8-dihydroxy-9,10-dioxo-3,7-disulfonateanthracene-1,5-diyl)bis(aminomethanesulfonate);

Disodium [3-cyano-5-hydroxy-4-(3-(3-cyano-5-oxo-1-(4-sulfonatephenyl)-2-pyrazolin-4-ylidene)-1-pentanyl)-1-pyrazolyl]benzene-4-sulfonate

Layer Structure

The composition of each layer will be set forth below. The figure indicates the coated amount of component (g/m$^2$). The coated amount of silver halide emulsion is represented as calculated in terms of silver.

Support

Polyethylene double-laminated paper support which has been corona-discharged on the surface thereof

| | |
|---|---|
| 1st layer: blue-sensitive layer | |
| Above mentioned silver chlorobromide emulsion (AgBr content: 0.7 mol %; cubic; average grain size: 0.9 μm) | 0.29 |
| Gelatin | 1.80 |
| Yellow coupler (ExY) | 0.60 |
| Discoloration inhibitor (Cpd-1) | 0.28 |
| Solvent (Solv-3) | 0.01 |
| Solvent (Solv-4) | 0.03 |
| 2nd layer: color stain inhibiting layer | |
| Gelatin | 0.80 |
| Color stain inhibitor (Cpd-2) | 0.055 |
| Solvent (Solv-1) | 0.03 |
| Solvent (Solv-2) | 0.15 |
| 3rd layer: green-sensitive layer | |
| Above mentioned silver chlorobromide emulsion (AgBr content: 0.7 mol %; cubic; average grain size: 0.45 μm) | 0.18 |
| Gelatin | 1.86 |
| Magenta coupler (ExM) | 0.27 |
| Discoloration inhibitor (Cpd-3) | 0.17 |
| Discoloration inhibitor (Cpd-4) | 0.10 |
| Solvent (Solv-1) | 0.2 |
| Solvent (Solv-2) | 0.03 |
| 4th layer: color stain inhibiting layer | |
| Gelatin | 1.70 |
| Color stain inhibitor (Cpd-2) | 0.065 |
| Ultraviolet absorbent (UV-1) | 0.45 |
| Ultraviolet absorbent (UV-2) | 0.23 |
| Solvent (Solv-1) | 0.05 |
| Solvent (Solv-2) | 0.05 |
| 5th layer: red-sensitive layer | |
| Above mentioned silver chlorobromide emulsion (AgBr content: 4 mol %; cubic; average grain size: 0.5 μm) | 0.21 |
| Gelatin | 1.80 |
| Cyan coupler (ExC-1) | 0.26 |
| Cyan coupler (ExC-2) | 0.12 |
| Discoloration inhibitor (Cpd-1) | 0.20 |
| Solvent (Solv-1) | 0.16 |
| Solvent (Solv-2) | 0.09 |
| Color develoment accelerator (Cpd-5) | 0.15 |
| 6th layer: ultraviolet absorbing layer | |
| Gelatin | 0.70 |
| Ultraviolet absorbent (UV-1) | 0.26 |
| Ultraviolet absorbent (UV-2) | 0.07 |
| Solvent (Solv-1) | 0.30 |
| Solvent (Solv-2) | 0.09 |
| 7th layer: protective layer | |
| Gelatin | 1.07 |

Yellow Coupler (ExY)

α-Pivalyl-α-(3-benzyl-1-hydantoinyl)-2-chloro-5-[β-(dodecylsulfonyl)butylamide]acetanilide Magenta Coupler (ExM)

7-Chloro-6-isopropyl-3-(3-[(2-butoxy-5-tert-octyl)benzenesulfonyl]propyl)-1H-pyrazolo[5,1-C]-1,2,4-triazole Cyan Coupler (ExC-1)

2-Pentafluorobenzamide-4-chloro-5[2-(2,4-di-tert-amylphenoxy)-3-methylbutylamidephenol Cyan Coupler (ExC-2)

2,4-Dichloro-3-methyl-6-[α-(2,4-di-tert-amylphenoxy)-butylamide]phenol

Discoloration Inhibitor (Cpd-1)

$$\left(CH_2-\underset{\substack{|\\ CONHC_4H_9(n)}}{CH}\right)_n$$

Average molecular weight: 80,000

Color Stain Inhibitor (Cpd-2)

2,5-Di-tert-octylhydroquinone

Discoloration Inhibitor (Cpd-3)

7,7'-Dihydroxy-4,4,4',4'-tetramethyl-2,2'-spirochroman

Discoloration Inhibitor (Cpd-4)

N-(4-dodecyloxyphenyl)-morpholine

Color Development Accelerator (Cpd-5)
p-(p-Toluenesulfonamide)phenyl dodecane
Solvent (Solv-1)
Di(2-ethylhexyl)phthalate
Solvent (Solv-2)
Dibutyl phthalate
Solvent (Solv-3)
Di(i-nonyl) phthalate
Solvent (Solv-4)
N,N-diethylcarbonamide-methoxy-2,4-di-t-amylbenzene
Ultraviolet Absorbent (UV-1)
2-(2-Hydroxy-3,5-di-tert-amylphenyl)benzotriazole
Ultraviolet Absorbent (UV-2)
2-(2-Hydroxy-3,5-di-tert-butylphenyl)benzotriazole These specimens were subjected to black-and-white exposure by means of a sensitometer (Type FWH, available from Fuji Photo Film Co., Ltd.).

These specimens were then subjected to the same tests as effected in Example 20 by means of a paper processing machine.

The results are set forth in Table 12.

Table 12 shows that the use of the compound of the present invention as fixing agent in stead of thiosulfate can provide excellent results, i.e., no precipitation, excellent solution stability and low density (Dmin, bleach fog) on the unexposed portion. This tendency was remarkable particularly when a bleaching agent having a high redox potential was used as bleaching agent.

TABLE 12

| Fixing agent | Bleaching agent in blix bath | Magenta density (Dmin) on unexposed portion | Presence of precipitates in blix bath | Presence of precipitates in rinse bath 1 | |
|---|---|---|---|---|---|
| Ammonium thiosulfate | 1 | 0.16 | B | C | Comparative |
| | 2 | 0.20 | D | D | |
| Compound B-1 | 1 | 0.13 | A | A | Present invention |
| | 2 | 0.11 | A | A | |
| Compound B-12 | 1 | 0.14 | A | A | Present invention |
| | 2 | 0.12 | A | A | |
| Compound B-30 | 1 | 0.13 | A | A | Present invention |
| | 2 | 0.12 | A | A | |
| Compound B-65 | 1 | 0.14 | A | A | Present invention |
| | 2 | 0.12 | A | A | |
| Compound B-68 | 1 | 0.13 | A | A | Present invention |
| | 2 | 0.12 | A | A | |

<Evaluation of the presence of precipitates>
A: No precipitates visually observed
B: A small amount of precipitates visually observed
C: A large amount of precipitates visually observed
D: An extremely large amount of precipitates visually observed
Note)
Bleaching agent 1: Ferric ammonium ethylene-diaminetetraacetate
Bleaching agent 2: Ferric ammonium 1,3-propylenediaminetetraacetate

EXAMPLE 27

Tests were effected in the same manner as in Example 26 except that Compound B-1 was replaced by Compounds B-5, B-23, B-26 and B-49, respectively.

As a result, excellent results were obtained, i.e., no precipitation and little bleach fog even upon running processing as in Example 26.

This tendency was particularly remarkable when a bleaching agent having a high redox potential was used as bleaching agent.

EXAMPLE 28

The same color light-sensitive material for picture taking as prepared in Specimen 201 in Example 2 in JP-A-2-90151 was imagewise exposed to light, and then subjected to continuous processing (running test) in the following steps until the replenishment reached twice the tank capacity of the blix bath.

| Processing step | | | | |
|---|---|---|---|---|
| Step | Time | Temperature | Replenishment rate* | Tank capacity |
| Color development | 3 min. 15 sec. | 38.0° C. | 23 ml | 15 l |
| Blix | 2 min. 30 sec. | 38.0° C. | 20 ml | 5 l |
| Rinse 1 | 30 sec. | 38.0° C. | — | 3 l |
| Rinse 2 | 20 sec. | 38.0° C. | 34 ml | 3 l |
| Stabilizing | 20 sec. | 38.0° C. | 20 ml | 3 l |
| Drying | 1 min. | 55.0° C. | | |

*Determined per 35-mm wide and 1-m long light-sensitive material

The rinse was effected in a countercurrent process wherein water flows backward.

The amount of the developer brought over to the bleaching step, the amount of the bleaching solution brought over to the fixing step, and the amount of the fixing solution brought over to the washing step were 2.5 ml, 2.0 ml, and 2.0 ml per m of 35-mm wide light-sensitive material, respectively. The time for crossover was 5 seconds in all the steps. This crossover time is included in the processing time at the previous step.

The various processing solutions had the following compositions:

| | Running Solution | Replenisher |
|---|---|---|
| Developer | | |
| Diethylenetriamine-pentaacetic acid | 2.0 g | 2.2 g |
| 1-Hydroxyethylidene- | 3.3 g | 3.3 g |

-continued

| | Running Solution | Replenisher |
|---|---|---|
| 1,1-diphosphonic acid | | |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-Methyl-4-[N-ethyl-N-(β-hydroxyethyl)amino] aniline sulfate | 4.5 g | 6.1 g |
| Water to make | 1.0 l | 1.0 l |
| pH | 10.05 | 10.15 |
| Blix solution | | |
| Ammonium thiosulfate (700 g/l) | 280 ml | 560 ml |
| or compound of the present invention | 1.32 mol | 2.64 mol |
| Ammonium sulfite | 40.0 g | 80.0 g |
| Ferric ammonium 1,3-propylenediaminetetra-acetate monohydrate | 144.0 g | 288.0 g |
| Ammonium bromide | 40.0 g | 80.0 g |
| Ammonium nitrate | 20.0 g | 40.0 g |
| Water to make | 1.0 l | 1.0 l |
| pH at 25° C. adjusted with acetic acid and aqueous ammonia | 5.8 5.6 | |

Washing Solution (The running solution was used also as replenisher)

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company) so that the calcium and magnesium ion concentrations were each reduced to 3 mg/l or less. Dichlorinated sodium isocyanurate and sodium sulfate were then added to the solution in amounts of 20 mg/l and 150 mg/l, respectively.

The washing solution thus obtained had a pH value of 6.5 to 7.5.

| Stabilizing solution (The running solution was also used as replenisher) | |
|---|---|
| 37% Formalin | 2.0 ml |
| Polyoxyethylene-p-monononylphenylether (mean polymerization degree: 10) | 0.3 g |
| Disodium ethylenediaminetetraacetate | 0.05 g |
| Water to make | 1.0 l |
| pH | 5.8–8.0 |

After the running processing, the blix bath and the rinse bath 1 were visually examined for the presence of precipitates.

The specimen was measured for magenta transmission density (Dmin) on the unexposed portion by means of an X-ray densitometer. The results are set forth in Table 13.

Table 13 Shows that the use of the compound of the present invention as fixing agent in stead of thiosulfate can provide excellent results, i.e., no precipitation, excellent solution stability and low density (Dmin, bleach fog) on the unexposed portion even in the presence of a bleaching agent having a high redox potential.

TABLE 13

| Fixing agent | Magenta density (Dmin) on unexposed portion | Presence of precipitates in blix bath | Presence of precipitates in rinse bath 1 | |
|---|---|---|---|---|
| Ammonium thiosulfate | 0.70 | D | D | Comparative |
| Compound B-1 | 0.59 | A | A | Present invention |
| Compound B-15 | 0.60 | A | A | Present invention |
| Compound B-30 | 0.61 | A | A | Present invention |
| Compound B-40 | 0.60 | A | A | Present invention |
| Compound B-64 | 0.61 | A | A | Present invention |

<Evaluation of the presence of precipitates>
A: No precipitates visually observed
B: A small amount of precipitates visually observed
C: A large amount of precipitates visually observed
D: An extremely large amount of precipitates visually observed

EXAMPLE 29

Tests were effected in the same manner as in Example 28 except that Compound B-1 was replaced by Compounds B-5, B-23, B-41 and B-67, respectively.

As a result, it was found that the use of the fixing agent of the present invention can provide excellent results as in Example 28.

EXAMPLE 30

Tests were effected in the same manner as in Example 28 except that the concentration of the fixing agent (compound of the present invention) in the blix bath was altered to 0.02, 0.08, 0.5, 1.2 and 1.5 mol/l, respectively. The specimen was then measured for the amount of silver left on the unexposed portion by X-ray fluorescence.

However, as bleaching agent there was used only ferric ammonium ethylenediaminetetraacetate. The results are set forth in Table 14.

Table 14 shows that the use of the compound of the present invention in the amount as specified herein can provide excellent results.

TABLE 14

| Fixing agent | Fixing agent concentration (mol/l) | Residual amount of silver on unexposed portion | Magenta density on unexposed portion | Presence of precipitates in blix bath | Presence of precipitates in Rinse bath 1 |
|---|---|---|---|---|---|
| Ammonium thiosulfate | 0.02 | 480 | 1.70 | B | B (C) |
| | 0.08 | 400 | 1.32 | B | B (C) |
| | 0.50 | 5.4 | 0.72 | C | C (C) |
| | 1.20 | 0.8 | 0.68 | D | D (C) |
| | 1.50 | 0.6 | 0.68 | D | D (C) |
| Compound B-1 | 0.02 | 485 | 1.65 | A | A (C) |
| | 0.08 | 420 | 1.39 | A | A (C) |
| | 0.50 | 4.2 | 0.62 | A | A (P) |
| | 1.20 | 0.6 | 0.58 | A | A (P) |
| | 1.50 | 0.5 | 0.57 | | (P) |

TABLE 14-continued

| Fixing agent | Fixing agent concentration (mol/l) | Residual amount of silver on unexposed portion | Magenta density on unexposed portion | Presence of precipitates in blix bath | Presence of precipitates in Rinse bath 1 |
|---|---|---|---|---|---|
| Compound B-15 | 0.02 | 488 | 1.70 | A | A (C) |
| | 0.08 | 430 | 1.43 | A | A (C) |
| | 0.50 | 4.3 | 0.62 | A | A (P) |
| | 1.20 | 0.6 | 0.58 | A | A (P) |
| | 1.50 | 0.5 | 0.58 | | (P) |
| Compound B-30 | 0.02 | 480 | 1.72 | A | A (C) |
| | 0.08 | 420 | 1.40 | A | A (C) |
| | 0.50 | 4.5 | 0.63 | A | A (P) |
| | 1.20 | 0.6 | 0.58 | A | A (P) |
| | 1.50 | 0.5 | 0.58 | | (P) |

<Evaluation of the presence of precipitates>
A: No precipitates visually observed
B: A small amount of precipitates visually observed
C: A large amount of precipitates visually observed
D: An extremely large amount of precipitates visually observed
Note)
P: Present invention
C: Comparative

EXAMPLE 31

Tests were effected in the same manner as in Example 30 except that Compound B-1 was replaced by Compounds B-5, B-23, B-41 and B-67, respectively.

As a result, it was found that the use of the compound of the present invention in the amount as specified herein can provide excellent results as in Example 30.

INDUSTRIAL APPLICABILITY

In accordance with the present invention, the compound represented by the general formula (I) or (II) can be used as fixing agent for processing color photographic light-sensitive materials, and black-and-white light-sensitive materials to accomplish a processing method which provides little stain under heat and humidity conditions and excellent desilvering (fixing) properties.

Further, the compound represented by the general formula (III) or (IV) can be used as fixing agent in the blix solution for processing color photographic paper in a concentration of 0.1 mol/l or more to accomplish a processing method which provides improvements in the stability of the blix solution (no precipitation due to sulfurization) and little bleach fog.

What is claimed is:

1. A process for processing an imagewise exposed silver halide photographic material comprising a support having thereon at least one light-sensitive silver halide emulsion layer, comprising the steps of developing in a developing bath, containing a developing agent and processing in a bath having a fixing ability, wherein the bath having a fixing ability contains as a fixing agent at least one compound represented by formula (I):

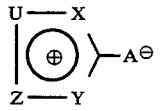

(I)

wherein X represents N or C—$R_1$; Y and Z each represents O, S, N, N—$R_2$ or C—$R_3$; U represents O, S or N—$R_4$; and $A^{\ominus}$ represents —$O^{\ominus}$, —$S^{\ominus}$ or —$N^{\ominus}R$, in which $R_1$, $R_2$, $R_3$ and $R_4$ may be the same or different and each represents $-(T)_nR'$ (wherein T represents —S—, —O—,

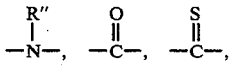

—$SO_2$— or combinations thereof; and n represents 0 or 1); R, R' and R'' may be the same or different and each represents a hydrogen atom, an alkyl group, a cycloalkyl group, an alkenyl group, an alkynyl group or a heterocyclic group, with the proviso that at least one of R, R' and R'' is substituted by a carboxylic acid or sulfonic acid group; and X and U, Y and Z, and Z and U may be ring-closed.

2. The process of claim 1, wherein said compound represented by formula (I) is a compound represented by formula (II):

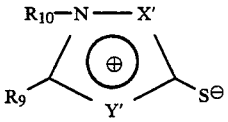

(II)

wherein X' represents N or C—$R_5$; Y' represents O, S, N—$R_6$ or

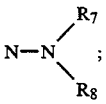

$R_5$, $R_6$, $R_7$, $R_8$, $R_9$ and $R_{10}$ may be the same or different and each represents a substituted or unsubstituted $C_{1-6}$ alkyl group; and $R_5$, $R_6$, $R_7$, $R_8$ and $R_9$ each may be a hydrogen atom, with the proviso that at least one of $R_5$, $R_6$, $R_7$, $R_8$, $R_9$ and $R_{10}$ is substituted by at least one carboxylic acid group or sulfonic acid group.

3. The process of claim 1 or 2, wherein the amount of said compound represented by formula (I) or (II) is contained in the bath having a fixing ability in the range of from $1\times10^{-5}$ to 10 mol/l.

4. The process of claim 1 or 2, wherein when the halogen composition of the silver halide emulsion in the photographic material to be processed is AgBrI (iodide content≧2 mol %), said compound represented by formula (I) or (II) is contained in the bath having a fixing ability in the range of from 0.5 to 2 mol/l.

5. The process of claim 1 or 2, wherein when the halogen composition of the silver halide emulsion in the photographic material to be processed is AgBr or AgBrCl having a high silver chloride content (AgCl content≧80 mol %), said compound represented by formula (I) or (II) is contained in the bath having a fixing ability in the range of from 0.1 to 1 mol/l.

6. The process of claim 1 or 2, wherein said bath having a fixing ability is substantially free of thiosulfates.

7. The process of claim 1 or 2, wherein said bath having a fixing ability is a fixing bath or a blix bath.

8. A processing composition having a fixing ability for processing a silver halide photographic material containing at least one compound represented by formula (I) as set forth in claim 1.

9. The process of claim 1, wherein the silver halide photographic material is a black-and-white silver halide photographic material, and said bath having a fixing ability is a fixing bath containing at least one compound represented by formula (I) as a fixing agent.

10. The process of claim 1, wherein said photographic material is a color photographic material, said developing bath is a color developing bath containing a color developing agent, and said process comprises desilvering following the developing step.

11. The process of claim 10, wherein said desilvering comprises one of (i) bleaching in a bleaching bath containing a bleaching agent and fixing in a fixing bath containing at least one compound represented by formula (I) as a fixing agent, and (ii) bleach-fixing in blix bath containing a bleaching agent and at least one compound represented by formula (I) as a fixing agent.

12. A process for processing an imagewise exposed silver halide color photographic material comprising a support having thereon at least one light-sensitive silver halide emulsion layer, comprising the steps of subjecting the material to color development in a color developing bath containing a color developing agent, and then subjecting the material to blix in a blix bath, wherein said blix bath contains bleaching agent and at least one mesoionic compound represented by formula (III) or (IV) as a fixing agent in an amount of from $2\times10^{-1}$ to 3 mol/l and said blix bath is substantially free of other fixing agents:

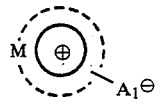

(III)

wherein M represents a 5-membered heterocyclic ring where the ring members of the heterocyclic ring are selected from the group consisting of carbon atom, nitrogen atom, oxygen atom, sulfur atom and selenium atom; and $A_1^{\ominus}$ represents $-O^{\ominus}$, $-S^{\ominus}$ or $-^{\ominus}NR_{11}$ in which $R_{11}$ represents an alkyl group, a cycloalkyl group, an alkenyl group, an alkynyl group, an aralkyl group, an aryl group or a heterocyclic group;

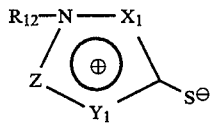

(IV)

wherein $X_1$ represents N or C—$R_{13}$; $Y_1$ represents O, S, N or N—$R_{14}$; Z represents N, N—$R_{15}$ or C—$R_{16}$; and $R_{12}$, $R_{13}$, $R_{14}$, $R_{15}$ and $R_{16}$ each represents an alkyl group, a cycloalkyl group, an alkenyl group, an alkynyl group, an aralkyl group, an aryl group, a heterocyclic group, an amino group, an acylamino group, a sulfonamide group, a ureide group, a sulfamoylamino group, an acyl group, a thioacyl group, a carbamoyl group or a thiocarbamoyl group, with the proviso that $R_{13}$ and $R_{16}$ each may be a hydrogen atom and $R_{12}$ and $R_{13}$, $R_{12}$ and $R_{15}$, $R_{12}$ and $R_{16}$, $R_{14}$ and $R_{15}$, and $R_{14}$ and $R_{16}$ may together form a ring.

13. The process of claim 12, wherein said blix bath contains a bleaching agent having a redox potential of 150 mV or more.

14. The process of claim 12, wherein the 5-membered heterocyclic ring represented by M is selected from the group consisting of an imidazolium ring, a pyrazolium ring, an oxazolium ring, a thiazolium ring, a triazolium ring, a tetrazolium ring, a thiadiazolium ring, an oxadiazolium ring, a thiatriazolium ring and an oxatriazolium ring.

* * * * *